US012595789B2

(12) United States Patent
McAlister et al.

(10) Patent No.: US 12,595,789 B2
(45) Date of Patent: Apr. 7, 2026

(54) FACILITATING FLUID OR SLURRY MOVEMENT IN A PERISTALTIC PUMP

(71) Applicant: SEPRO MINERAL SYSTEMS CORP., Langley (CA)

(72) Inventors: Steven Alexander McAlister, Langley (CA); Carlo Alberto Socci, Langley (CA)

(73) Assignee: SEPRO MINERAL SYSTEMS CORP., Langley (CA)

( * ) Notice: Subject to any disclaimer, the term of this patent is extended or adjusted under 35 U.S.C. 154(b) by 0 days.

(21) Appl. No.: 18/707,139

(22) PCT Filed: Nov. 1, 2022

(86) PCT No.: PCT/CA2022/051614
§ 371 (c)(1),
(2) Date: May 2, 2024

(87) PCT Pub. No.: WO2023/077219
PCT Pub. Date: May 11, 2023

(65) Prior Publication Data

US 2025/0012267 A1 Jan. 9, 2025

Related U.S. Application Data

(60) Provisional application No. 63/274,871, filed on Nov. 2, 2021.

(51) Int. Cl.
*F04B 43/12* (2006.01)
*F04B 43/08* (2006.01)

(52) U.S. Cl.
CPC ..... *F04B 43/1261* (2013.01); *F04B 43/082* (2013.01); *F04B 43/1223* (2013.01); *F04B 43/1238* (2013.01); *F04B 43/1246* (2013.01)

(58) Field of Classification Search
CPC combination set(s) only.
See application file for complete search history.

(56) References Cited

U.S. PATENT DOCUMENTS 314,851 A 3/1885 Kelly
2,406,485 A 8/1946 Arnold
(Continued)

FOREIGN PATENT DOCUMENTS

CA 2961235 A1 9/2018
DE 29600517 U1 4/1996
(Continued)

OTHER PUBLICATIONS

"Pinch Valve Mechanism—Understanding How it Works" https://www.pinch-valves.com/2017/05/02/pinch-valve-mechanism/, Accessed Oct. 20, 2022.
(Continued)

*Primary Examiner* — Binh Q Tran
(74) *Attorney, Agent, or Firm* — Kolitch Romano Dascenzo Gates LLC

(57) ABSTRACT

An apparatus for facilitating control of fluid or slurry movement in a collapsible tube is provided. The apparatus includes the tube. The tube includes first and second opposing wall portions having circumferentially varying thickness including first and second maximum thicknesses respectively, the first and second maximum 5 thicknesses disposed on opposite sides of the tube, and third and fourth opposing wall portions between the first and second opposing wall portions, the third and fourth opposing wall portions having third and fourth circumferentially minimum thicknesses respectively, the third and fourth minimum thicknesses disposed on opposite sides of the tube about halfway between the first and second maximum thicknesses. 10 wherein the first and second opposing wall portions are configured to be engaged by a tube engager to cause the tube
(Continued)

to fold at the third and fourth minimum thicknesses to seal the tube. Other apparatuses, systems, and methods are disclosed.

67 Claims, 31 Drawing Sheets

(56) References Cited

U.S. PATENT DOCUMENTS

| | | | | |
|---|---|---|---|---|
| 2,693,766 | A | 11/1954 | Seyler | |
| 2,695,766 | A | 11/1954 | Peltz | |
| 2,987,004 | A | 6/1961 | Murray | |
| 3,128,716 | A | 4/1964 | Stallman | |
| 3,176,622 | A | 4/1965 | Pfeiffer | |
| 3,192,863 | A | 7/1965 | Vadot | |
| 3,295,556 | A | 1/1967 | Gertsma | |
| 3,406,633 | A | 10/1968 | Schomburg | |
| 3,446,247 | A | 5/1969 | Manning | |
| 3,508,587 | A | 4/1970 | Mauch | |
| 3,649,138 | A | 3/1972 | Clay et al. | |
| 3,721,269 | A | 3/1973 | Choate | |
| 3,749,153 | A | 7/1973 | Fauquembergue | |
| 4,110,061 | A | 8/1978 | Gerritsen | |
| 4,131,399 | A * | 12/1978 | Calvet | F04B 43/0072 138/119 |
| 4,214,855 | A | 7/1980 | Gerritsen | |
| 4,424,009 | A | 1/1984 | Van Os | |
| 4,515,536 | A | 5/1985 | Van Os | |
| 5,067,879 | A * | 11/1991 | Carpenter | F04B 43/0072 138/119 |
| 5,088,522 | A | 2/1992 | Rath | |
| 5,215,450 | A * | 6/1993 | Tamari | F04B 43/0072 138/119 |
| 5,415,532 | A | 5/1995 | Loughnane et al. | |
| 5,561,453 | A | 10/1996 | Shibata | |
| 5,662,144 | A | 9/1997 | Lo | |
| 6,029,711 | A | 2/2000 | Koch | |
| 6,675,835 | B2 | 1/2004 | Gerner | |
| 7,762,794 | B2 | 7/2010 | Harada | |
| 10,557,465 | B2 | 2/2020 | Fremy | |
| 2003/0138335 | A1 | 7/2003 | Doi | |
| 2005/0115622 | A1 | 6/2005 | Bennett | |
| 2006/0251532 | A1 * | 11/2006 | Fujii | F04B 43/1253 417/477.1 |
| 2007/0148022 | A1 | 6/2007 | Cheng | |
| 2007/0224063 | A1 | 9/2007 | Postma | |
| 2009/0280016 | A1 | 11/2009 | Carroll | |
| 2010/0202907 | A1 * | 8/2010 | Klein | F04B 43/1261 417/476 |
| 2010/0316516 | A1 | 12/2010 | Vidal | |
| 2012/0020822 | A1 | 1/2012 | Richardson | |
| 2013/0092277 | A1 * | 4/2013 | Garrett | B29C 53/582 156/428 |
| 2014/0037479 | A1 | 2/2014 | Klein | |
| 2014/0053941 | A1 | 2/2014 | Belcak | |
| 2015/0354555 | A1 * | 12/2015 | Gledhill, III | F04B 43/1292 417/477.1 |
| 2018/0003168 | A1 * | 1/2018 | Yaeguchi | F04B 45/08 |
| 2020/0072210 | A1 | 3/2020 | Barth | |

FOREIGN PATENT DOCUMENTS

| | | | |
|---|---|---|---|
| FR | 2677711 | A1 | 12/1992 |
| JP | 2015212525 | A | 11/2015 |
| KR | 101870347 | B1 | 6/2018 |

OTHER PUBLICATIONS

Esser, Falk et al. "Silent Pumpers: A Comparative Topical Overview of the Peristaltic Pumping Principle in Living Nature Engineering and Biomimetics" Adv. Intell. Syst. 2019.

Fuhrer, Roland et al. "Soft Iron/Silicon Composite Tubes for Magnetic Peristaltic Pumping: Frequency-Dependent Pressure and vol. Flow" Adv. Funct. Mater. 2013.

Sepro Systems, "Peristaltic Pumps Operation | Sepro Mixing & Pumping," https://www.youtube.com/watch?v=PW8dQRiA0UM, Published May 5, 2021.

Sepro Systems, "Peristaltic Pump Features & Options | Sepro Mixing & Pumping," https://www.youtube.com/watch?v=t9y_kAVnRak, Published May 5, 2021.

Sepro Systems, "Peristaltic Pumps Vs Diaphragm Pumps | Sepro Industrial Mixing Experts," https://www.youtube.com/watch?v=cDzWzep4Mwk, Published Sep. 17, 2020.

International Search Report and Written Opinion of the International Searching Authority from the European Patent Office, in PCT/CA2022/051614 dated Nov. 1, 2022, which is an international application to which this application claims priority.

* cited by examiner

FACILITATING FLUID OR SLURRY MOVEMENT IN A PERISTALTIC PUMP

CROSS REFERENCES

This application claims the benefit of U.S. provisional patent application No. 63/274,871 entitled "FACILITATING FLUID OR SLURRY MOVEMENT IN A PERISTALTIC PUMP", filed on Nov. 2, 2021, which is hereby incorporated by reference herein in its entirety.

BACKGROUND

1. Field

Embodiments of this disclosure relate to controlling fluid or slurry movement and more particularly to facilitating control of fluid or slurry movement in a collapsible tube.

2. Description of Related Art

Some known devices for controlling fluid or slurry movement in a collapsible tube, such as, in a peristaltic pump or a pinch valve, may include collapsible tubes, which may have inner and outer surfaces having only generally circular and/or cylindrical shaped cross sections or may have shapes that are not conducive to high pressure sealing or pumping. Some known devices may include cylindrical or planar rollers and/or tube engaging surfaces that are generally cylindrical or planar or may have shapes that are not conducive to high pressure sealing or pumping, high flow rate pumping, and/or ease of manufacturing. Such devices may be poorly suited for extended tube life, passage of large particles, high pressure sealing or peristaltic pumping, high flow rate peristaltic pumping, and/or ease of manufacturing.

SUMMARY

In accordance with various embodiments, there is provided an apparatus for facilitating control of fluid or slurry movement in a collapsible tube, the apparatus including the tube. The tube includes first and second opposing wall portions having circumferentially varying thickness including first and second maximum thicknesses respectively, the first and second maximum thicknesses disposed on opposite sides of the tube, and third and fourth opposing wall portions between the first and second opposing wall portions, the third and fourth opposing wall portions having third and fourth circumferentially minimum thicknesses respectively, the third and fourth minimum thicknesses disposed on opposite sides of the tube about halfway between the first and second maximum thicknesses, wherein the first and second opposing wall portions are configured to be engaged by a tube engager to cause the tube to fold at the third and fourth minimum thicknesses to seal the tube.

The apparatus may be configured to facilitate fluid or slurry movement in a peristaltic pump and the first and second opposing wall portions may be configured to be engaged by the tube engager to cause the tube to fold at the third and fourth minimum thicknesses to peristaltically seal the tube.

The third and fourth minimum thicknesses may each extend less than 10% about a circumference of the tube.

The third and fourth minimum thicknesses may each extend less than 2% about the circumference of the tube.

The third and fourth minimum thicknesses may each extend a negligible portion about the circumference of the tube.

Each of the third and fourth wall portions may have circumferentially varying thickness.

An outer surface of the tube may include outer surfaces of the first, second, third, and fourth wall portions, the outer surface of the tube having a generally circular cross sectional profile when the tube is relaxed.

An inner surface of the tube may include inner surfaces of the first, second, third, and fourth wall portions, the inner surface of the tube having a generally elliptical cross sectional profile when the tube is relaxed.

The tube may include a first length portion, the first, second, third, and fourth wall portions extending along the first length portion, and the tube may include a second length portion and a third length portion coupled to opposite ends of the first length portion, wherein the second length portion has a generally constant wall thickness between an inner surface and an outer surface of the second length portion and the third length portion has a generally constant wall thickness between an inner surface and an outer surface of the third length portion.

The inner surfaces of the second and third length portions of the tube may each have a generally circular cross sectional profile.

The inner surface of the second length portion of the tube, the third length portion of the tube, or both, may have a cross sectional circumference greater than 95% of a cross sectional circumference of an inner surface of the first length portion of the tube.

The cross-sectional circumference of the inner surface of the second length portion, the third length portion, or both may be between 95% and 105% of the cross sectional circumference of the inner surface of the first length portion of the tube.

The tube may include a first transition length portion extending between the first and second length portions and a second transition length portion extending between the first and third length portions, the first and second transition length portions including wall thicknesses that vary generally linearly along lengths of the first and second transition length portions.

The first and second maximum thicknesses may be generally equal and the third and fourth minimum thicknesses may be generally equal and a ratio of the first and second maximum thicknesses over the third and fourth minimum thicknesses may be between 1.5 and 5.

The first and second maximum thicknesses may be generally equal and the third and fourth minimum thicknesses may be generally equal and a ratio of the first and second maximum thicknesses over the third and fourth minimum thicknesses may be at least 1.5

A cross sectional circumference of an inner surface of the tube at the first, second, third, and fourth wall portions may be at least 314 mm.

The first and second maximum thicknesses may be generally equal and the third and fourth minimum thicknesses may be generally equal and a ratio of the first and second maximum thicknesses over the third and fourth minimum thicknesses may be at least 2.0.

A cross sectional circumference of an inner surface of the tube at the first, second, third, and fourth wall portions may be at least 471 mm.

The first and second maximum thicknesses may be generally equal and the third and fourth minimum thicknesses may be generally equal and a ratio of the first and second maximum thicknesses over the third and fourth minimum thicknesses may be at least 3.5.

A cross sectional circumference of an inner surface of the tube at the first, second, third, and fourth wall portions may be at least 942 mm.

Each of the third and fourth minimum thicknesses may be less than or equal to 35 mm.

The apparatus may include the tube engager, the tube engager including first and second tube engaging surfaces configured to engage the first and second wall portions of the tube respectively to cause the tube to fold at the third and fourth minimum thicknesses to seal the tube, wherein the first and second tube engaging surfaces are configured to define a spacing between the first and second tube engaging surfaces to compress the tube during sealing, the spacing varying along a width of the first and second tube engaging surfaces and having a greatest spacing at around a middle width position of the first and second tube engaging surfaces.

The first tube engaging surface may include, on each side of the middle width position, a plurality of surface portions at respective width positions along the width of the first and second tube engaging surfaces, each of the surface portions of the first tube engaging surface having a distinct non-zero slope relative to the width.

The slopes of the surface portions may increase for a first width as the width positions of the surface portions move outward from the middle width position.

The slopes of the surface portions may decrease for a second width as the width positions of the surface portions move outward from the first width.

A maximum slope of the slopes of the surface portions may be between 20 and 40 degrees.

The spacing may be constant at the greatest spacing for a central width at around the middle width position of the first and second tube engaging surfaces.

The central width may be at least 10% of a width of the first tube engaging surface.

The central width may be between 10% and 30% of the width of the first tube engaging surface.

The second tube engaging surface may be shaped generally as a reflection of the first tube engaging surface at the spacing.

The second tube engaging surface may have a slope that is generally zero and constant along the width of the second tube engaging surface.

The apparatus may include a roller including the first tube engaging surface.

The apparatus may include a tube engaging wall including the second tube engaging surface.

The first tube engaging surface may be configured to maintain a longitudinal position along the tube when folding the tube against the second tube engaging surface such that the apparatus acts as a closed pinch valve when the tube is folded and sealed.

The first tube engaging surface may be configured to travel along a length of the first wall portion while folding the tube against the second tube engaging surface to peristaltically force fluid in the tube along the tube.

The apparatus may include a rotor, the first tube engaging surface pivotably coupled to the rotor, wherein the rotor is configured to rotate to cause the first tube engaging surface to engage the first wall portion of the tube and the second tube engaging surface to engage the second wall portion of the tube to cause the tube to fold at the third and fourth minimum thicknesses to seal the tube and to travel along the length of the first wall portion.

The apparatus may include a driver coupled to the rotor and configured to cause the rotor to rotate.

The apparatus may include the tube engager, wherein the tube engager includes a vessel configured to surround the tube and hold a hydraulic fluid in engagement with the tube, the tube engager configured to selectively increase pressure of the hydraulic fluid to cause the tube to fold at the third and fourth minimum thicknesses to seal the tube.

The tube may include fifth and sixth opposing wall portions and seventh and eighth opposing wall portions longitudinally spaced from the first, second, third, and fourth wall portions and wherein the fifth and sixth opposing wall portions have circumferentially varying thickness including fifth and sixth maximum thicknesses respectively, the fifth and sixth maximum thicknesses disposed on opposite sides of the tube, the seventh and eighth opposing wall portions are disposed between the fifth and sixth opposing wall portions, the seventh and eighth opposing wall portions having seventh and eighth circumferentially minimum thicknesses respectively, the seventh and eighth minimum thicknesses disposed on opposite sides of the tube about halfway between the fifth and sixth maximum thicknesses, the fifth and sixth opposing wall portions are configured to be engaged by the hydraulic fluid to cause the tube to fold at the seventh and eighth minimum thicknesses to seal the tube, and the seventh and eighth minimum thicknesses are greater than the third and fourth minimum thicknesses such that the tube is configured to fold at the third and fourth minimum thicknesses when the pressure of the hydraulic fluid is at a first pressure level and the tube is configured to fold at the seventh and eighth minimum thicknesses when the pressure of the hydraulic fluid is at a second pressure level greater than the first pressure level.

Thickness of the tube may vary generally linearly longitudinally along the tube from the third and fourth minimum thicknesses to the seventh and eighth minimum thicknesses.

The fifth and sixth maximum thicknesses may be greater than the first and second maximum thicknesses.

The apparatus may include an isolation valve in fluid communication between the vessel and a pressure source, the isolation valve configured to selectively increase the pressure of the hydraulic fluid in the vessel when the isolation valve is opened and an exhaust valve in fluid communication between the vessel and an exhaust, the exhaust valve configured to selectively decrease the pressure of the hydraulic fluid in the vessel when the exhaust valve is opened.

The apparatus may include an inlet valve configured to selectively open to provide fluid to the tube and an outlet valve configured to selectively open to facilitate flow of fluid out of the tube.

The tube engager may be configured to raise the pressure of the hydraulic fluid from an initial pressure level lower than the first pressure level upwards and through the first pressure level to cause the tube to fold at the third and fourth minimum thicknesses to seal the tube and to continue raising the pressure of the hydraulic fluid from the first pressure level to the second pressure level to cause the tube to fold at the seventh and eighth minimum thicknesses to seal the tube, such that fluid or slurry in the tube is peristaltically forced longitudinally from the third and fourth minimum thicknesses to the seventh and eighth minimum thicknesses along the tube.

The tube includes ninth and tenth opposing wall portions and eleventh and twelfth opposing wall portions longitudinally spaced from the first, second, third, and fourth wall portions such that the first, second, third, and fourth wall portions are disposed longitudinally between the fifth, sixth, seventh, and eighth wall portions and the ninth, tenth, eleventh, and twelfth portions and wherein the ninth and tenth opposing wall portions have circumferentially varying thickness including ninth and tenth maximum thicknesses respectively, the ninth and tenth maximum thicknesses disposed on opposite sides of the tube, the eleventh and twelfth opposing wall portions are disposed between the ninth and tenth opposing wall portions, the eleventh and twelfth opposing wall portions having eleventh and twelfth circumferentially minimum thicknesses respectively, the eleventh and twelfth minimum thicknesses disposed on opposite sides of the tube about halfway between the ninth and tenth maximum thicknesses, the ninth and tenth opposing wall portions are configured to be engaged by the hydraulic fluid to cause the tube to fold at the eleventh and twelfth minimum thicknesses to seal the tube, and the eleventh and twelfth minimum thicknesses are greater than the third and fourth minimum thicknesses such that the tube is configured to fold at the eleventh and twelfth minimum thicknesses when the pressure of the hydraulic fluid is at the second pressure level greater than the first pressure level.

The tube engager may be configured to raise the pressure of the hydraulic fluid from an initial pressure level lower than the first pressure level upwards and through the first pressure level to cause the tube to fold at the third and fourth minimum thicknesses to seal the tube and to continue raising the pressure of the hydraulic fluid from the first pressure level to the second pressure level to cause the tube to fold at the seventh and eighth minimum thicknesses and the eleventh and twelfth minimum thicknesses to seal the tube, such that fluid or slurry in the tube is peristaltically forced longitudinally from the third and fourth minimum thicknesses outward to the seventh and eighth minimum thicknesses and the eleventh and twelfth minimum thicknesses along the tube when the tube sealed.

Thickness of the tube may vary generally linearly longitudinally along the tube from the third and fourth minimum thicknesses to the eleventh and twelfth minimum thicknesses.

The third and fourth minimum thicknesses may extend longitudinally along the tube for a length of at least 10% of an inner circumference of the tube at the first, second, third, and fourth wall portions of the tube.

The third and fourth minimum thicknesses may extend longitudinally along the tube for a length of at least 50% of the inner circumference of the tube at the first, second, third, and fourth wall portions of the tube.

In accordance with various embodiments, there is provided an apparatus for facilitating control of fluid or slurry movement in a collapsible tube, the apparatus including a tube engager including first and second tube engaging surfaces configured to engage first and second opposing wall portions of the tube respectively to cause the tube to fold to seal the tube, wherein the first and second tube engaging surfaces are configured to define a spacing between the first and second tube engaging surfaces to compress the tube during sealing, the spacing varying along a width of the first and second tube engaging surfaces and having a greatest spacing at around a middle width position of the first and second tube engaging surfaces.

The apparatus may be configured to facilitate fluid or slurry movement in a peristaltic pump and the first and second tube engaging surfaces may be configured to engage the first and second opposing wall portions of the tube to cause the tube to fold to peristaltically seal the tube.

The first tube engaging surface may include, on each side of the middle width position, a plurality of surface portions at respective width positions along the width of the first and second tube engaging surfaces, each of the surface portions of the first tube engaging surface having a distinct non-zero slope relative to the width.

The slopes of the surface portions may increase for a first width as the width positions of the surface portions move outward from the middle width position.

The slopes of the surface portions may decrease for a second width as the width positions of the surface portions move outward from the first width.

A maximum slope of the slopes of the surface portions may be between 20 and 40 degrees.

The spacing may be constant at the greatest spacing for a central width at around the middle width position of the first and second tube engaging surfaces.

The central width may be at least 10% of a width of the first tube engaging surface.

The central width may be between 10% and 30% of the width of the first tube engaging surface.

The second tube engaging surface may be shaped generally as a reflection of the first tube engaging surface at the spacing.

The second tube engaging surface may have a slope that is generally zero and constant along the width of the second tube engaging surface.

The apparatus may include a roller including the first tube engaging surface.

The apparatus may include a tube engaging wall including the second tube engaging surface.

The first tube engaging surface may be configured to maintain a longitudinal position along the tube when folding the tube against the second tube engaging surface such that the apparatus acts as a closed pinch valve when the tube is folded and sealed.

The first and second tube engaging surfaces may be configured to travel along a length of the first and second wall portions while folding the tube to peristaltically force fluid in the tube along the tube.

The apparatus may include a rotor, the first tube engaging surface pivotably coupled to the rotor, wherein the rotor is configured to rotate to cause the first tube engaging surface to engage the first wall portion of the tube and the second tube engaging surface to engage the second wall portion of the tube to cause the tube to fold at the third and fourth minimum thicknesses to seal the tube and to travel along the length of the first wall portion.

The apparatus may include a driver coupled to the rotor and configured to cause the rotor to rotate.

Other aspects and features of embodiments of the present disclosure will become apparent to those ordinarily skilled in the art upon review of the following description of specific embodiments of the present disclosure in conjunction with the accompanying figures.

BRIEF DESCRIPTION OF THE DRAWINGS

In drawings which illustrate embodiments of the present disclosure.

DETAILED DESCRIPTION

Figure 1:
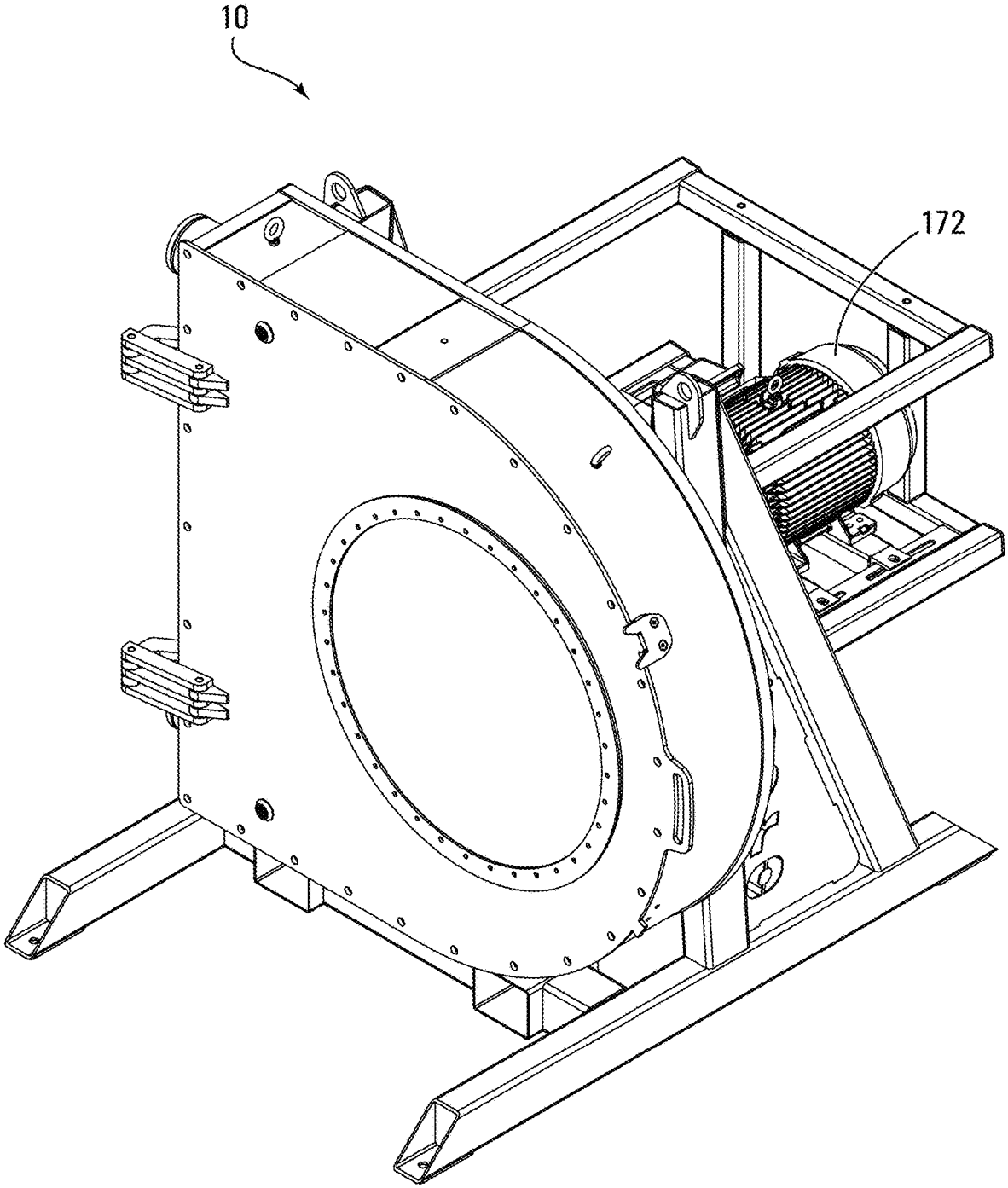
FIG. 1 is an isometric view of an apparatus for facilitating control of fluid or slurry movement in a collapsible tube, according to various embodiments.

Referring to FIG. 1, there is shown an isometric view of an apparatus 10 for facilitating control of fluid or slurry movement in a collapsible tube, according to various embodiments. In various embodiments, the apparatus 10 may be configured to facilitate fluid or slurry movement in a peristaltic pump. In various embodiments, the apparatus 10 and/or elements thereof may facilitate extended tube life, passage of large particles, reduced force for pumping or sealing, high pressure peristaltic pumping or sealing and/or high flow rate peristaltic pumping, which may be desirable in various applications such as, for example, vacuum truck applications, peristaltic pumps or valves, such as pinch valves, used with paste backfill, sewage sludge, oily, silty waste water produced by oil wells, fluid transfer in chemical plants, thickener underflow, fish, and/or other peristaltic pumping or valve applications including industrial peristaltic pumping and/or pinch valve applications. In various embodiments, the apparatus 10 may facilitate pumping at maximum pressure of 25 bar and/or maximum flow of 120 $m^3/h$, for example.

Figure 2:
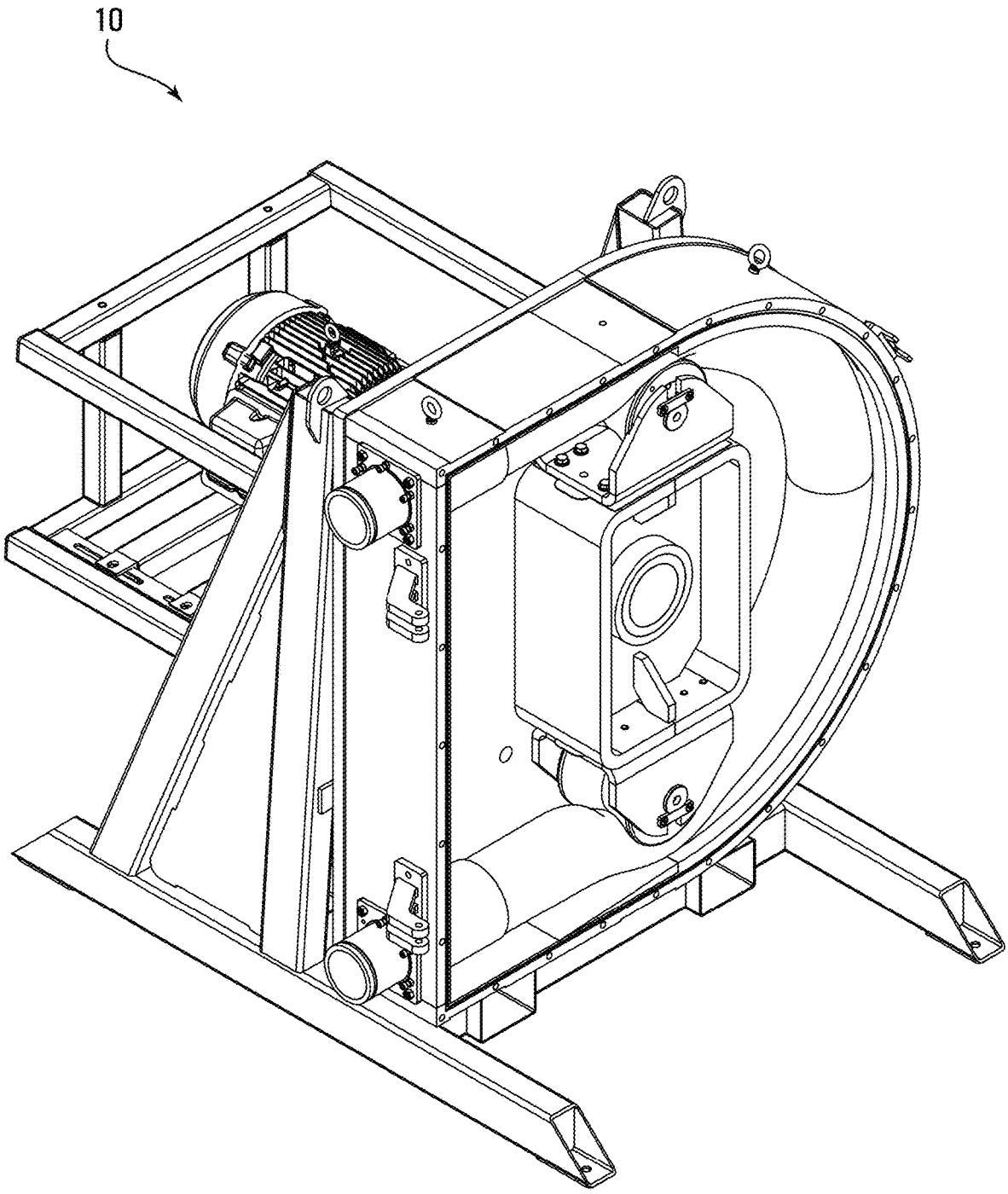
FIG. 2 is an isometric view of the apparatus shown in FIG. 1, with a cover removed, according to various embodiments.
Figure 3:
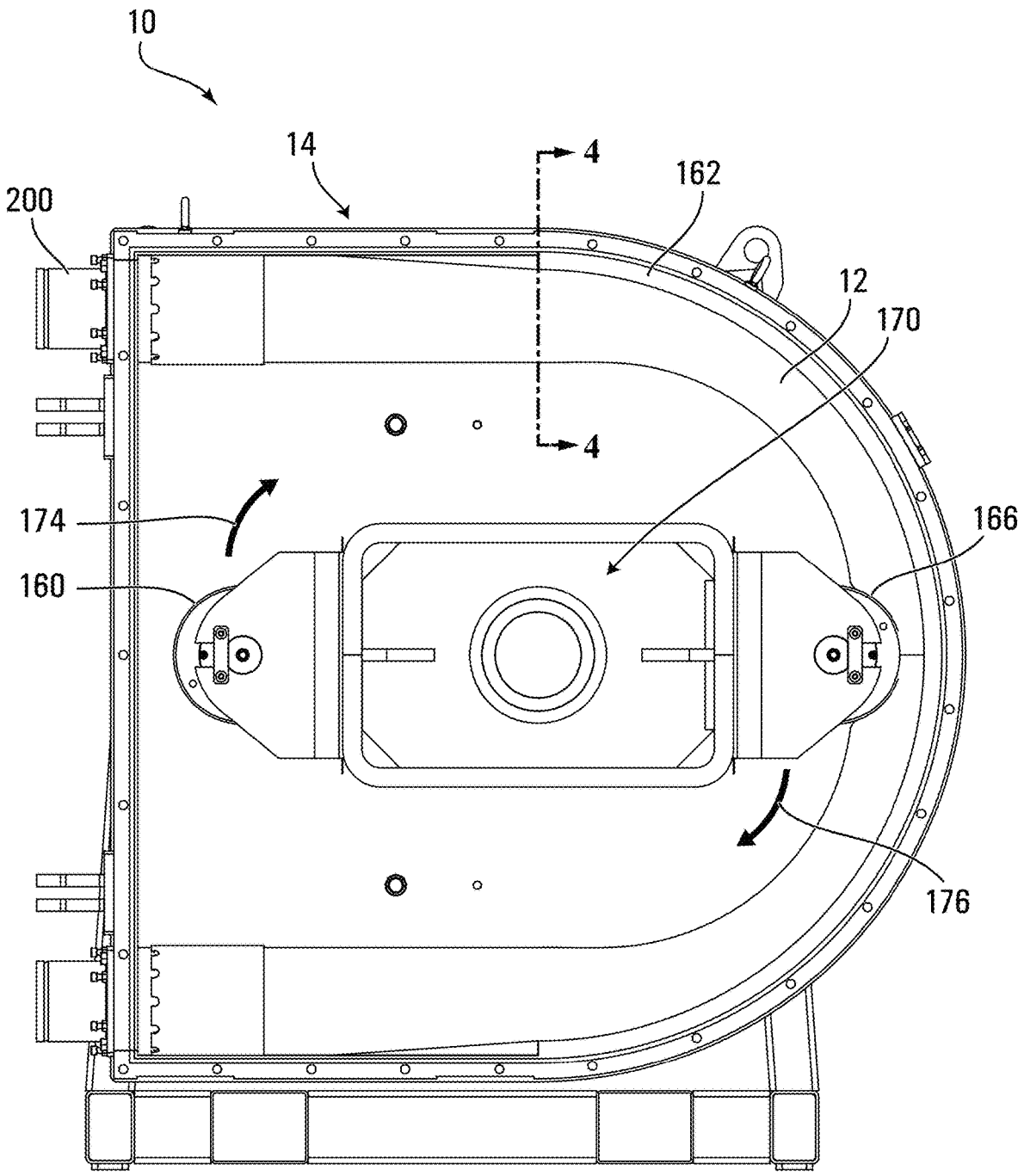
FIG. 3 is a front view of the apparatus shown in FIG. 1 in a first configuration, with the cover removed, according to various embodiments.

Referring to FIG. 2, there is shown the apparatus 10 of FIG. 1 with a cover of the apparatus removed such that inner elements of the apparatus are visible, according to various embodiments. Referring to FIG. 3, a front view of the apparatus 10 with the cover removed is shown according to various embodiments. Referring to FIG. 3, in some embodiments, the apparatus 10 may include a tube 12.

Figure 4:
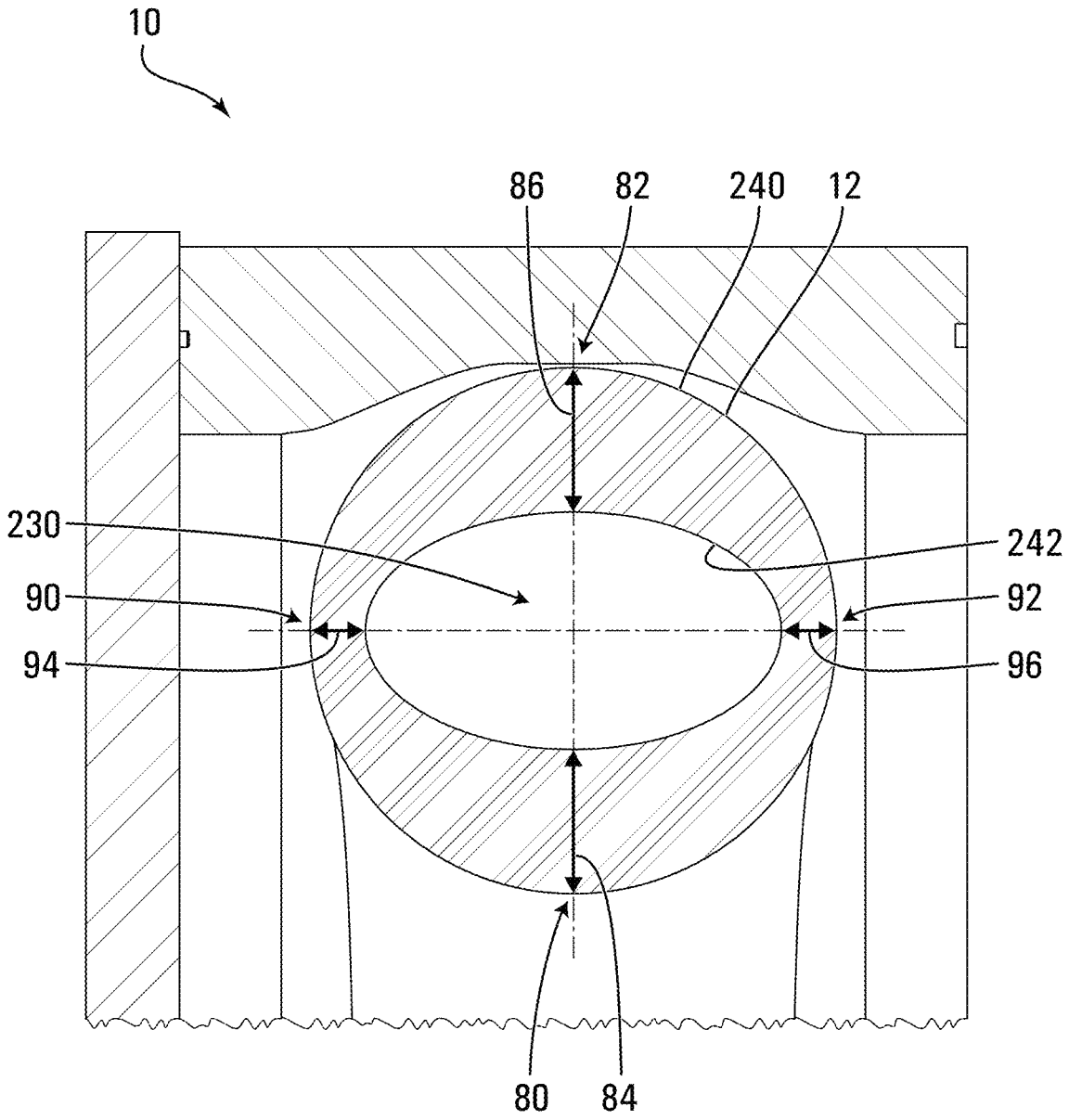
FIG. 4 is a sectional view of a portion of the apparatus shown in FIG. 3 according to various embodiments.

Referring to FIG. 3, there is shown at 4, a depiction of a cross-section upon which a sectional view shown in FIG. 4 of the tube 12 in a relaxed or open state is taken, according to various embodiments. Referring to FIG. 4, the tube 12 is shown with midsection lines, for reference. Referring to FIG. 4, in various embodiments, the tube 12 includes first and second opposing wall portions 80 and 82 having circumferentially varying thickness including first and second maximum thicknesses 84 and 86 respectively, the first and second maximum thicknesses disposed on opposite sides of the tube 12. In various embodiments, the thicknesses of the first and second opposing wall portions 80 and 82 varying circumferentially may mean that the thicknesses vary around the tube, at a single longitudinal or lengthwise/axial location or length of the tube 12.

In various embodiments, the tube 12 includes third and fourth opposing wall portions 90 and 92 between the first and second opposing wall portions 80 and 82, the third and fourth opposing wall portions 90 and 92 having third and fourth circumferentially minimum thicknesses 94 and 96 respectively, the third and fourth minimum thicknesses disposed on opposite sides of the tube 12 about halfway between the first and second maximum thicknesses 84 and 86.

In various embodiments, the first and second opposing wall portions 80 and 82 may be configured to be engaged by a tube engager or tube engaging system 14 shown in FIG. 3 to cause the tube 12 to fold at the third and fourth minimum thicknesses 94 and 96 to seal the tube. In various embodiments, the apparatus 10 may include the tube engager 14. In various embodiments, sealing the tube 12 may involve peristaltically sealing the tube by compressing the tube 12 to create a seal and moving the seal along a length of the tube while retaining the seal to push or pump fluid along the tube.

Figure 5:
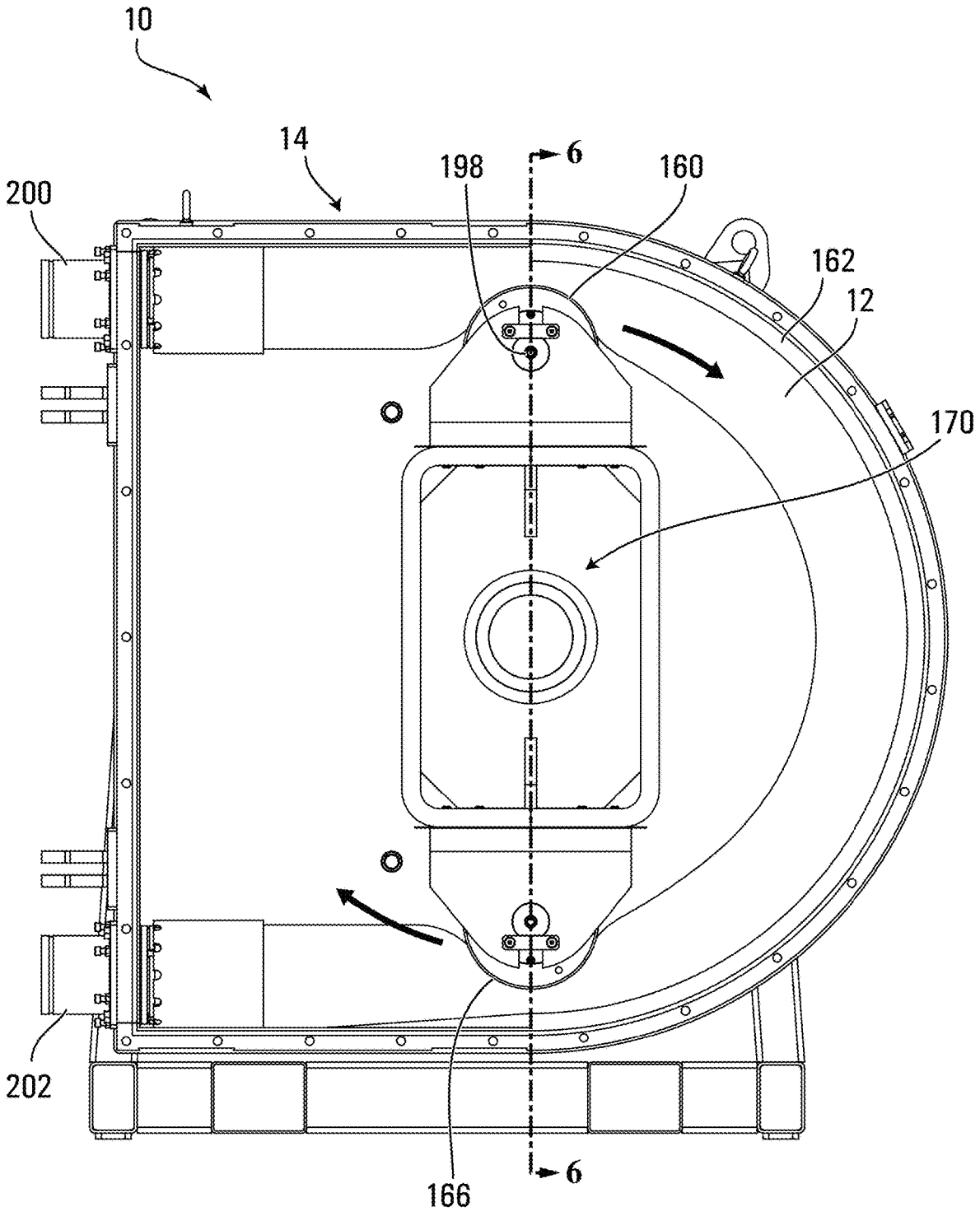
FIG. 5 is a front view of the apparatus shown in FIG. 1 in a second configuration, with the cover removed, according to various embodiments.

Referring to FIG. 3, the tube engager 14 may include a first roller 160 and a tube engaging wall 162. Referring to FIG. 3, in various embodiments, the tube engager 14 may include a second roller 166, which may be generally similar to the first roller 160. The first and second rollers 160 and 166 may be pivotably coupled to a rotor 170 and the rotor may be configured to rotate to cause the first and second rollers 160 and 166 to move in the directions shown by arrows 174 and 176 from a first configuration shown in FIG. 3 to a second configuration shown in FIG. 5. Referring to FIG. 5, there is shown at 6, a depiction of a cross-section upon which a partial sectional view shown in FIG. 6 of the tube 12 in a folded sealed state is taken, according to various embodiments.

Figure 6:
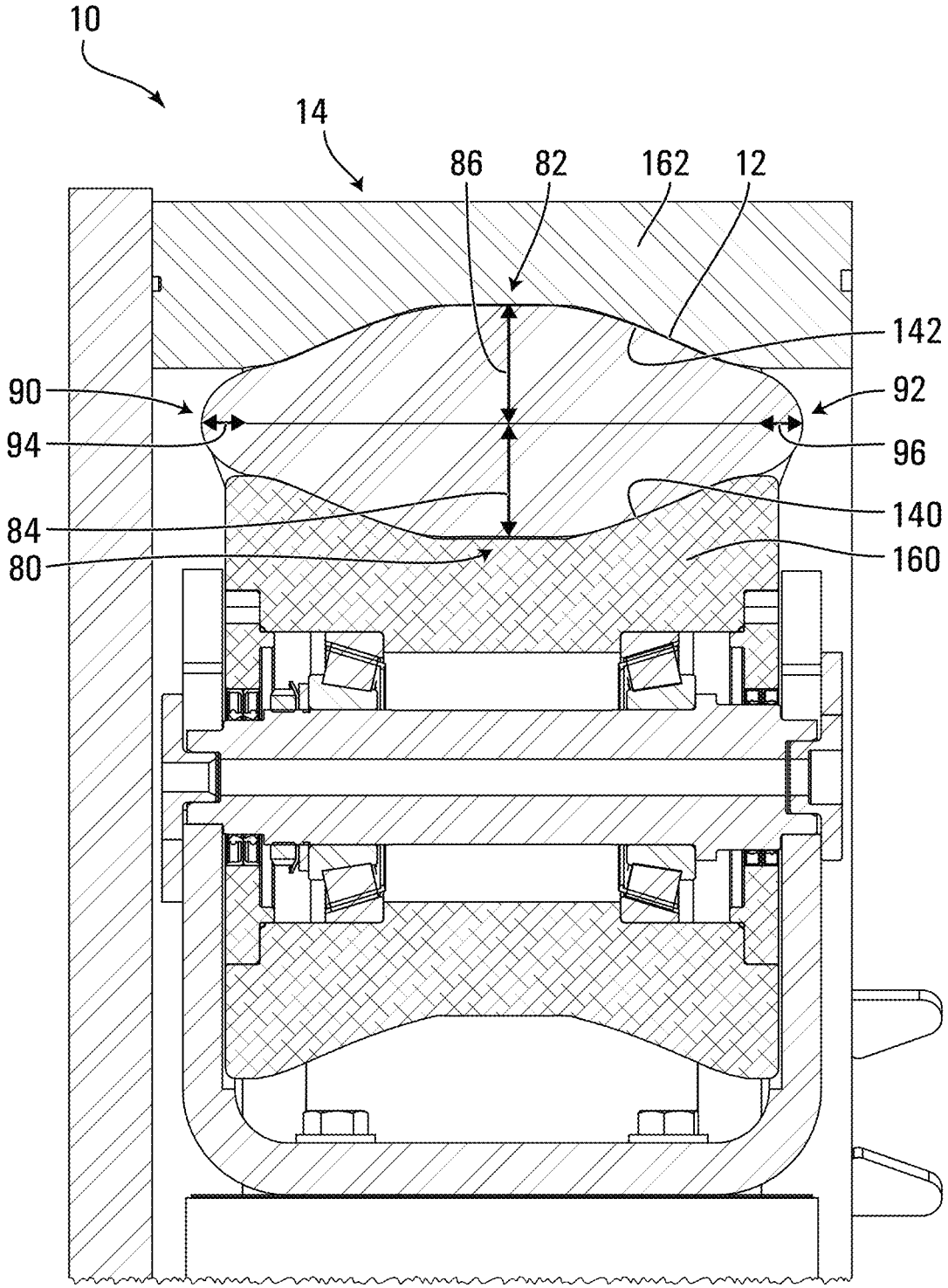
FIG. 6 is a partial sectional view of a portion of the apparatus shown in FIG. 5, according to various embodiments.

Referring to FIG. 6, in various embodiments, the tube engager 14 may include first and second tube engaging surfaces 140 and 142 configured to engage the first and second opposing wall portions 80 and 82 of the tube 12 respectively to cause the tube to fold to seal the tube. For example, in some embodiments, the first roller 160 and the tube engaging wall 162 may include the first and second tube engaging surfaces 140 and 142 respectively. In various embodiments, the first tube engaging surface 140 may be configured to travel along a length of the first wall portion 80 while folding the tube 12 against the second tube engaging surface 142 to peristaltically force fluid in the tube along the tube. In some embodiments, the rotor 170 may be configured to rotate to cause the first tube engaging surface 140 to engage the first wall portion 80 of the tube 12 and the second tube engaging surface 142 to engage the second wall portion 82 of the tube 12 to cause the tube to fold at the third and fourth minimum thicknesses 94 and 96 to seal the tube and to travel along the length of the first wall portion.

In various embodiments, the first roller 160 may be configured to roll or travel along a length of the tube 12, while engaging and sealing the tube 12 against the tube engaging wall 162, to move a seal or point at which the tube 12 is sealed along a length of the tube 12 while the tube is sealed. In various embodiments, this may cause fluid or slurry in the tube 12 to move through the tube along the length of the tube with the first roller 160. In various embodiments, the first roller 160 may have a generally rotationally symmetric shape, such that the first tube engaging surface 140 that engages the tube 12 remains generally the same shape during engagement and rolling of the first roller 160. In various embodiments, the tube engaging wall 162 may retain a generally constant cross sectional shape along an arc following the path of the first roller 160, such that the second tube engaging surface 142 that engages the tube 12 remains generally the same shape relative to the tube and the first tube engaging surface 140 during engagement with the tube 12 opposite the first tube engaging surface 140.

Referring to FIGS. 1 and 3, in various embodiments, the rotor 170 may be coupled to a driver 172, such that the driver 172 is configured to cause the rotor to rotate. In some embodiments, the driver 172 may include a 3-phase 4-pole electric motor coupled to a gearbox configured to drive the rotor 170. In some embodiments, maximum continuous draw may be ~100 KW and/or the rotor 170 may be driven at about 20-25 RPM. Referring to FIG. 3, in various embodiments, the second roller 166 may function generally similarly to the first roller 160, but offset by 180 degrees, moving in the direction shown by the arrow 176.

Figure 7:
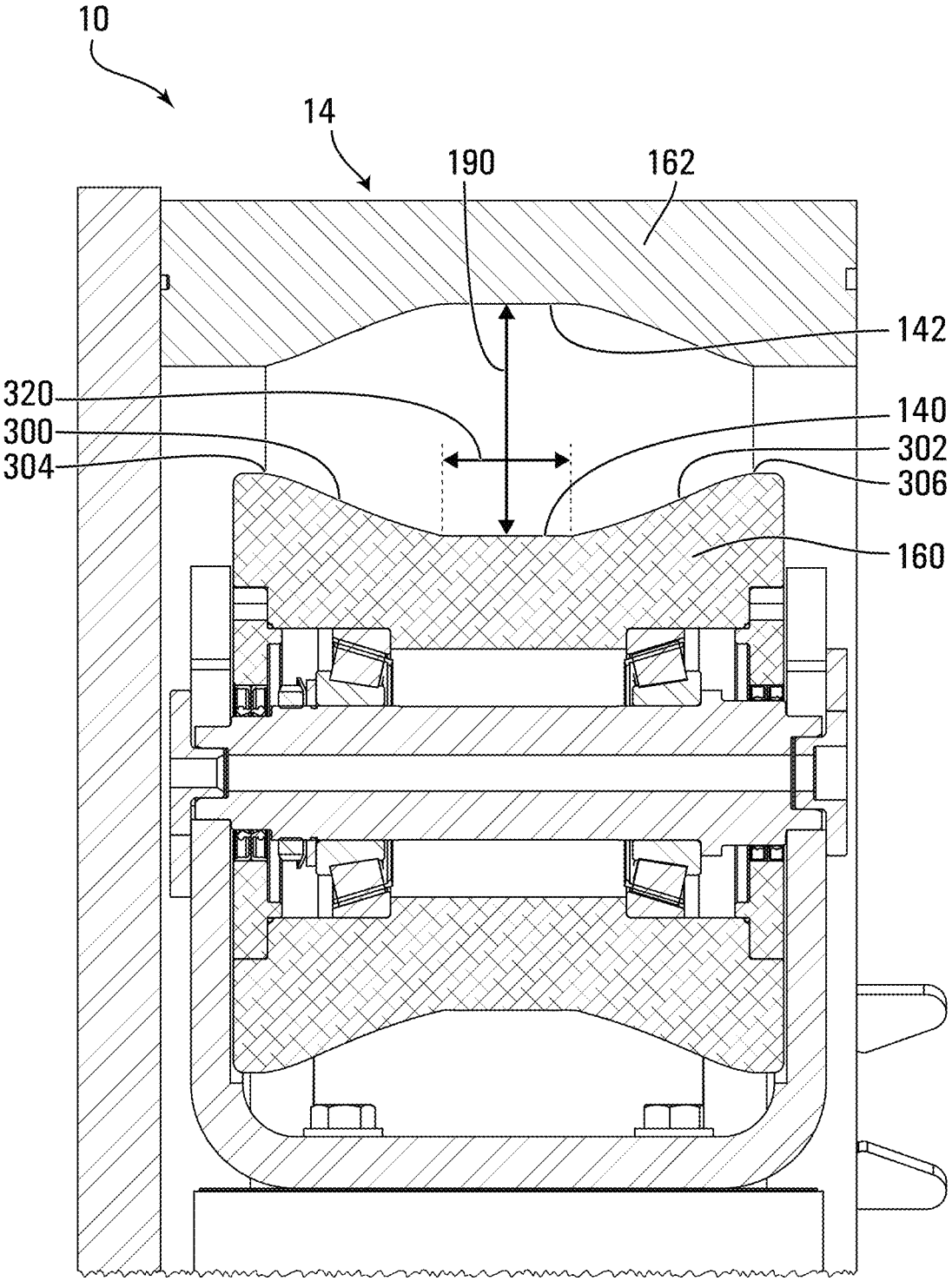
FIG. 7 is a sectional view of a portion of the apparatus shown in FIG. 5, with the tube removed, according to various embodiments.

Referring to FIG. 7, there is shown the sectional view of the tube engager 14 shown in FIG. 6 but with the tube 12 removed, for illustration purposes. In various embodiments, the first and second tube engaging surfaces 140 and 142 of the tube engager 14 may be configured to define a spacing between the first and second tube engaging surfaces to compress or seal the tube during sealing, the spacing varying along a width of the first and second tube engaging surfaces and having a greatest spacing at around a middle width position of the first and second tube engaging surfaces. The greatest spacing at the middle width position is shown at 190 in FIG. 7. In various embodiments, the spacing being greatest at the middle width position shown at 190 may facilitate generally simultaneous sealing of the tube 12 along a width of the tube 12, when the tube 12 is compressed between the first and second tube engaging surfaces 140 and 142.

In some embodiments, this generally simultaneous sealing along the width may facilitate a strong seal that may reduce or avoid leaks and/or openings even under high pressure and/or high flow rate peristaltic pumping. In some embodiments, the shape of the spacing may generally correspond to the shape of the compressed or sealed tube 12 as shown in FIG. 6, such that total thickness of the tube 12 when sealed is generally equal to the spacing between the first and second tube engaging surfaces 140 and 142 across the width of the tube 12. In various embodiments, the space between the surfaces 140 and 142 may be less than the sum total thickness of the compressed tube 12 to facilitate compressing the tube walls considerably in order to achieve a seal. In various embodiments, ~10 mm of squeeze after reaching the initial 'touch point' may be required to seal at 25 bar, for example.

In various embodiments, the rollers 160 and 166 may be made of a durable hard material, such as, for example, 6061 Aluminum or Ultra High Molecular Weight Polyethylene (UHMW). In various embodiments, the tube engaging wall may be made of a durable hard material such as, for example, Carbon Steel or Ductile Iron.

Referring back to FIG. 3, during operation, fluid or slurry may be provided at an input port 200 of the apparatus 10 in fluid communication with a first end of the tube 12. For example, in some embodiments, fluid or slurry may be provided from a thickener, tank or vessel situated above or below the pump. In some embodiments, the fluid or slurry may include sewage sludge, finely ground mineral ore, water/sand mixtures, clay suspensions, oily water, paste backfill, liquid hydrocarbons, concrete and/or another fluid or slurry, for example.

Referring to FIGS. 1-3, the driver 172 may cause the rotor 170 to rotate such that the first and second rollers 160 and 166 move in the directions shown by the arrows 174 and 176 and the first roller 160 may engage with the tube 12 as shown in FIG. 5. Referring to FIG. 6, in various embodiments, the first tube engaging surface 140 of the first roller 160 may engage the first wall portion 80 of the tube 12 and compress the tube 12 against the second tube engaging surface 142 of the tube engaging wall 162, such that the tube 12 folds at the minimum thicknesses 94 and 96 of the tube 12. In various embodiments, the first roller 160 may travel or move along the length of the first wall portion 80. In various embodiments, this may move the seal along the length of the tube 12 as the rotor 170 rotates 180 degrees from the position shown in the second configuration shown in FIG. 5. In various embodiments, the first roller 160 may roll or pivot about an axis 198 as the first roller 160 travels on an arc at a constant spacing from the tube engaging wall 162.

In various embodiments, as the rotor 170 rotates 180 degrees from the second configuration shown in FIG. 5 such that the first roller 160 travels along a 180 degree arc adjacent to the tube engaging wall 162, fluid or slurry in the tube 12 ahead of the first roller 160 may be urged or pumped towards an output port 202 of the apparatus 10, the output port 202 in fluid communication with a second end of the tube 12. In various embodiments, as the rotor 170 rotates 180 degrees from the second configuration shown in FIG. 5, the tube 12 may open back up behind the first roller 160 and draw fluid or slurry in from the input port 200. In various embodiments, the tube 12 may reopen behind the roller 160 to a relaxed or open state, generally as shown in FIG. 4.

Referring to FIGS. 4 and 6, in various embodiments, the tube 12 having circumferentially varying thicknesses, including the first and second opposing wall portions 80 and 82 with first and second maximum thicknesses 84 and 86 on opposite sides of the tube 12, may facilitate having a large sectional area 230 for high flow rates, while also encouraging resilient re-opening of the tube 12 after the first roller 160 has folded the tube. In some embodiments, this may facilitate use of the tube 12 with higher flow rates. In various embodiments, the increased thicknesses at the first and second maximum thicknesses 84 and 86 may facilitate sealing of the tube, while requiring reduced folding angles and/or compression travel of the first roller 160 against the tube 12. In various embodiments, this may facilitate use with higher flow rates and/or pressures and/or may reduce wear and tear on the tube 12 during use. In various embodiments, longitudinal folding or buckling of the tube 12 at locations where the tube 12 is not compressed by the first or second rollers 160 or 166 may also be avoided and/or reduced by the increased thicknesses at the first and second maximum thicknesses 84 and 86. In some embodiments, reduction of longitudinal folding or buckling may reduce or obviate requiring longitudinal support of the tube 12 where the tube is not engaged by the first roller 160.

In various embodiments, when the tube 12 is in a relaxed or open state shown in FIG. 4, the first and second maximum thicknesses 84 and 86 may each be about 61.5 mm, the third and fourth minimum thicknesses 94 and 96 may each be about 23 mm, and an outside diameter of the tube may be about 225 mm. In various embodiments, the first and second maximum thicknesses 84 and 86 may be generally equal and the third and fourth minimum thicknesses 94 and 96 may be generally equal and a ratio of the first and second maximum thicknesses 84 and 86 over the third and fourth minimum thicknesses 94 and 96 may be between 1.5 and 5. In various embodiments, this ratio may facilitate higher flow rates and/or pressures and/or may reduce wear and tear on the tube 12 during use. In some embodiments, the ratio may be about 2.7, for example.

In various embodiments, the thicknesses 84, 86, 94, and 96 may be chosen such that the tube 12 does not collapse under vacuum while at the same time having thin minimum thicknesses. In some embodiments, the thinner the side wall, the less force it may take to fold it and lower folding forces may mean less heat generation, which may lead to longer hose life.

In accordance with various embodiments, the third and fourth minimum thicknesses 94 and 96 may be less than or equal to 35 mm. In various embodiments, the third and fourth minimum thicknesses 94 and 96 being less than or equal to 35 mm may facilitate flat squeezing of the tube 12.

In some embodiments, increased thickness of the first and second maximum thicknesses 84 and 86 may reduce the likelihood of a large solid particle damaging the tube engager 14 if the particle were to be caught between the first and second tube engaging surfaces 140 and 142 during compression of the tube 12.

In various embodiments, the tube 12 may be made of rubber reinforced with fabric laid in layers. In some embodiments, the tube 12 may be configured to be used with pressures of 25 bar and may have 6 layers or plys of fabric reinforcement, for example.

Referring to FIGS. 4 and 6, in various embodiments, the tube 12 having the third and fourth minimum thicknesses 94 and 96 at about halfway between the first and second maximum thicknesses 84 and 86 may facilitate ease of folding the tube 12 during engagement and/or compression between the first and second tube engaging surfaces 140 and 142 shown in FIG. 6. In various embodiments, this may facilitate use of increased speed for the roller 160, increased life of the tube 12, and/or increased life of the tube engager 14 during repeated compression/folding of the tube 12 when the apparatus 10 is in use.

In some embodiments, the thicker walls on the first and second opposing wall portions 80 and 82 of the tube 12 may facilitate construction of larger industrial peristaltic pumps by providing better resistance to vacuum collapse and/or reduction or removal of the need for supports to prevent hose buckling. In some embodiments, the thicker walls on the first and second opposing wall portions 80 and 82 and the thinner walls on the third and fourth opposing wall portions 90 and 92 may facilitate passage of larger solid particles, require less energy for pumping, and/or result in a less expensive apparatus due to lower forces required to seal the tube 12.

Referring to FIG. 4, in some embodiments, an outer surface 240 of the tube 12 may include outer surfaces of the first, second, third, and fourth wall portions 80, 82, 90, and 92, the outer surface 240 of the tube having a generally circular cross sectional profile when the tube is relaxed as shown in FIG. 4. Accordingly, in various embodiments, the outer surface 240 of the tube 12 may have a generally circular cross sectional profile when not compressed or sealed by the tube engager 14. In various embodiments, a generally circular cross sectional profile of the outer surface 240 when the tube 12 is relaxed may facilitate ease of manufacturing.

In some embodiments, the tube 12 may have an inner surface 242 including inner surfaces of the first, second, third, and fourth wall portions 80, 82, 90, and 92. In various embodiments, the inner surface 242 may have a generally elliptical cross sectional profile when the tube 12 is relaxed. In various embodiments, a generally elliptical cross section for the inner surface when relaxed may facilitate keeping a large cross sectional area inside the tube 12 for fluid flow.

In various embodiments, the ellipse major axis may be about 178 mm and the ellipse minor axis may be about 103.5 mm. In various embodiments, the area of the ellipse may be about 14,469 $mm^2$ Referring to FIG. 4, in some embodiments, the third and fourth minimum thicknesses 94 and 96 may be kept relatively small (i.e., the minimum thickness may not extend significantly around a circumference of the tube 12). In various embodiments, keeping the third and fourth minimum thicknesses from extending significantly about the circumference of the tube 12 may facilitate reduced forces required for folding of the tube 12 during sealing, while maintaining thickness required for reopening after sealing. In some embodiments, for example, the third and fourth minimum thicknesses 94 and 96 may extend less than 10% about a circumference of the tube 12. In some embodiments, this may facilitate some reduction in force for folding the tube 12, while maintaining manufacturability. In some embodiments, the third and fourth minimum thicknesses may each extend less than about 2% about the circumference of the tube. In some embodiments, this may facilitate an improved reduction in force for folding the tube 12, while maintaining manufacturability. In some embodiments, the third and fourth minimum thicknesses may each extend a negligible portion about the circumference of the tube 12. In various embodiments, this may facilitate further improved reduction in force for folding the tube 12.

Referring to FIG. 6, in various embodiments, whereas the first and second wall portions 80 and 82 are contacted by the first and second tube engaging surfaces 140 and 142, the third and fourth wall portions 90 and 92 may be considered to be wall portions that are not contacted by the first and second tube engaging surfaces 140 and 142. Referring to FIG. 4, in various embodiments, each of the third and fourth wall portions 90 and 92 may have circumferentially varying thickness. In various embodiments, the third and fourth wall portions 90 and 92 having varying or non-constant thickness may facilitate control over where the tube 12 folds and/or reduced forces required for folding of the tube 12 during sealing, while maintaining a resistance to vacuum collapse required for reopening under vacuum after sealing.

Referring to FIG. 7, wherein the tube engager 14 is shown without the tube 12, for illustration purposes, in various embodiments, the shape of the first and second tube engaging surfaces 140 and 142 may facilitate strong sealing of the tube 12. For example, in some embodiments, the shape of the first and second tube engaging surfaces 140 and 142 may facilitate a seal that occurs generally simultaneously across the width of the tube 12.

Referring to FIG. 7, in some embodiments, the first tube engaging surface 140 may include, on each side of the middle width position, a plurality of surface portions at respective width positions along the width of the first and second tube engaging surfaces, each of the surface portions of the first tube engaging surface having a distinct non-zero slope relative to the width. Thus, in various embodiments, the slope of the first tube engaging surface 140 may vary along its width. In some embodiments, this may facilitate sealing of the tube 12 whereby the seal occurs generally simultaneously across the width of the tube. In various embodiments, such sealing may facilitate improved high pressure and/or high flow rate peristaltic pumping and reduce leaks through the seal during sealing or pumping. In some embodiments, this variance may cause the spacing between the first and second tube engaging surfaces 140 and 142 to generally correspond to thickness of the tube 12 when compressed as shown in FIG. 6. In some embodiments, the surface portions may provide a continuous surface having a changing slope, such as a curved surface, for example.

In some embodiments, the slopes of the surface portions may increase for a first width as the width positions of the surface portions move outward from the middle width position. Referring to FIG. 7, for example, in some embodiments, the slope of a surface portion of the first tube engaging surface 140 may be zero at the middle width position. In some embodiments, the slope may increase up to the width positions 300 and 302 shown in FIG. 7. In some embodiments, a maximum slope of the slopes of the surface portions may be between 20 and 40 degrees. In some embodiments, this may facilitate use of the first tube engaging surface 140 with the tube 12, allowing the tube to flatten while being compressed and facilitating sealing of the tube 12 whereby the seal occurs generally simultaneously across the width of the tube. In some embodiments, the maximum slope may be about 25 degrees, for example.

In various embodiments, the slopes of the surface portions may decrease for a second width as the width positions of the surface portions move outward from the first width. Referring to FIG. 7, for example, the slope may decrease as the width positions move outward from the width position 300 and the slope may decrease as the width positions move outward from the width position 302. In various embodiments, the decrease in slope may continue until the slope is about zero at width positions 304 and 306, for example, In various embodiments, the slope may stay at about zero for a width distance outward of the width positions 304 and 306.

In some embodiments, the spacing may be constant at the greatest spacing shown at 190 for a central width 320 at around the middle width position of the first and second tube engaging surfaces. For example, in some embodiments, the central width 320 may be at least about 10% of a width of the first tube engaging surface 140. In various embodiments, the central width 320, where the spacing is constant, being non-zero may facilitate sealing of the tube 12 whereby the tube is folded consistently and the seal occurs generally simultaneously across the width of the tube. In some embodiments, the central width 320 may be between about 10% and 30% of the width of the first tube engaging surface 140. In some embodiments the central width 320 being between 10% and 30% of the width of the first tube engaging surface 140 may facilitate sealing of the tube 12 whereby the seal occurs generally simultaneously across the width of the tube. In some embodiments, the central width 320 may be about 52 mm and the width of the first tube engaging surface may be about 266 mm, for example. Accordingly, in various embodiments, the central width 320 may be about 20% of the width of the first tube engaging surface 140.

Figure 8:
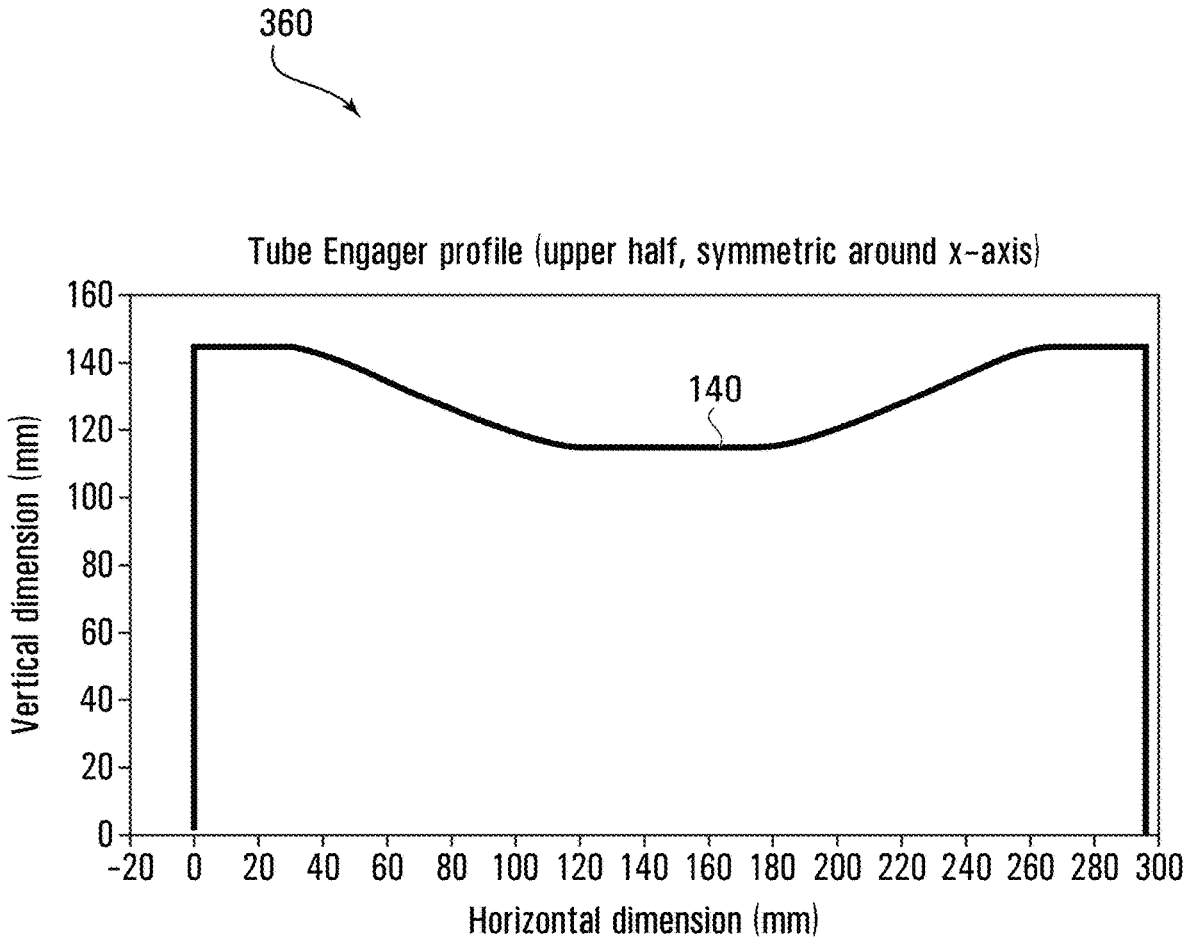
FIG. 8 is a depiction of profile dimensions of the first tube engaging surface shown in FIG. 7, according to various embodiments.

Referring to FIG. 8, there is shown at 360 a depiction of the profile dimensions of the first tube engaging surface 140 shown in FIG. 7, in accordance with various embodiments. Referring to FIG. 8, in various embodiments, the distance between the width positions 304 and 306 may be about 236 mm and a change in height from the central width 320 and the width positions 304 and 306 shown in FIG. 7 may be about 30 mm. In some embodiments, the width outward of the width positions 304 and 306 where the slope is zero may be about 30 mm, for example. The below table shows some X and Y positions for the profile 360 shown in FIG. 8, according to various embodiments.

| X [mm] | Y [mm] |
|---|---|
| 0.000 | 0.000 |
| 0.000 | 145.000 |
| 30.000 | 145.000 |
| 36.545 | 143.692 |
| 43.090 | 141.739 |
| 49.635 | 139.176 |
| 56.180 | 136.232 |
| 62.725 | 133.328 |
| 69.270 | 130.657 |
| 75.815 | 127.828 |
| 82.360 | 125.257 |
| 88.905 | 122.819 |
| 95.450 | 120.608 |
| 101.995 | 118.575 |
| 108.540 | 116.804 |
| 115.085 | 115.366 |
| 121.630 | 114.760 |
| 128.175 | 114.760 |
| 134.720 | 114.760 |
| 141.265 | 114.760 |

-continued

| X [mm] | Y [mm] |
|---|---|
| 147.810 | 114.760 |
| 154.355 | 114.760 |
| 160.900 | 114.760 |
| 167.445 | 114.760 |
| 173.990 | 114.760 |
| 180.535 | 115.366 |
| 187.080 | 116.804 |
| 193.625 | 118.575 |
| 200.170 | 120.608 |
| 206.715 | 122.819 |
| 213.260 | 125.257 |
| 219.805 | 127.828 |
| 226.350 | 130.657 |
| 232.895 | 133.328 |
| 239.440 | 136.232 |
| 245.985 | 139.176 |
| 252.530 | 141.739 |
| 259.075 | 143.692 |
| 265.620 | 145.000 |
| 295.620 | 145.000 |
| 295.620 | 0.000 |

In various embodiments, the second tube engaging surface 142 may be shaped generally as a reflection of the first tube engaging surface 140 at the spacing. In various embodiments, this may facilitate a straight and/or flat seal of the tube 12, which may facilitate reduced maximum folding angles and/or wear and tear on the tube 12. In various embodiments, the tube engaging wall 162 may be shaped such that the second tube engaging surface follows the path of the roller 160 such that the second tube engaging surface 142 continues to reflect the first tube engaging surface 140 at the minimum spacing between the first and second tube engaging surfaces 140 and 142 while the roller moves on the path.

Figure 9:
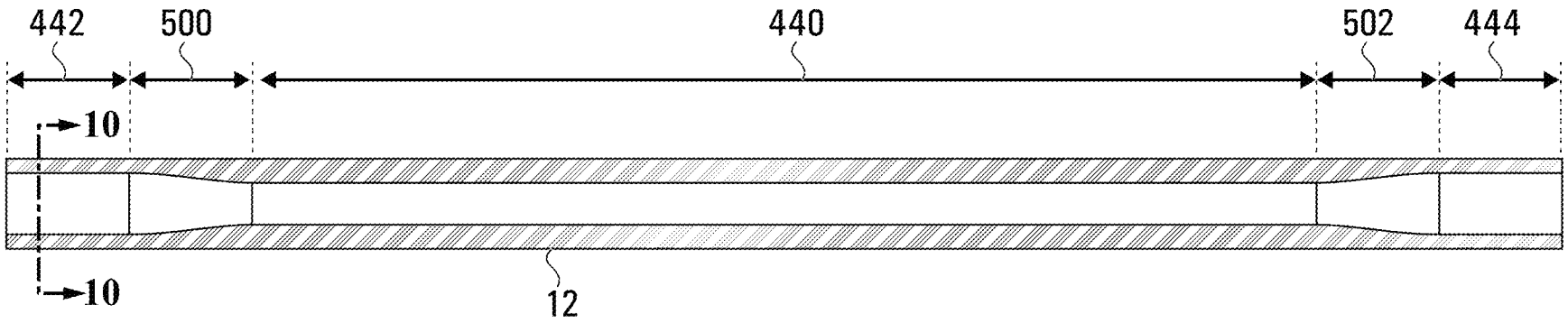
FIG. 9 is a sectional view of a tube of the apparatus shown in FIG. 1, according to various embodiments.

Referring now to FIG. 9, there is shown a cross sectional view of the tube 12 of the apparatus 10 shown in FIGS. 1 to 5, the tube 12 being shown in isolation and unbent, the cross section taken along a vertical axis of the tube 12, according to various embodiments. Referring to FIG. 9, the tube includes a first length portion 440. In various embodiments, the first, second, third, and fourth wall portions 80, 82, 90 and 92 shown in FIG. 4, for example, may extend along the first length portion 440. Accordingly, in various embodiments, a cross sectional view of the tube 12 along the first length portion 440 may look generally similar to the cross section of the tube 12 shown in FIG. 4. Referring still to FIG. 9, in various embodiments, the tube 12 may include a second length portion 442 and a third length portion 444 coupled to opposite ends of the first length portion 440, wherein the second length portion 442 has a generally constant wall thickness between an inner surface and an outer surface of the second length portion and the third length portion 444 has a generally constant wall thickness between an inner surface and an outer surface of the third length portion. In various embodiments, the generally constant wall thickness may facilitate coupling of the tube 12 to inputs and outputs, such as, for example, the input and output ports 200 and 202 shown in FIG. 5. In some embodiments, the generally constant wall thickness may facilitate ease of flow within the tube 12 and/or ease of manufacturing.

Figure 10:
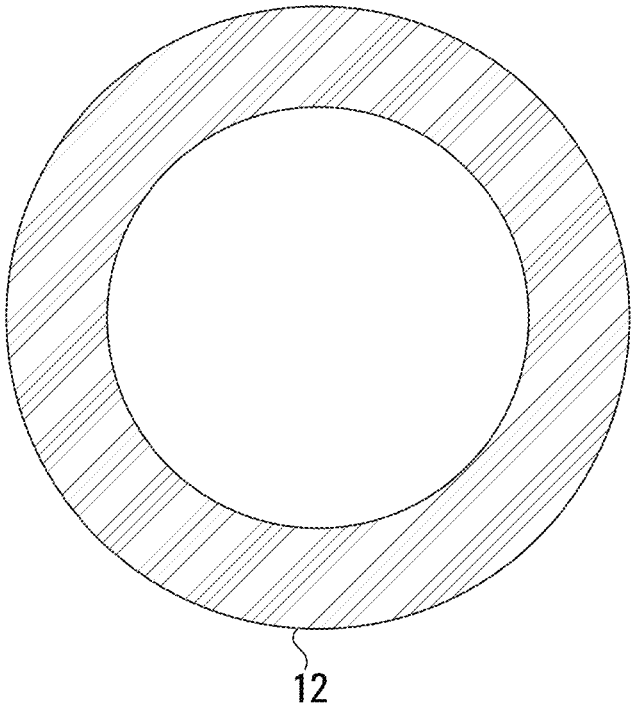
FIG. 10 is a sectional view of a tube of the apparatus shown in FIG. 1, according to various embodiments.

In various embodiments, the inner surfaces of the second and third length portions 442 and 444 of the tube 12 may each have a generally circular cross sectional profile. Referring to FIG. 9, there is shown at 10, a depiction of a cross-section upon which a sectional view shown in FIG. 10 of the tube 12 is taken, according to various embodiments. In various embodiments, the generally circular cross sectional profile shown in FIG. 10 may facilitate coupling, higher flow rates within the tube 12 and/or ease of manufacturing.

Referring to FIG. 9, in various embodiments, the inner surfaces of the second and third length portions 442 and 444 of the tube 12 may each have a cross sectional circumference that is about equal to or larger than the cross sectional circumference of the inner surface of the first length portion 440 of the tube 12. In some embodiments, the inner surface of the second length portion 442 of the tube 12, the third length portion 444 of the tube 12, or both may have a cross sectional circumference greater than 95% of a cross sectional circumference of the inner surface of the tube 12 at the inner surfaces of the first, second, third, and fourth wall portions 80, 82, 90, and 92. In various embodiments, the inner surfaces of the second length portion 442, the third length portion 444, or both having a cross sectional circumference greater than 95% of a cross sectional circumference of the inner surface of the first length portion 440 of the tube 12 may facilitate pulling of a mandrel, such as, an elliptically shaped mandrel, out of the tube 12 during manufacturing. In various embodiments, the circumference at the first length portion 440 of the tube 12 may be slightly larger (by a ratio of about 100:95, for example) than the circumference of the tube 12 at the second and third length portions 442 or 444 because of the flexibility of the tube 12, but pulling through may become much more difficult as the circumference at the first length portion 440 of the tube 12 grows. In some embodiments, the inner surfaces of the second and third length portions 442 and 444 of the tube 12 may each have a cross sectional circumference greater than 95% of a cross sectional circumference of the inner surface of the first length portion 440 of the tube 12, which may facilitate pulling the mandrel out of either end of the tube 12.

In various embodiments, the cross-sectional circumference of the inner surface of the second length portion 442 of the tube 12, the third length portion 444 of the tube 12, or both may be between 95% and 105% of the cross sectional circumference of the inner surface of the first length portion 440 of the tube 12. In various embodiments, this may facilitate high flow rates in the tube 12 at the inner surfaces of the first, second, third, and fourth wall portions 80, 82, 90, and 92 for the tube 12.

In various embodiments, the cross sectional circumference of the inner surfaces of the second and third length portions 442 and 444 of the tube 12 may be about 150 mm×Pi=~471 mm. In some embodiments, the cross sectional circumference of the inner surface of the first length portion 440 of the tube 12 may be about that of an ellipse with major axis 178 mm and minor axis 103.5 mm and so may be about 450 mm.

Referring to FIG. 9, in some embodiments, the tube 12 may include a first transition length portion 500 extending between the first and second length portions 440 and 442 and a second transition length portion 502 extending between the first and third length portions 440 and 444, the first and second transition length portions including wall thicknesses that vary generally linearly along lengths of the first and second transition length portions. In various embodiments, the wall thickness varying generally linearly along the first and second transition portions may facilitate higher flow rates within the tube 12. In various embodiments, the first and second transition length portions 500 and 502 may each have a length of at least the inner diameter of the tube 12 in the second and third length portions 442 and 444.

Figure 11:
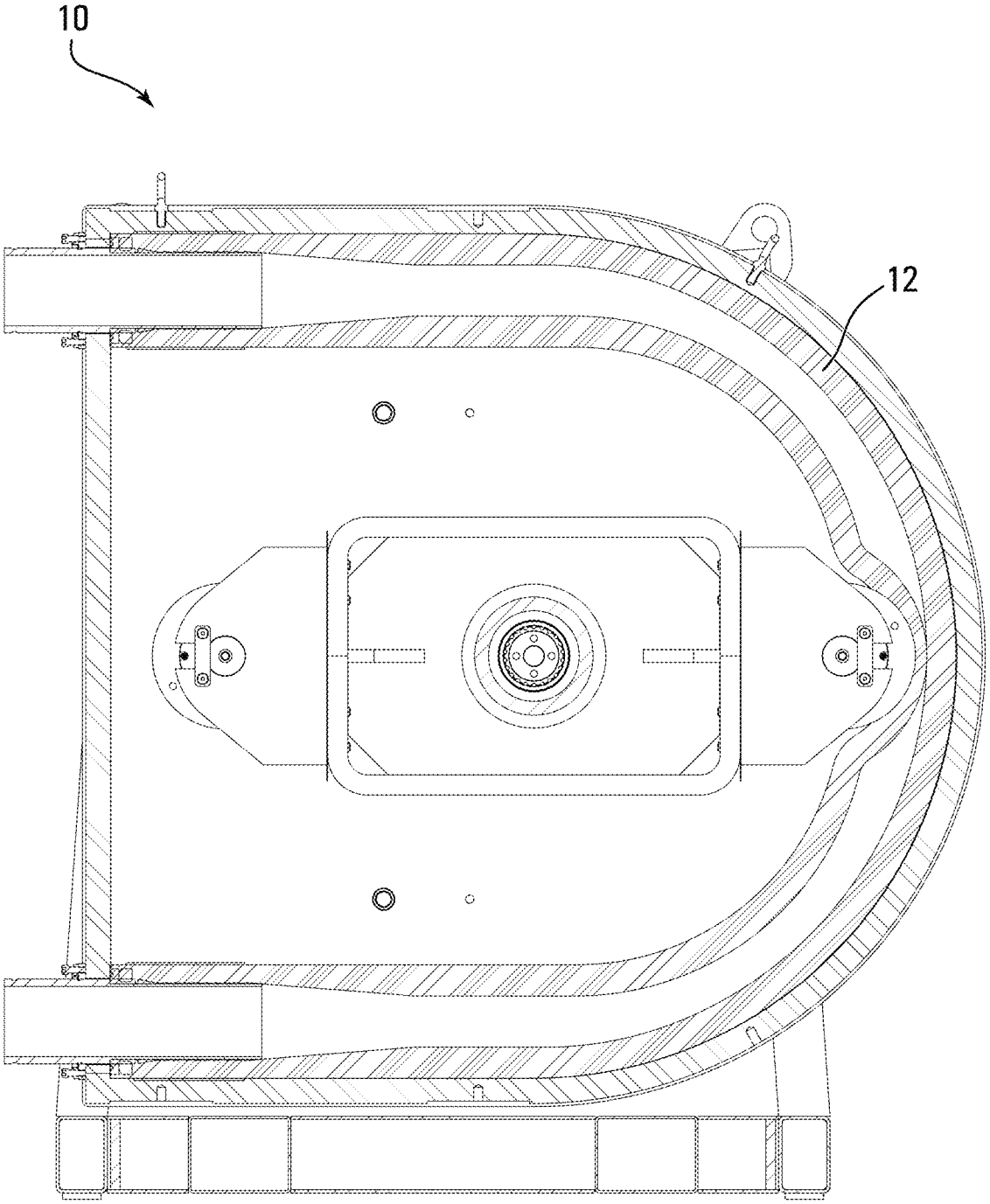
FIG. 11 is a front view of the apparatus shown in FIG. 3, with the tube shown in cross section, according to various embodiments.

Referring to FIG. 11, there is shown the apparatus 10 from the same view shown in FIG. 3, but with the tube 12 shown in cross section to illustrate the first, second, and third length portions 440, 442, 444 and the first and second transition length portions 500 and 502 shown in FIG. 9. In some embodiments, the length of the first length portion 440 may be about 2,595 mm, the lengths of the second and third length portions 442 and 444 may each be about 430 mm, and the lengths of the first and second transition length portions 500 and 502 may each be about 300 mm.

Various Embodiments

In various embodiments, the tube 12 may be provided by itself and/or in connection with additional and/or alternative tube engagers. In various embodiments, the tube engager 14 may be provided by itself and/or in connection with additional and/or alternative tubes.

While in various embodiments, the apparatus 10 includes a first roller 160 and a second roller 166 as shown in FIG. 3, in some embodiments the apparatus 10 or an apparatus, which functions generally similarly to the apparatus 10, may not include a second roller or may include additional rollers configured to function generally similarly to the first and second rollers 160 and 166.

In some embodiments, an apparatus that functions generally similarly to the apparatus 10 described herein may be configured to move a roller generally similar to the roller 160 on a linear path, rather than a curved or semi-circular one, along a linear tube having wall thicknesses generally similar to the tube 12 described herein. In some embodiments, the apparatus may include a tube engaging wall that follows the linear path of the tube.

In some embodiments, the surface portions of the tube engaging surfaces may be generally smooth. In some embodiments, the surface portions may be ridged or rough.

In some embodiments, the direction of rotation of the rotor 170 of the apparatus shown in FIG. 3 may be reversed for generally the same effect pumping flow in the opposite direction to that shown in FIG. 3.

Figure 12:
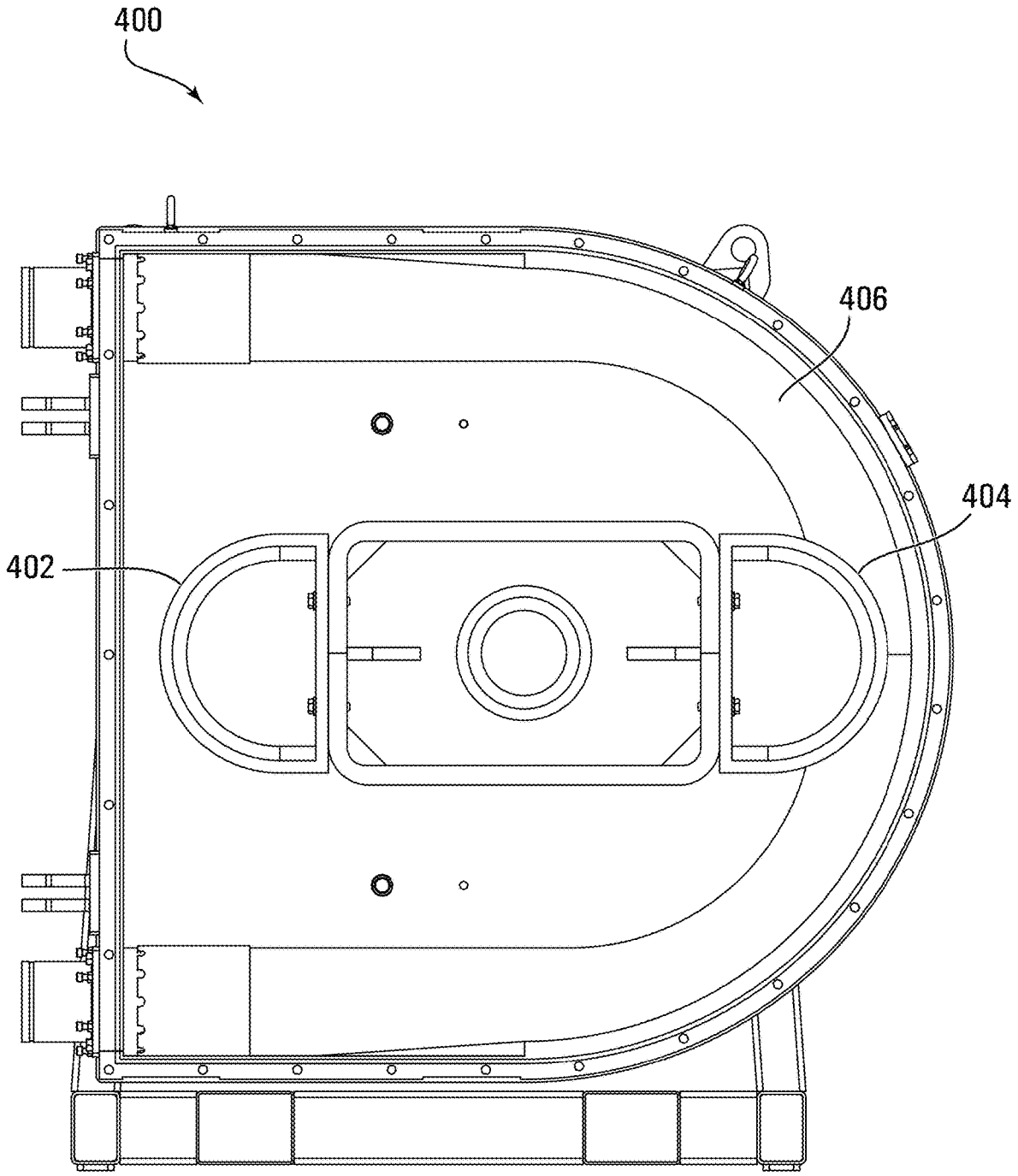
FIG. 12 is a front view of an apparatus facilitating control of fluid or slurry movement in a collapsible tube, with the cover removed, according to various embodiments.

Referring to FIG. 12, there is shown at 400 an apparatus according to various embodiments that is configured to function generally similarly to the apparatus 10, but including shoes 402 and 404 in place of the first and second rollers 160 and 166 shown in FIG. 3, the shoes 402 and 404 including tube engaging surfaces shaped generally similar to the first tube engaging surface 140 shown in FIGS. 6 and 7. In various embodiments, each of the shoes 402 and 404 may function generally similarly to the first roller 160 but the shoes may not be pivotable or configured to roll when engaged with a tube 406, the tube 406 being generally similar to the tube 12. In some embodiments, the shoes 402 and 404 may have a longer 'lead-in/out' section compared to the radius of the first and second rollers 160 and 166 shown in FIG. 3.

Figure 13:
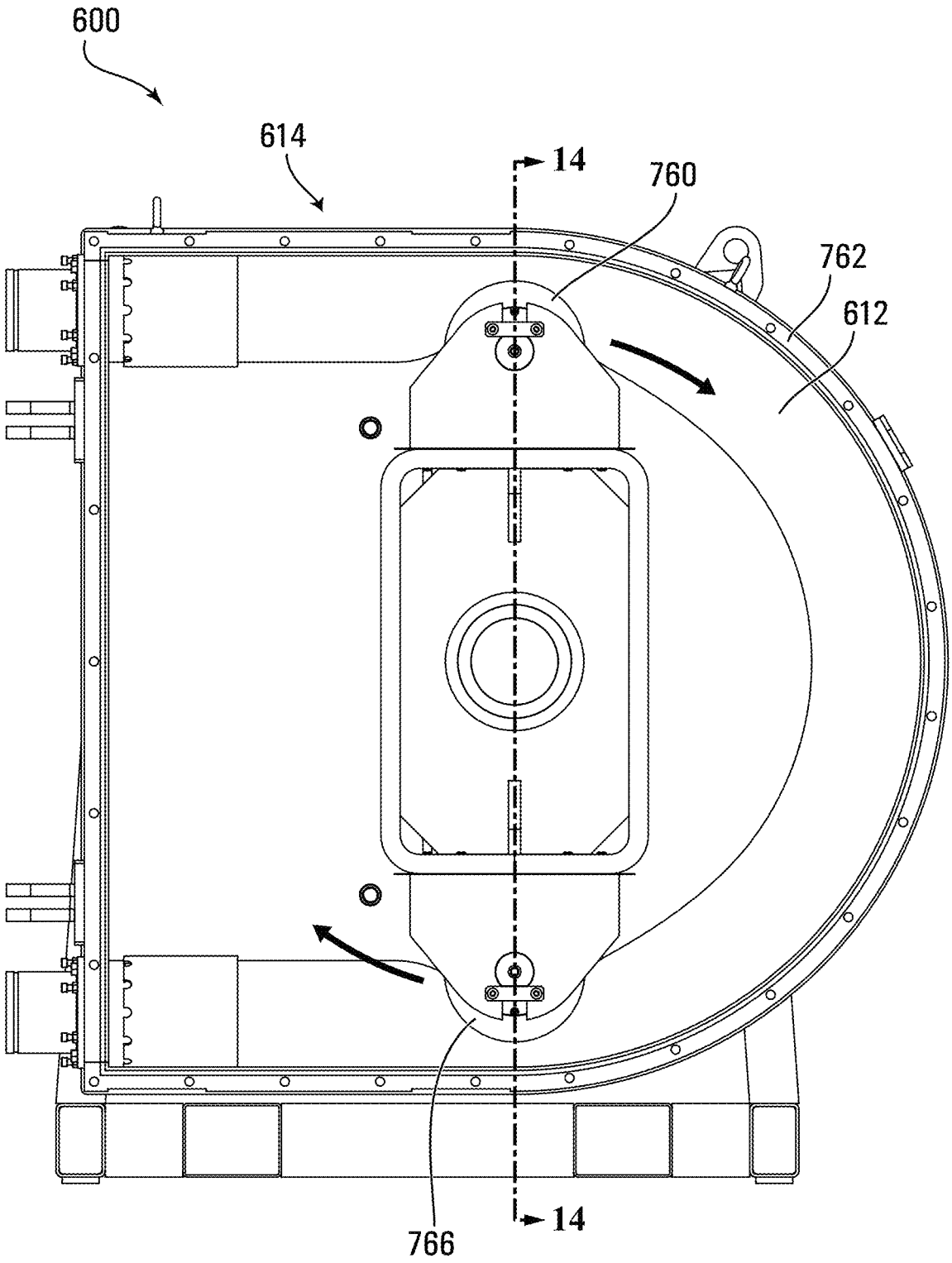
FIG. 13 is a front view of an apparatus for facilitating control of fluid or slurry movement in a collapsible tube, with the cover removed, according to various embodiments.

Referring now to FIG. 13 there is shown an apparatus 600 for facilitating fluid or slurry movement in a peristaltic pump, according to various embodiments. In various embodiments, the apparatus 600 may function generally similarly to the apparatus 10 shown in FIGS. 1-7 but with a differently configured tube engager. In various embodiments, the apparatus 600 may include a tube 612, the tube 612 being generally similar to the tube 12 of the apparatus 10 shown in FIGS. 1-7 and described herein. In various embodiments, the apparatus 600 may include a tube engager 614, which is configured to function generally similarly to the tube engager 14 of the apparatus 10 shown in FIGS. 1-7 and described herein, except that the tube engager 614 may include differently shaped tube engaging surfaces.

Figure 14:
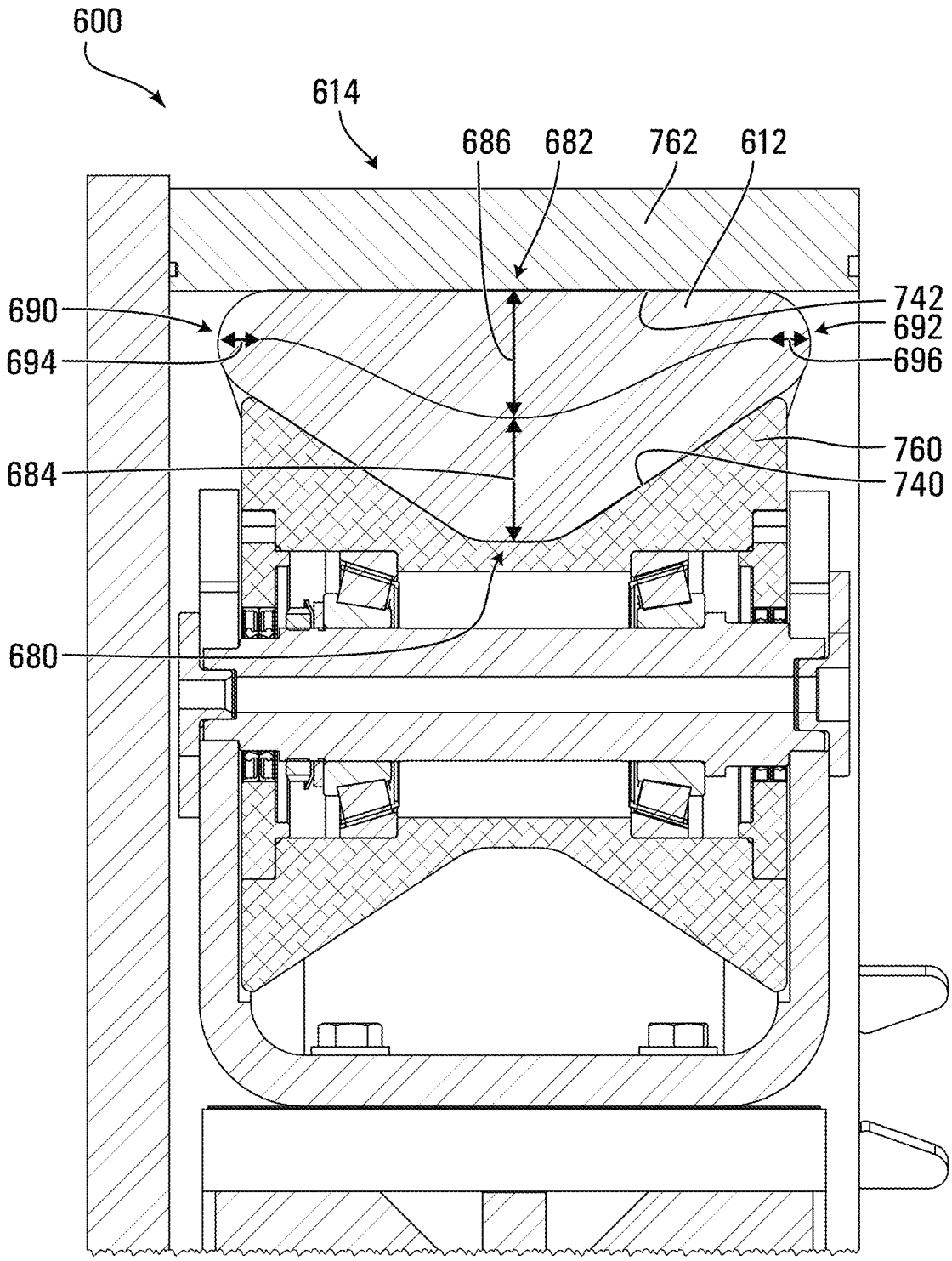
FIG. 14 is a sectional view of a portion of the apparatus shown in FIG. 13, according to various embodiments.

Referring to FIG. 13, there is shown at 14, a depiction of a cross-section upon which a partial sectional view shown in FIG. 14 of the tube 612 in a folded sealed state is taken, according to various embodiments. While the tube 612 is shown in a folded state in FIG. 14, the tube 612 may be shaped generally similarly to the tube 12 shown in FIG. 4 when it is in a relaxed state. In various embodiments, the tube 612 may include first and second opposing wall portions 680 and 682 having circumferentially varying thickness including first and second maximum thicknesses 684 and 686 respectively, the first and second maximum thicknesses disposed on opposite sides of the tube 612. In various embodiments, the tube 612 may include third and fourth opposing wall portions 690 and 692 between the first and second opposing wall portions 680 and 682, the third and fourth opposing wall portions having third and fourth circumferentially minimum thicknesses 694 and 696 respectively, the third and fourth minimum thicknesses disposed on opposite sides of the tube 612 about halfway between the first and second maximum thicknesses 684 and 686.

In various embodiments, the first and second opposing wall portions 680 and 682 may be configured to be engaged by the tube engager 614 to cause the tube 612 to fold at the third and fourth minimum thicknesses 694 and 696 to seal the tube 612.

Referring to FIG. 13, the tube engager 614 may include a first roller 760 and a tube engaging wall 762 including first and second tube engaging surfaces 740 and 742 (shown in FIGS. 14 and 15, for example) respectively. Referring to FIG. 13, in various embodiments, the tube engager 614 may include a second roller 766, which may be generally similar to the first roller 760.

Figure 15:
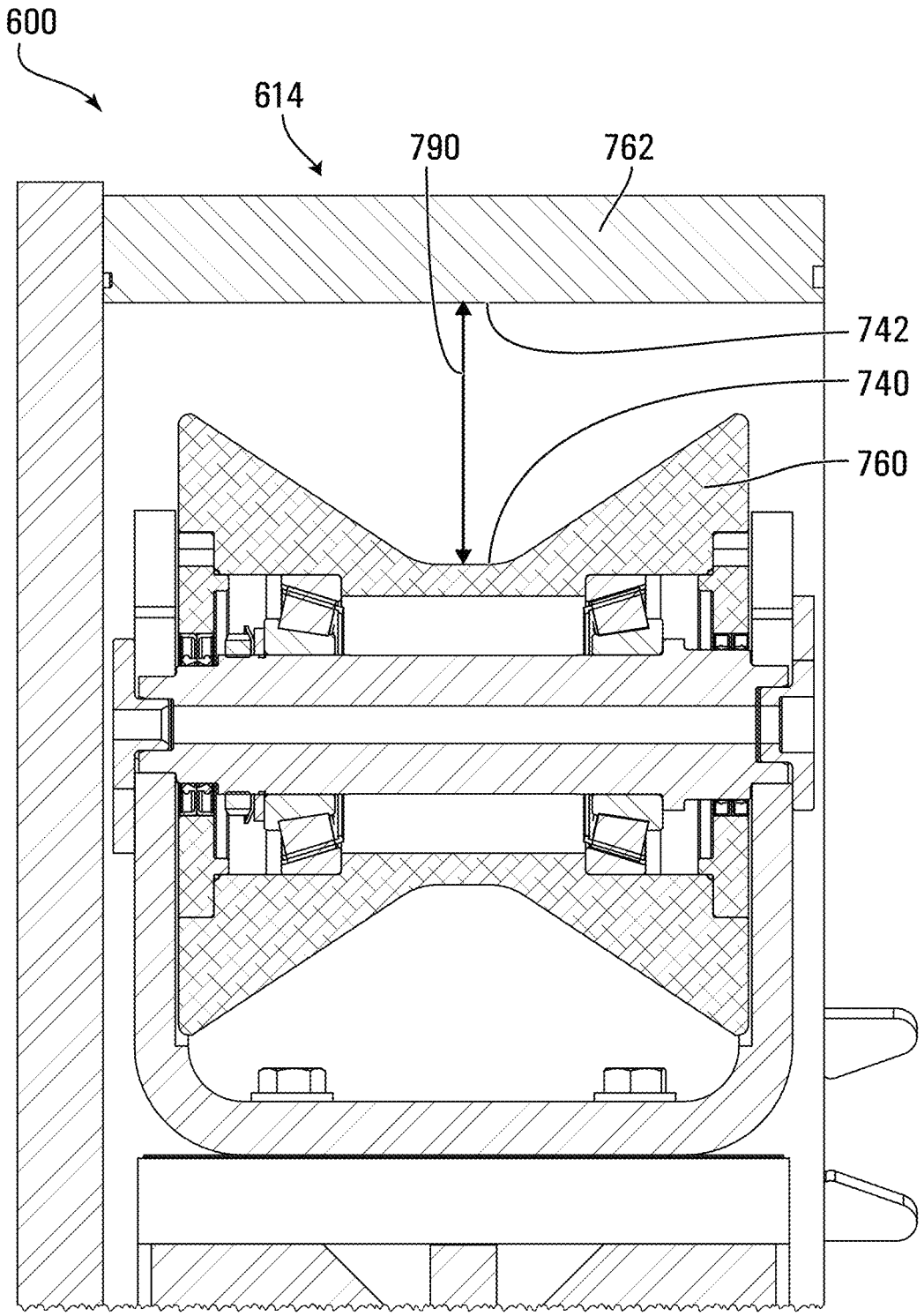
FIG. 15 is a sectional view of a portion of the apparatus shown in FIG. 13, with the tube removed, according to various embodiments.

Referring to FIG. 15, the depiction shown in FIG. 14 is provided, without the tube 612, for ease of reference. Referring to FIG. 15, in various embodiments, the tube engager 614 may include the first and second tube engaging surfaces 740 and 742 configured to engage the first and second wall portions 680 and 682 of the tube 612 respectively to cause the tube 612 to fold at the third and fourth minimum thicknesses 694 and 696 to seal the tube 612 (shown in FIG. 14), wherein the first and second tube engaging surfaces 740 and 742 are configured to define a spacing between the first and second tube engaging surfaces to compress the tube during sealing, the spacing varying along a width of the first and second tube engaging surfaces 740 and 742 and having a greatest spacing 790 at around a middle width position of the first and second tube engaging surfaces. In various embodiments, the second tube engaging surface 742 of the tube engager 614 may have a slope that is generally zero and constant along the width of the second tube engaging surface. Accordingly, in various embodiments, the change in spacing between the first and second tube engaging surfaces 740 and 742 may be provided by the shape of the first tube engaging surface 740. In various embodiments, the second tube engaging surface 742 having a generally zero and constant slope along the width, relative to its width, may facilitate ease of manufacturing. In some embodiments, a slope of a surface portion of the first tube engaging surface 740 may be zero at the middle width position. In some embodiments, the slope may increase at positions outward of the middle width position. In some embodiments, a maximum slope of the slopes of the surface portions may be between 20 and 40 degrees. In some embodiments, the maximum slope may be greater than for the first tube engaging surface 140 shown in FIG. 7 to account for the zero slope of the second tube engaging surface 742. In some embodiments, the maximum slope may be about 35 degrees.

In various embodiments, non-rolling shoes may be used in the apparatus 600 in place of rollers.

In various embodiments, other apparatuses including elements generally similar to those described herein in connection with the apparatuses 10, 400, and 600 may include various tube engaging surfaces or combinations of tube engaging surfaces that provide spacing therebetween as described herein to facilitate at least some or all of the advantages described herein.

In accordance with various embodiments, tube 12 or a tube generally similar to the tube 12 described above may have various dimensions, including the thicknesses 84, 86, 94, and 96 and ratios thereof, which may be chosen such that the tube does not collapse under vacuum while at the same time having thin minimum thicknesses. In some embodiments, particular ratios of maximum thickness over minimum thickness may work well with particular cross sectional inner surface circumferences of the tube 12 at the first, second, third, and fourth wall portions 80, 82, 90, and 92.

In some embodiments, vacuum collapse may be resisted with a tube having a 314 mm cross sectional inner surface circumference and 145.5 mm outer diameter (OD) where the first and second maximum thicknesses are 35.75 mm and the third and fourth minimum thicknesses are 17 mm. Accordingly, in some embodiments, the ratio may be 35.75/17 or about 2.10, for example.

In some embodiments, the first and second maximum thicknesses 84 and 86 may be generally equal and the third and fourth minimum thicknesses 94 and 96 may be generally equal and a ratio of the first and second maximum thicknesses 84 and 86 over the third and fourth minimum thicknesses may be at least 1.5. In various embodiments, this may facilitate high flow rates, resilient re-opening of the tube 12, sealing of the tube 12 while requiring reduced folding angles and/or compression travel for sealing, use with high pressures, reduced wear and tear, and/or avoidance or reduction of longitudinal folding or buckling of the tube 12 at locations where the tube 12 is not compressed. In some embodiments, a cross sectional circumference of an inner surface of the tube at the first, second, third, and fourth wall portions may be at least 314 mm. In various embodiments, the cross sectional circumference being at least 314 mm may be well suited to the ratio being at least 1.5 to facilitate any or all of the above noted advantages.

In some embodiments, vacuum collapse may be resisted with a tube having a 471 mm cross sectional inner surface circumference and 229 mm OD where the first and second maximum thicknesses are about 63.4 mm and the third and fourth minimum thicknesses are 24.8 mm. Accordingly, in some embodiments, the ratio may be about 2.56, for example.

In some embodiments, the first and second maximum thicknesses 84 and 86 may be generally equal and the third and fourth minimum thicknesses 94 and 96 may be generally equal and a ratio of the first and second maximum thicknesses 84 and 86 over the third and fourth minimum thicknesses may be at least 2.0. In various embodiments, this may facilitate high flow rates, resilient re-opening of the tube 12, sealing of the tube 12 while requiring reduced folding angles and/or compression travel for sealing, use with high pressures, reduced wear and tear, and/or avoidance or reduction of longitudinal folding or buckling of the tube 12 at locations where the tube 12 is not compressed. In some embodiments, a cross sectional circumference of an inner surface of the tube at the first, second, third, and fourth wall portions may be at least 471 mm. In various embodiments, the cross sectional circumference being at least 471 mm may be well suited to the ratio being at least 2.0 to facilitate any or all of the above noted advantages.

In some embodiments, the first and second maximum thicknesses 84 and 86 may be generally equal and the third and fourth minimum thicknesses 94 and 96 may be generally equal and a ratio of the first and second maximum thicknesses 84 and 86 over the third and fourth minimum thicknesses may be at least 3.5. In various embodiments, this may facilitate high flow rates, resilient re-opening of the tube 12, sealing of the tube 12 while requiring reduced folding angles and/or compression travel for sealing, use with high pressures, reduced wear and tear, and/or avoidance or reduction of longitudinal folding or buckling of the tube 12 at locations where the tube 12 is not compressed. In some embodiments, a cross sectional circumference of an inner surface of the tube at the first, second, third, and fourth wall portions may be at least 942 mm. In various embodiments, the cross sectional circumference being at least 942 mm may be well suited to the ratio being at least 3.5 to facilitate any or all of the above noted advantages.

In various embodiments, dimensions such as widths, thicknesses, slopes, and other dimensions described herein may be tested and/or determined using computer modeling such as computer modeling including finite element analysis.

Figure 16:
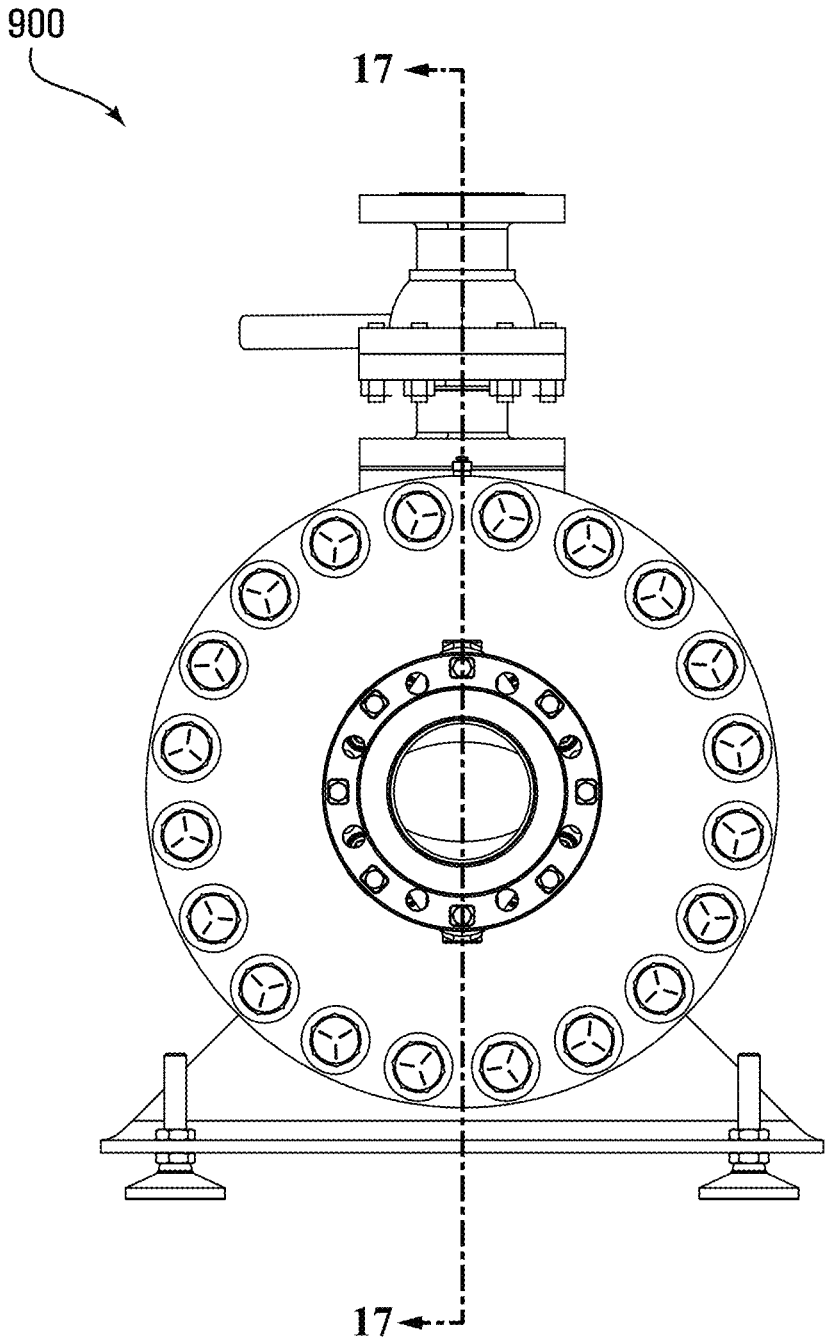
FIG. 16 is an end view of an apparatus for facilitating control of fluid or slurry movement in a collapsible tube, according to various embodiments.
Figure 17:
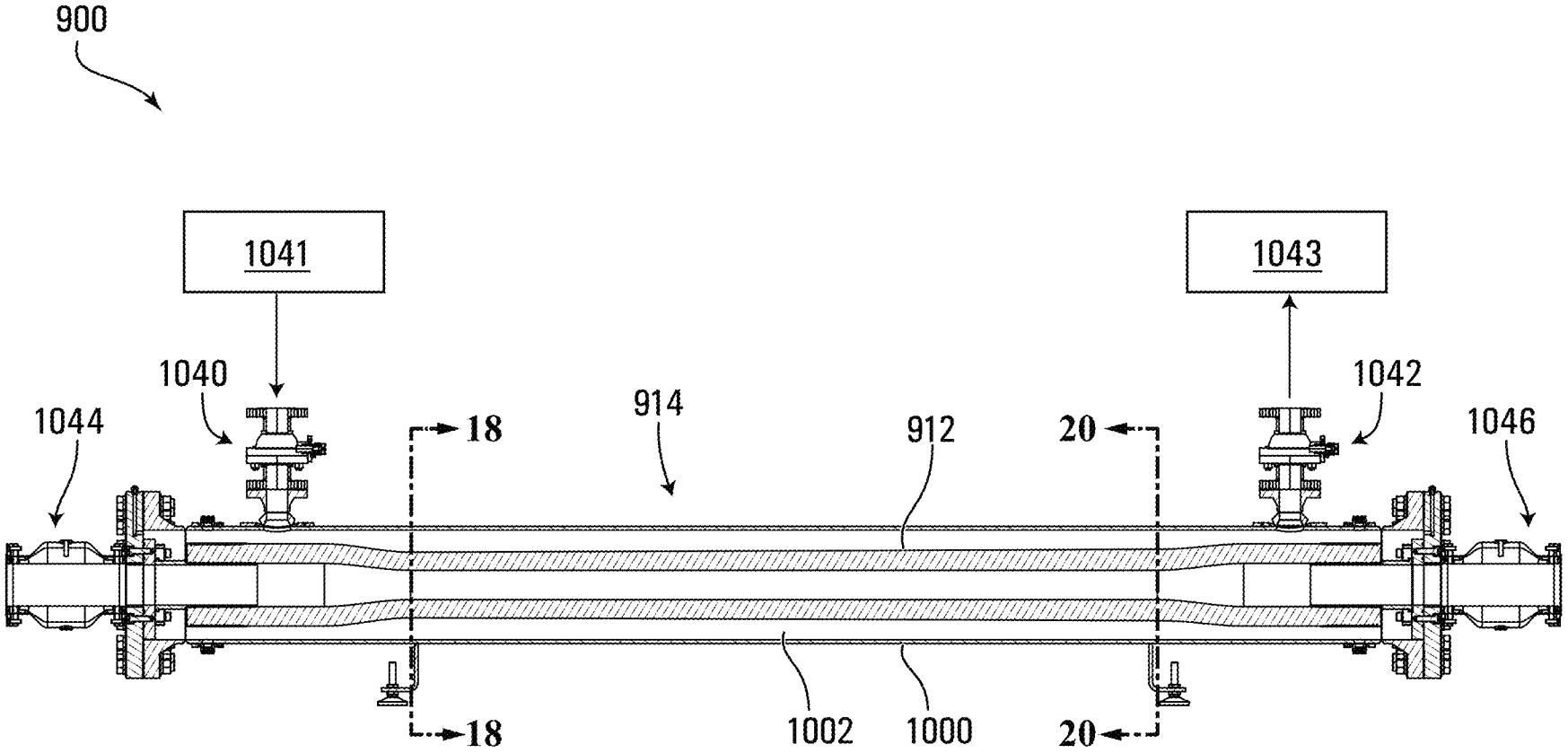
FIG. 17 is a sectional view of the apparatus shown in FIG. 16, according to various embodiments.

Referring now to FIG. 16, there is shown an end view of an apparatus 900 for facilitating control of fluid or slurry movement in a collapsible tube, according to various embodiments. Referring to FIG. 16, there is shown at 17 a depiction of a cross-section upon which a sectional view shown in FIG. 17 is taken of the apparatus 900, in accordance with various embodiments. Referring to FIG. 17, the apparatus 900 may include a tube 912 having some features that are generally similar to the tube 12 shown in FIGS. 3-6 and 9-11 but configured to function with a hydraulic tube engager. In various embodiments, the apparatus 900 may be configured to facilitate fluid or slurry movement in a peristaltic pump. In some embodiments, the apparatus 900 may be configured to act as a peristaltic pump.

Referring to FIG. 17, in various embodiments, the apparatus 900 may include a tube engager 914 including a vessel 1000 configured to surround the tube 912 and hold a hydraulic fluid 1002 in engagement with the tube 912. For example, in some embodiments, the hydraulic fluid may include water or hydraulic oil, or another hydraulic fluid configured to deliver force for pumping via pressure changes.

Figure 18:
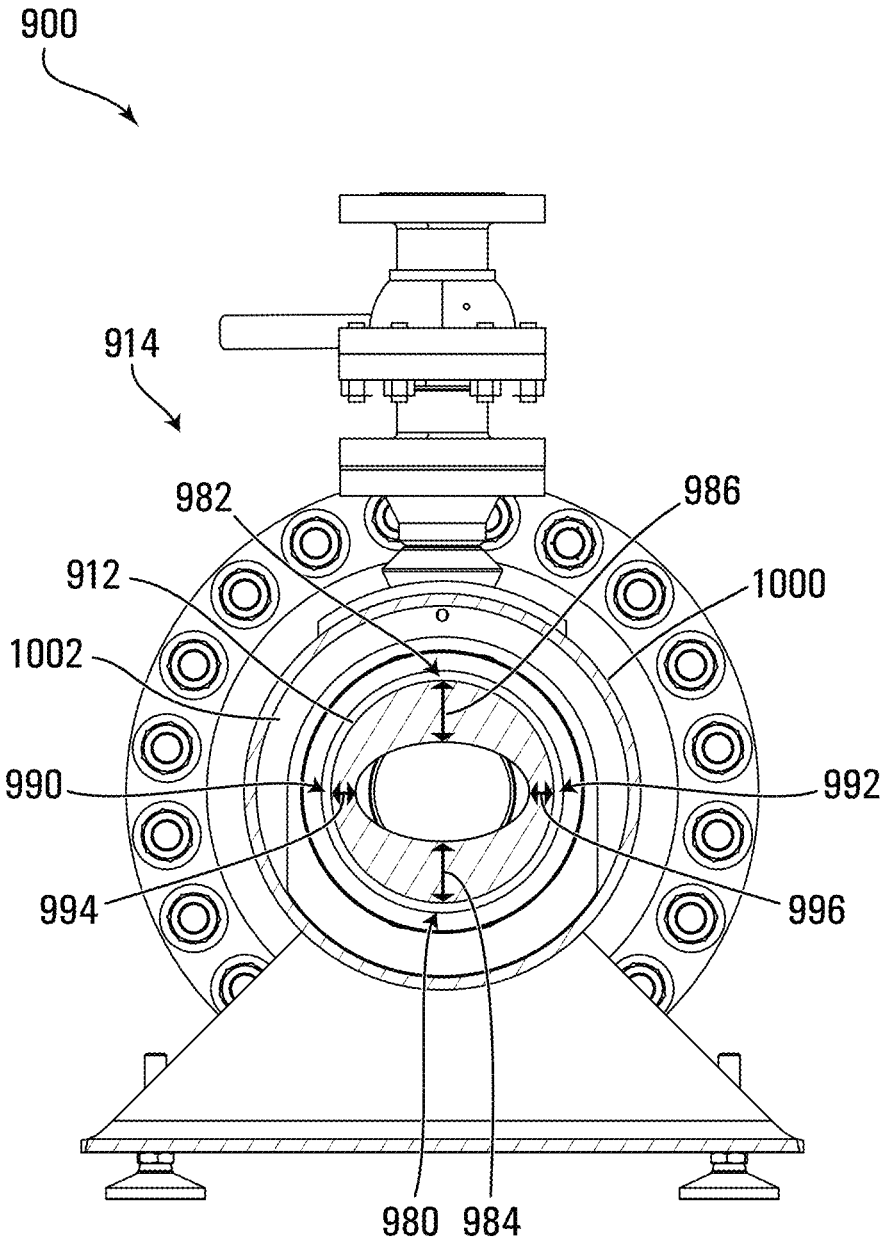
FIG. 18 is a sectional view of the apparatus shown in FIG. 17, according to various embodiments.

Referring to FIG. 17, there is shown at 18 a depiction of a cross-section upon which a sectional view shown in FIG. 18 is taken of the tube 912 in a relaxed or open state, in accordance with various embodiments. Referring to FIG. 18, the tube 912 includes first and second opposing wall portions 980 and 982 having circumferentially varying thickness including first and second maximum thicknesses 984 and 986 respectively, the first and second maximum thicknesses disposed on opposite sides of the tube 912. In various embodiments, the tube 912 includes third and fourth opposing wall portions 990 and 992 between the first and second opposing wall portions 980 and 982, the third and fourth opposing wall portions 990 and 992 having third and fourth circumferentially minimum thicknesses 994 and 996 respectively, the third and fourth minimum thicknesses disposed on opposite sides of the tube 912 about halfway between the first and second maximum thicknesses 984 and 986. In various embodiments, the first and second opposing wall portions 980 and 982 may be configured to be engaged by the tube engager 914 to cause the tube 912 to fold at the third and fourth minimum thicknesses 994 and 996 to seal the tube.

In various embodiments, the tube engager 914 may be configured to selectively increase pressure of the hydraulic fluid 1002 to cause the tube 912 to fold at the third and fourth minimum thicknesses 994 and 996 to seal the tube 912.

Referring to FIG. 17, the tube engager 914 may include an isolation valve 1040, in fluid communication between the vessel 1000 and a pressure source, shown schematically at 1041. In various embodiments, the isolation valve 1040 may be configured to selectively increase the pressure of the hydraulic fluid 1002 in the vessel 1000 when the isolation valve is opened. In some embodiments, the pressure source 1041 may include a pump. For example, the pressure source may include a pump that is controlled by a variable frequency drive, which may facilitate generating a desired maximum squeezing pressure. In some embodiments, the tube engager 914 may be configured to open the fluid isolation valve to increase the pressure of the hydraulic fluid 1002 in the vessel 1000.

In some embodiments, the apparatus 900 may include an inlet valve 1044 configured to selectively open to provide fluid or slurry to the tube 912 and an outlet valve 1046 configured to selectively open to facilitate flow of fluid or slurry out of the tube 912. Referring to FIG. 17, the tube engager 914 may include an exhaust valve 1042 in fluid communication between the vessel 1000 and an exhaust, shown schematically at 1043, the exhaust valve 1042 configured to selectively decrease the pressure of the hydraulic fluid in the vessel when the exhaust valve is opened.

In some embodiments, the inlet valve 1044 and the outlet valve 1046 may each include a pinch valve. In various embodiments, either or both of the inlet valve 1044 and the outlet valve 1046 may be implemented using a knife gate valve, a pinch valve, a ball-type slurry check valve, or another valve. In some embodiments, the isolation valve 1040 and the exhaust valve 1042 may each include a ball valve. In various embodiments, either or both of the isolation valve 1040 and the exhaust valve 1042 may be implemented using a knife gate valve, a pinch valve, a ball-type valve, a butterfly valve, a gate valve, or another valve.

In some embodiments, in operation, the tube 912 may be filled with fluid or slurry and the tube engager 914 may be in a first configuration wherein the isolation valve 1040 is closed such that the vessel 1000 is isolated from the pressure source 1041 and the exhaust valve 1042 is open. In various embodiments, in the first configuration, the pressure of the hydraulic fluid 1002 may be at an initial pressure level. For example, in some embodiments, the initial pressure level may be less than about 0.1 bar.

In various embodiments, when the tube engager 914 is in the first configuration, the outlet valve 1046 may be closed and the inlet valve 1044 may be opened to allow fluid or slurry to enter the tube 912 from the inlet valve 1044.

In some embodiments, when the hose is full, the inlet valve 1044 may be caused to close and the outlet valve 1046 may be caused to open. Next, the tube 912 may be peristaltically sealed to cause fluid or slurry to be pumped along the tube 912 and out of the outlet valve 1046.

Figure 19:
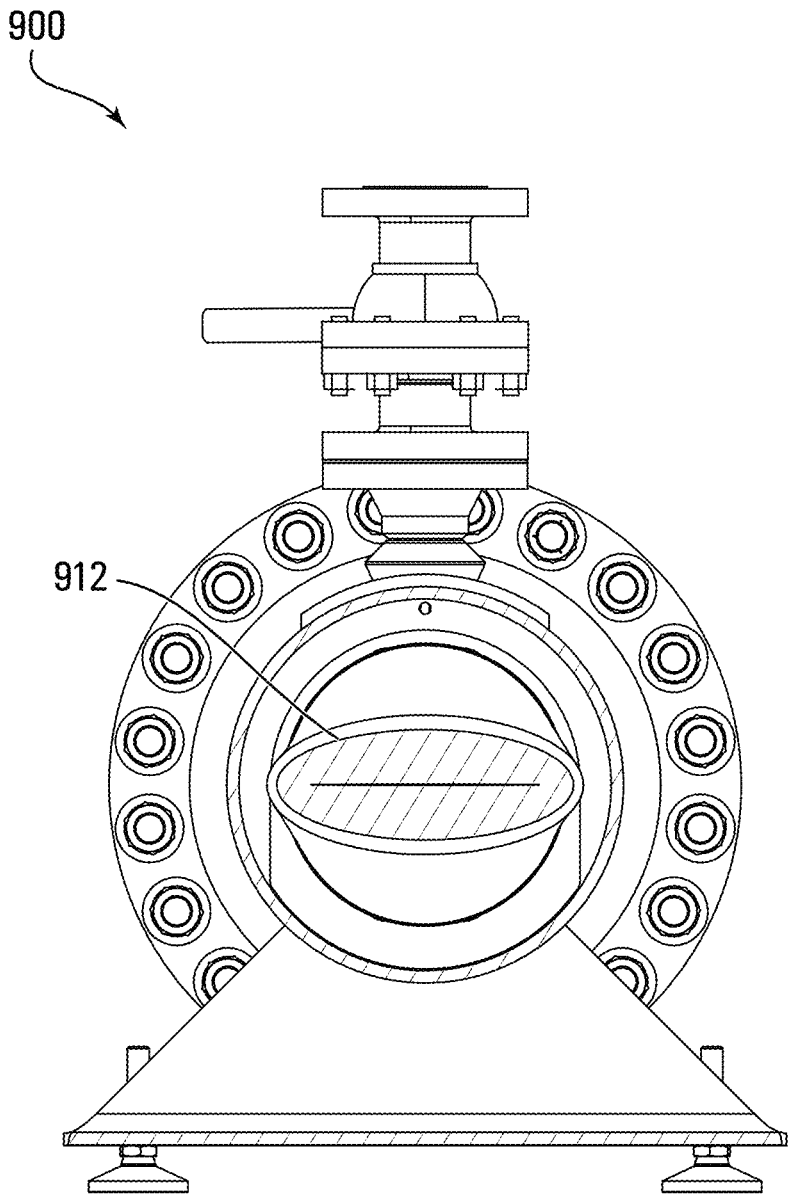
FIG. 19 is a sectional view of the apparatus shown in FIG. 17, according to various embodiments.

Referring to FIG. 17, in various embodiments, with the inlet valve 1044 closed and the outlet valve 1046 open, the tube engager 914 may be put into a second configuration wherein the pressure of the hydraulic fluid 1002 is increased from the initial pressure level to a first pressure level to cause the tube 912 to fold at the third and fourth minimum thicknesses 994 and 996 to seal the tube 912. In various embodiments, in the second configuration, the isolation valve 1040 is opened and the exhaust valve 1042 is closed, such that the pressure of the hydraulic fluid 1002 is increased from the initial pressure level to a first pressure level to cause the tube 912 to fold at the third and fourth minimum thicknesses 994 and 996 to seal the tube 912 as shown at FIG. 19, which shows the same cross-section shown in FIG. 18, but with the tube engager in the second configuration and the pressure of the hydraulic fluid 1002 at the first pressure level. In various embodiments, the first pressure level may be more than 0.1 bar but less than 50 bar, for example.

Figure 20:
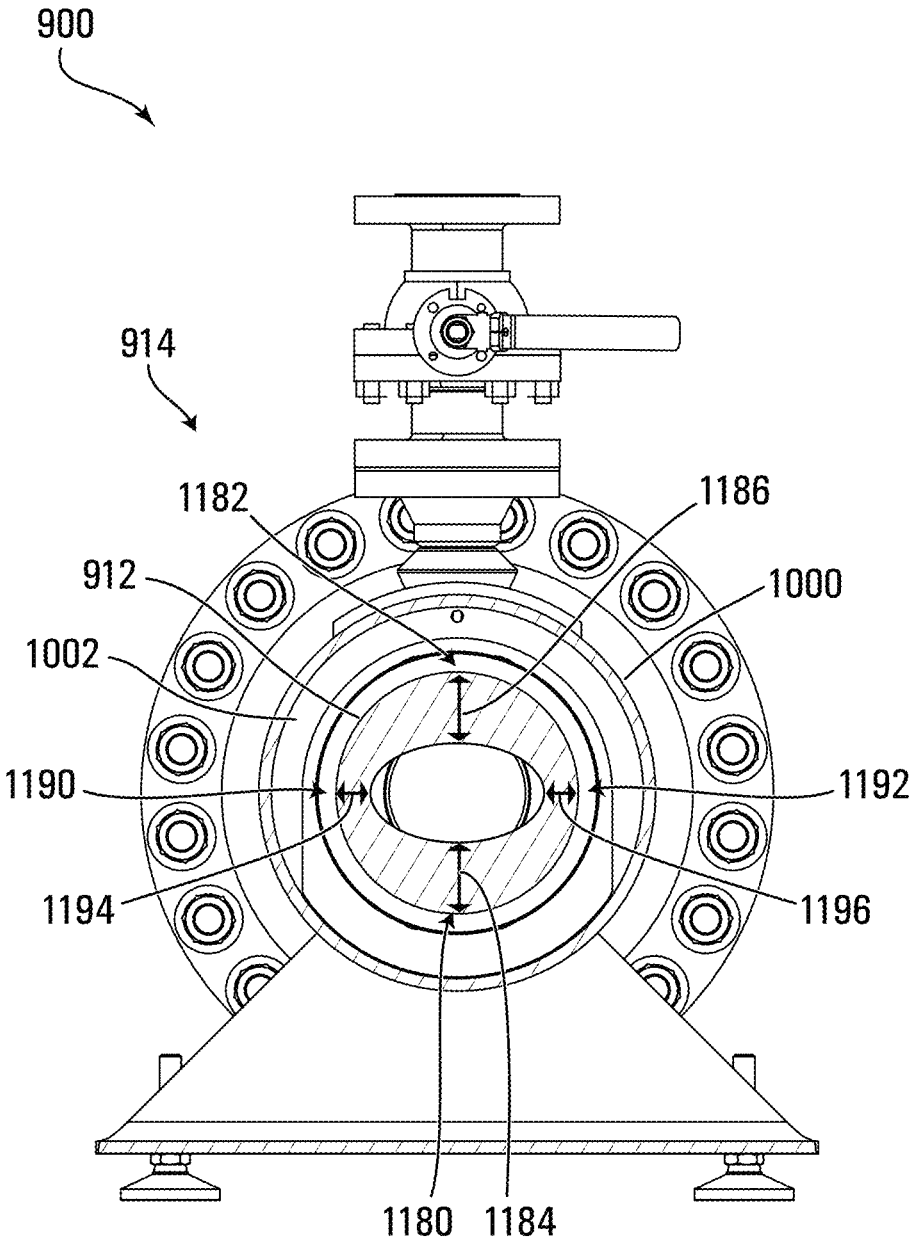
FIG. 20 is a sectional view of the apparatus shown in FIG. 17, according to various embodiments.

Referring to FIG. 17, there is shown at 20 a depiction of a cross-section, longitudinally spaced from the cross-section shown at 18 in FIG. 17, upon which a sectional view shown in FIG. 20 is taken of the tube 912. Referring to FIG. 20, the tube 912 includes fifth and sixth opposing wall portions 1180 and 1182 and seventh and eighth opposing wall portions 1190 and 1192 longitudinally spaced from the first, second, third, and fourth wall portions 980, 982, 990 and 992 (shown in FIG. 18). In some embodiments, the fifth, sixth, seventh, and eighth wall portions 1180, 1182, 1190, and 1192 taken at the cross-section 20 may be spaced about 102 and 3/16 inches from the first, second, third, and fourth wall portions 980, 982, 990 and 992 taken at the cross-section 18 (shown in FIG. 18).

In various embodiments, the fifth and sixth opposing wall portions 1180 and 1182 have circumferentially varying thickness including fifth and sixth maximum thicknesses respectively 1184 and 1186, the fifth and sixth maximum thicknesses disposed on opposite sides of the tube 912. In various embodiments, the seventh and eighth opposing wall portions 1190 and 1192 are disposed between the fifth and sixth opposing wall portions 1180 and 1182, the seventh and eighth opposing wall portions having seventh and eighth circumferentially minimum thicknesses respectively 1194 and 1196, the seventh and eighth minimum thicknesses disposed on opposite sides of the tube 912 about halfway between the fifth and sixth maximum thicknesses 1184 and 1186.

In various embodiments, the fifth and sixth opposing wall portions 1180 and 1182 may be configured to be engaged by the hydraulic fluid 1002 to cause the tube to fold at the seventh and eighth minimum thicknesses 1194 and 1196 to seal the tube 912. In various embodiments, the seventh and eighth minimum thicknesses 1194 and 1196 may be greater than the third and fourth minimum thicknesses 994 and 996 (shown in FIG. 18) such that the tube 912 is configured to fold at the seventh and eighth minimum thicknesses 1194 and 1196 when the pressure of the hydraulic fluid 1002 is at a second pressure level greater than the first pressure level at which the tube 912 is configured to fold at the third and fourth minimum thicknesses. For example, in some embodiments, the third and fourth minimum thicknesses 994 and 996 may each be about 0.984 inches and the seventh and eighth minimum thicknesses 1194 and 1196 may each be about 1.378 inches. In some embodiments, the second pressure level may be about 50 bar. In various embodiments, the second pressure level may result in a pressure differential between the outside and inside of the tube 912 of about 3 bar.

Figure 21:
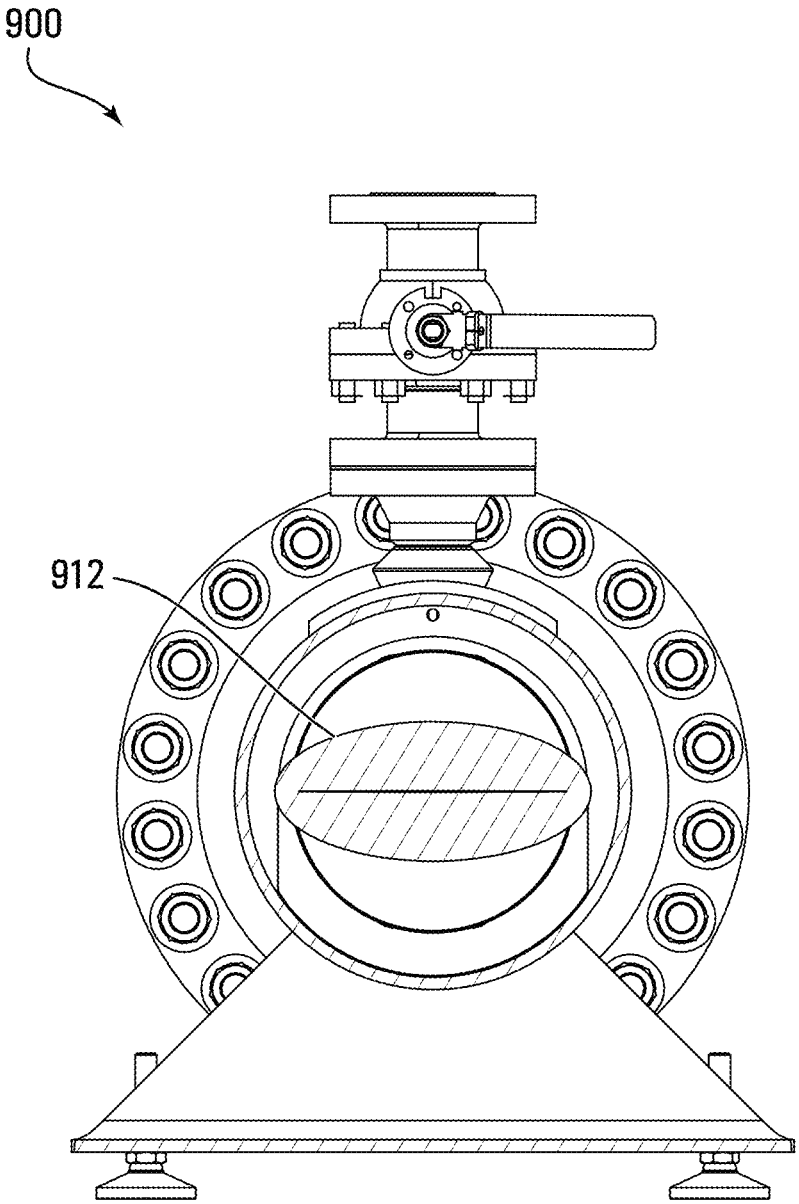
FIG. 21 is a sectional view of the apparatus shown in FIG. 17, according to various embodiments.

Referring to FIG. 21 there is shown the same cross-section depicted in FIG. 20, but with the pressure of the hydraulic fluid 1002 at the second pressure level greater than the first pressure level such that the tube 912 is folded at the seventh and eighth minimum thicknesses 1194 and 1196 and the tube 912 is sealed. In various embodiments, when the tube engager 914 is in the second configuration, the pressure of the hydraulic fluid 1002 may rise from the first pressure level to the second pressure level, such that the tube 912 peristaltically seals and the seal moves along the tube 912 from the third and fourth minimum thicknesses 984 and 986 to the seventh and eighth minimum thicknesses 1194 and 1196, thus forcing or pumping the fluid or slurry along the tube 912 towards or out of the outlet valve 1046.

In some embodiments, the thickness of the tube 912 may vary generally linearly longitudinally along the tube 912 from the third and fourth minimum thicknesses 984 and 986 to the seventh and eighth minimum thicknesses 1194 and 1196. In some embodiments, the tube 912 may have a length of about 102 and 3/16 inches between the cross-sections 18 and 20 shown in FIG. 17 and a thickness change from about 0.984 inches to about 1.378 inches at the minimum thicknesses, for example. In various embodiments, this may facilitate peristaltic sealing and/or efficient pumping of fluid or slurry along the tube 912.

In some embodiments, the fifth and sixth maximum thicknesses 1184 and 1186 may be greater than the first and second maximum thicknesses 984 and 986. In various embodiments, this may facilitate folding at the third and fourth minimum thicknesses 984 and 986 at a lower pressure level than required to fold at the seventh and eighth minimum thicknesses 1194 and 1196, which may facilitate peristaltic pumping of fluid or slurry along the tube 912. In various embodiments, this may facilitate ease of manufacturing. In some embodiments, the first and second maximum thicknesses 984 and 986 may be about 2.480 inches and the fifth and sixth maximum thicknesses may be about 2.874 inches, for example. In some embodiments, the outer diameter of the tube 912 when open may increase from about 9 inches at the cross section 18 to about 9 and ¾ inches at the cross section 20 shown in FIG. 17.

In some embodiments, the inner cross-sectional shape of the tube 912 may remain constant between the cross-section shown in FIG. 18 and the cross-section shown in FIG. 20, but a width or thickness of a surrounding ring or cylinder outside of the inner cross-sectional shape may increase along the tube 912 from the cross-section shown in FIG. 18 to the cross-section shown in FIG. 20.

Accordingly, in various embodiments, the tube engager 914 may be configured to raise the pressure of the hydraulic fluid 1002 from the initial pressure level lower than the first pressure level upwards and through the first pressure level to cause the tube 912 to fold at the third and fourth minimum thicknesses 984 and 986 shown in FIG. 18 to seal the tube and to continue raising the pressure of the hydraulic fluid 1002 from the first pressure level to the second pressure level to cause the tube 912 to fold at the seventh and eighth minimum thicknesses 1194 and 1196 shown in FIG. 20 to seal the tube, such that fluid or slurry in the tube 912 is peristaltically forced longitudinally from the third and fourth minimum thicknesses 984 and 986 to the seventh and eighth minimum thicknesses 1194 and 1196 along the tube 912.

In various embodiments, upon complete or maximum collapse of the tube 912, the outlet valve 1046 may be caused to close and then the inlet valve 1044 may be caused to open. The tube engager 914 may then be returned to the first configuration wherein the isolation valve 1040 is closed such that the vessel is isolated from the pressure source 1041 and the exhaust valve 1042 is open. In various embodiments, in the first configuration, the pressure of the hydraulic fluid 1002 may return to the initial pressure level. In various embodiments, this may cause negative pressure (partial vacuum) inside the tube 912 and fluid or slurry may be drawn into the tube 912 from the inlet valve 1044. Alternatively, fluid or slurry may be forced into the tube 912 by some external means.

Next, the apparatus 900 may be back to an initial condition and the cycle of peristaltic pumping may repeat.

In various embodiments, use of the tube 912 in the apparatus 900 wherein the tube is engaged and folded by the hydraulic fluid 1002 may facilitate any or all of the following:

- Collapse (or fold) of the tube 912 may be predictable and may occur at points where the wall is thinnest whereas with a circular constant thickness hose, collapse may occur at any axis at any point along the hose. Having a consistent and straight mode of collapse may offer less resistance to flow of the material being pumped. Random axes of collapse may cause higher resistance to flow and thus greater wear, shorter hose life, and greater energy input.
- Flattening a hose inside a pressurized vessel may cause the hose to shorten if the ends are unrestrained or become stressed in tension if restrained as is necessary in a pressurized vessel. Having thicker top and bottom walls as opposed to uniformly thick walls may reduce stress caused by flattening when compared to circular hoses. Reduced stress may produce less heat and thus may improve hose life.
- In hydraulic fluid actuated pumps, when the highest pressure is applied to the tube, it may become flat for most of its length except close to rigid shanks or connectors at the ends. There may be a transition at both ends from flat and sealed to round and open at the shanks. The region close to the beginning on the flat side of this transition may be subject to high bending stresses in the top and bottom wall of the tube. The varying cross section of the tube 912 may provide stiffer top and bottom walls where the bending will occur while keeping the fold point at the thinnest wall section. This configuration may be superior to a conventional tube with constant wall thickness by providing additional resistance to bending where it is required without losing foldability.

In various embodiments, use of the tube 912 in the apparatus 900 wherein the tube is engaged and folded by the hydraulic fluid 1002 may facilitate sealing of the tube 912, while requiring reduced folding angles, reduced wear and tear on the tube, and/or being able to employ a large diameter high pressure peristaltic pump wherein advantages of hydraulic actuation are attained, including, for example, in some embodiments, any or all of the following:

- In some embodiments, the fluid may circulate in and out of the vessel during cyclic operation. The fluid can be chilled outside the vessel if necessary so that it cools the tube upon returning to the vessel.
- In some embodiments, the stress may be applied across the entire outside surface of the tube and may be uniform irrespective of the smoothness of the outer tube surface. Tubes with rough outer surfaces can be manufactured more inexpensively than tubes with smooth surfaces. Sealing against a desired internal pressure may be achieved at lower force with 'hydraulic' sealing on account of this pressure uniformity. Sealing with mechanical means may require a higher force because the whole sealing surface must be squeezed to seal at the weakest point of contact. Other stronger contact points may be 'over-squeezed' unnecessarily.

In some embodiments, hydraulic squeezing may be applied around the entire circumference of the tube as opposed to just a portion of the top and bottom of the tube. Squeezing at the 'edges' of the tube may be beneficial because it may reduce stress at the edges when the hose is sealed. Lower stress may equate to lower heat generation which may equate to longer hose life.

In some embodiments, the vessel 1000 may be tilted at a slope of about 1:100. In various embodiments, this may reduce risk of bubbles in the vessel 1000.

Figure 22:
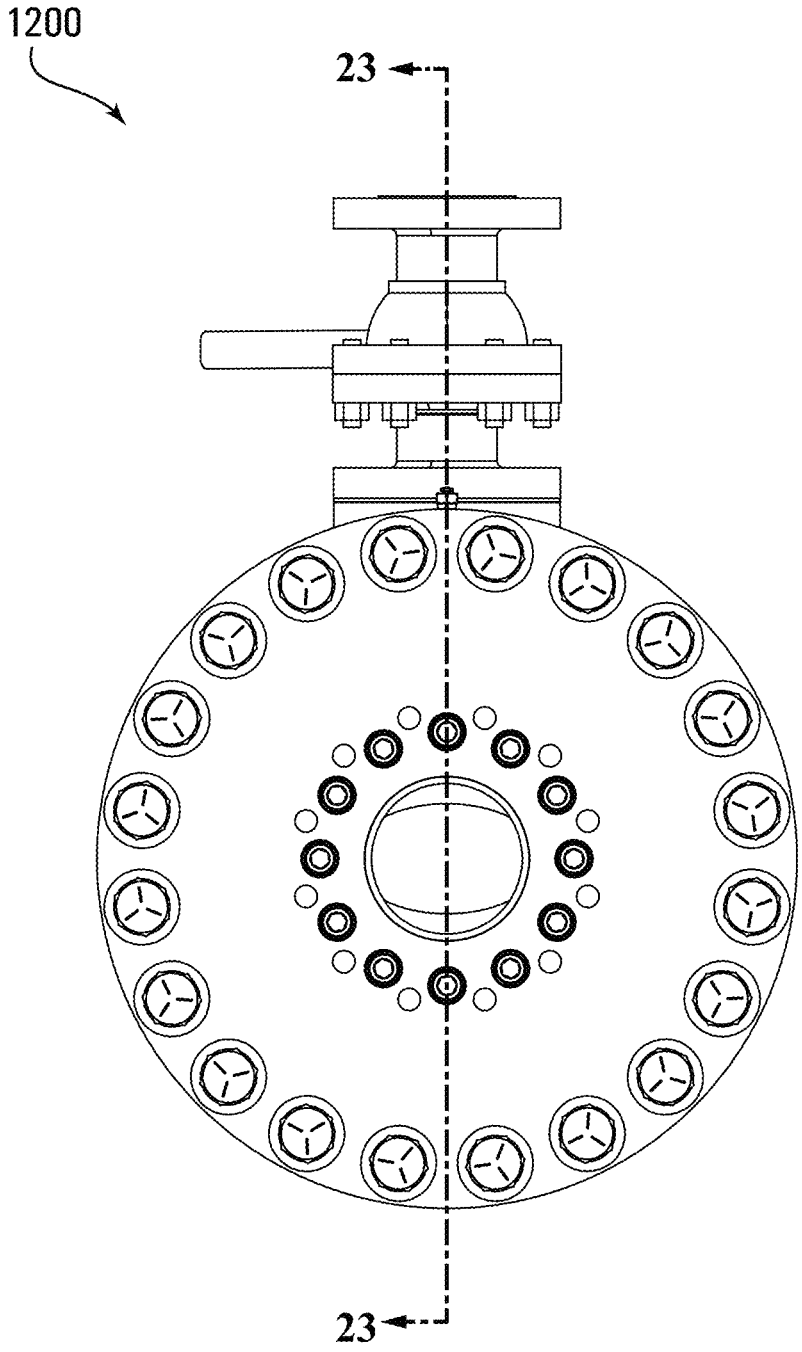
FIG. 22 is an end view of an apparatus for facilitating control of fluid or slurry movement in a collapsible tube, according to various embodiments.

Referring now to FIG. 22, there is shown an end view of an apparatus 1200 for facilitating control of fluid or slurry movement in a collapsible tube, according to various embodiments. In various embodiments, the apparatus 1200 may be configured to act as a valve for facilitating control of fluid or slurry movement in a collapsible tube.

Figure 23:
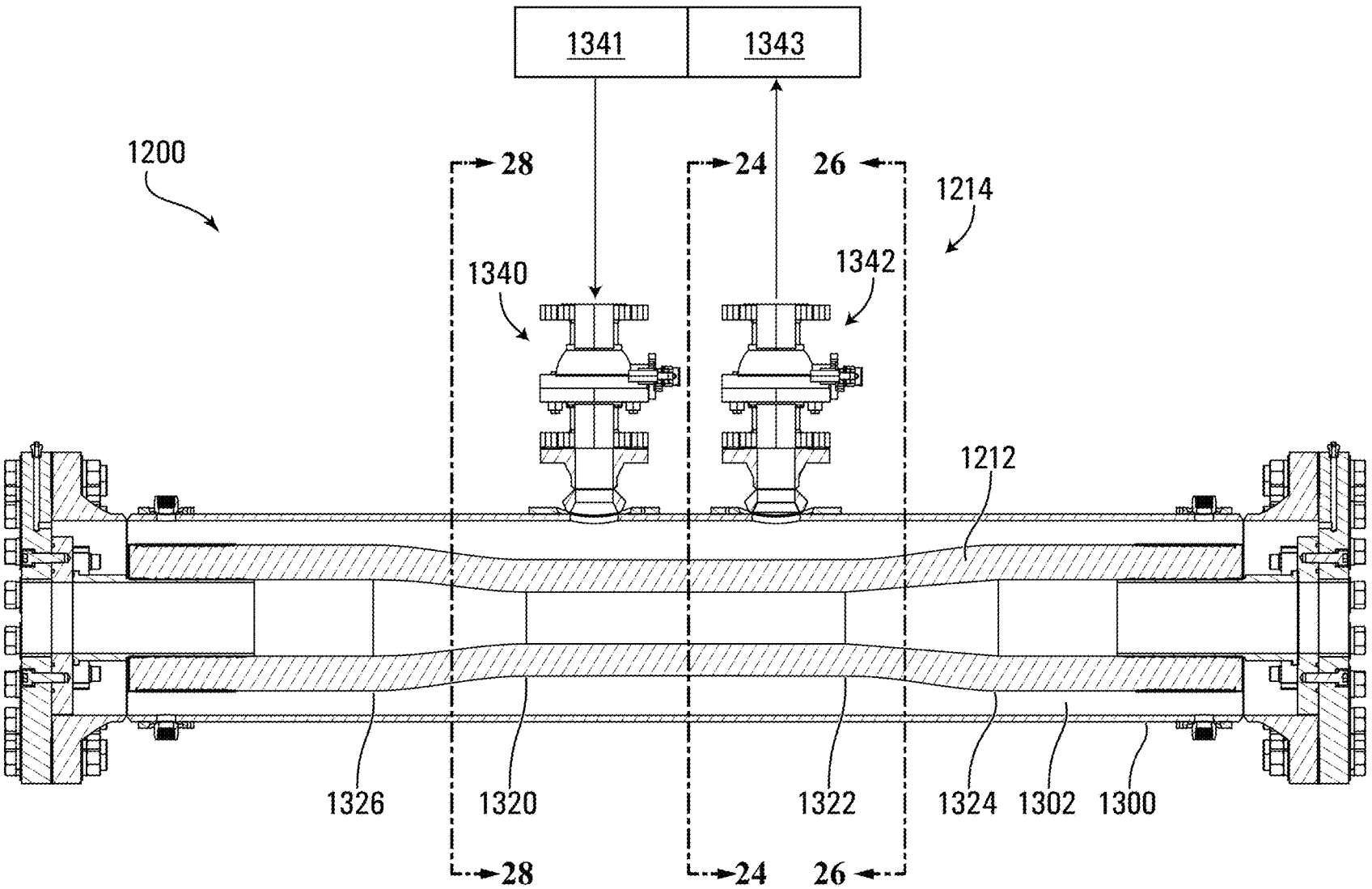
FIG. 23 is a sectional view of the apparatus shown in FIG. 22, according to various embodiments.

Referring to FIG. 22, there is shown at 23 a depiction of a cross-section upon which a sectional view shown in FIG. 23 is taken of the apparatus 1200, in accordance with various embodiments. Referring to FIG. 23, the apparatus 1200 may include a tube 1212, the apparatus 1200 and the tube 1212 having some features generally similar to features included in the apparatus 900 and the tube 912 shown in FIGS. 16-21 or the tube 12 shown in FIGS. 3-6 but configured to function with a hydraulic tube engager to act as a valve for facilitating control of fluid or slurry movement in a collapsible tube. In various embodiments, the apparatus 1200 may include a tube engager 1214 including a vessel 1300 configured to surround the tube 1212 and hold a hydraulic fluid 1302 in engagement with the tube 1212.

Figure 24:
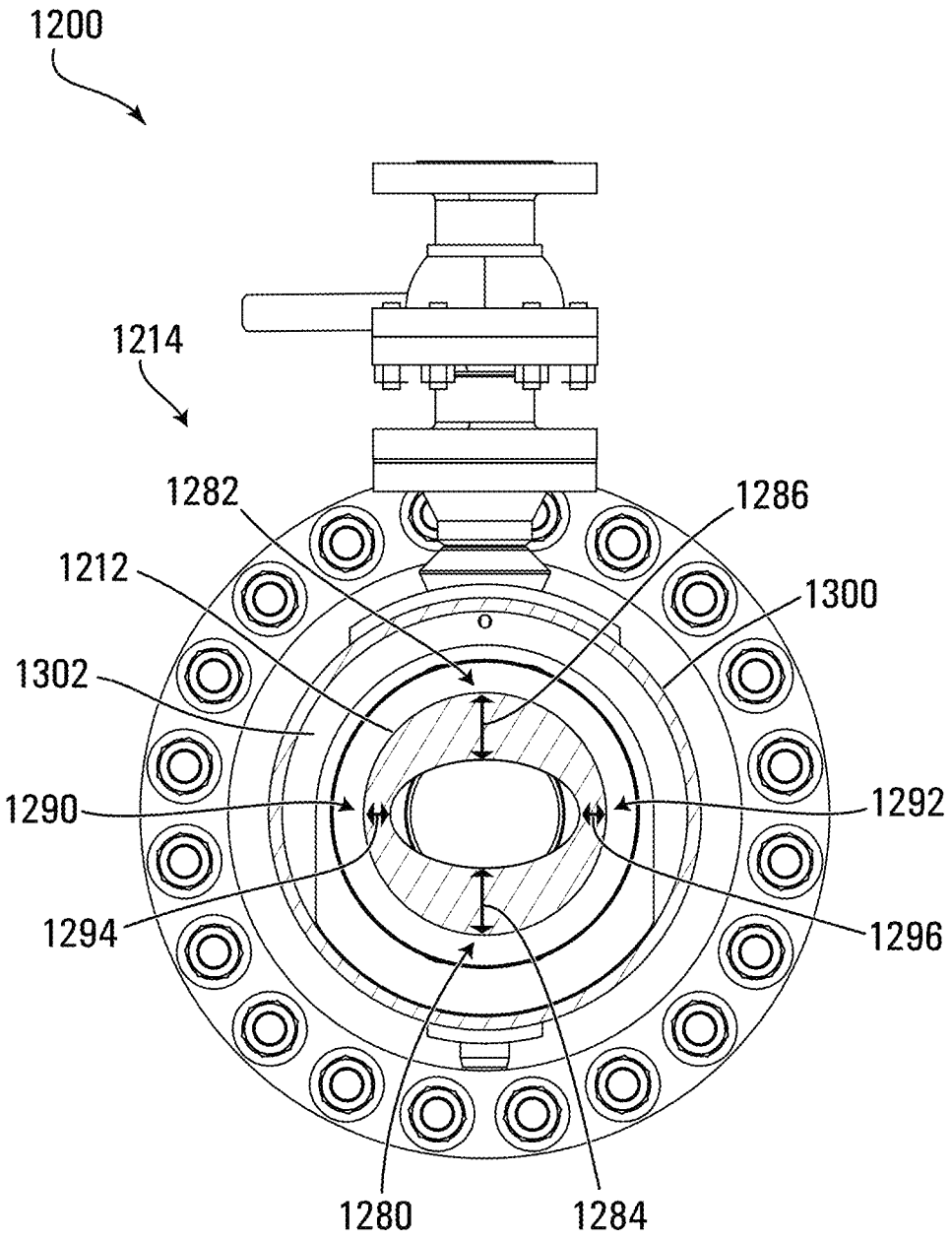
FIG. 24 is a sectional view of the apparatus shown in FIG. 23, according to various embodiments.

Referring to FIG. 23, there is shown at 24, a depiction of a cross-section upon which a sectional view shown in FIG. 24 is taken of the tube 1212 in a relaxed or open state, in accordance with various embodiments.

Referring to FIG. 24, the tube 1212 includes first and second opposing wall portions 1280 and 1282 having circumferentially varying thickness including first and second maximum thicknesses 1284 and 1286 respectively, the first and second maximum thicknesses disposed on opposite sides of the tube 1212. In various embodiments, the tube 1212 includes third and fourth opposing wall portions 1290 and 1292 between the first and second opposing wall portions 1280 and 1282, the third and fourth opposing wall portions 1290 and 1292 having third and fourth circumferentially minimum thicknesses 1294 and 1296 respectively, the third and fourth minimum thicknesses disposed on opposite sides of the tube 1212 about halfway between the first and second maximum thicknesses 1284 and 1286. In various embodiments, the first and second opposing wall portions 1280 and 1282 may be configured to be engaged by the tube engager 1214 to cause the tube 1212 to fold at the third and fourth minimum thicknesses 1294 and 1296 to seal the tube.

Referring to FIG. 23, in various embodiments, the cross-sectional profile of the tube 1212 may be generally constant between longitudinal positions 1320 and 1322. Accordingly, in various embodiments, the first, second, third, and fourth wall portions 1280, 1282, 1290, and 1292 shown in FIG. 22 may extend along a length of the tube 1212 between the longitudinal positions 1320 and 1322 shown in FIG. 23.

In various embodiments, the tube engager 1214 may be configured to selectively increase pressure of the hydraulic fluid 1302 to cause the tube 1212 to fold at the third and fourth minimum thicknesses 1294 and 1296 to seal the tube 1212.

Referring to FIG. 23, the tube engager 1214 may include an isolation valve 1340, in fluid communication between the vessel 1300 and a pressure source shown schematically at 1341. The isolation valve 1340 may be configured to selectively increase the pressure of the hydraulic fluid when the isolation valve 1340 is opened. In some embodiments, the pressure source 1341 may include a pump. In some embodiments, the tube engager 1214 may be configured to open the isolation valve 1340 to increase the pressure of the hydraulic fluid 1302 in the vessel 1300. Referring to FIG. 23, the tube engager 1214 may include an exhaust valve 1342 in fluid communication between the vessel 1300 and an exhaust 1343, the exhaust valve configured to selectively decrease the pressure of the hydraulic fluid 1302 in the vessel 1300 when the exhaust valve 1342 is opened. In various embodiments, the isolation valve 1340 and the exhaust valve 1342 may be generally similar to the isolation valve 1040 and the exhaust valve 1042 described herein and shown in FIG. 17.

In various embodiments, the apparatus 1200 may operate as a valve. In some embodiments, in operation, the tube engager 1214 may be in a first configuration wherein the isolation valve 1340 is closed such that the vessel 1300 is isolated from the pressure source 1341 and the exhaust valve 1342 is open. In various embodiments, in the first configuration, the pressure of the hydraulic fluid 1302 may be at an initial pressure level. In various embodiments, the initial pressure level may be less than 0.1 bar.

In various embodiments, when the tube engager 1214 is in the first configuration, the apparatus 1200 may act as an open valve and fluid or slurry may freely flow through the tube 1212.

Figure 25:
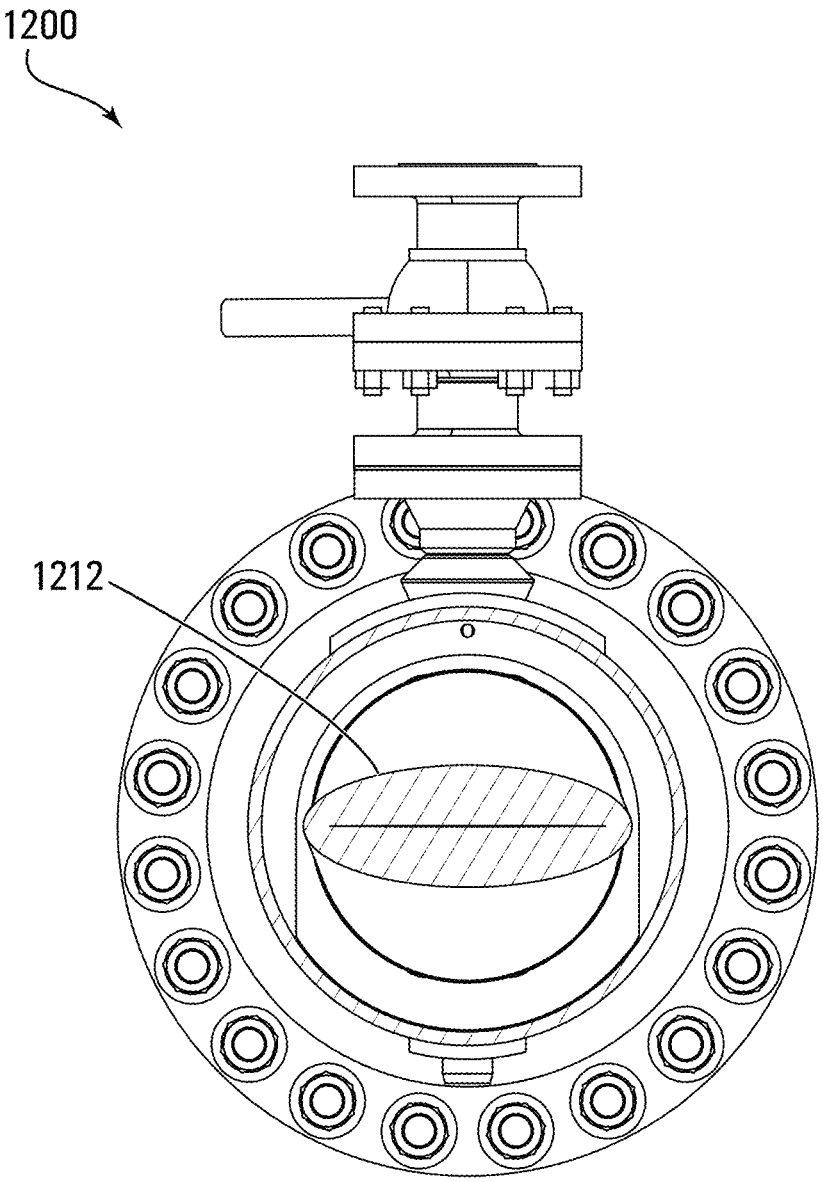
FIG. 25 is a sectional view of the apparatus shown in FIG. 23, according to various embodiments.

Referring to FIG. 23, in various embodiments, the valve may be closed when the tube engager 1214 is put into a second configuration wherein the pressure of the hydraulic fluid 1302 is increased from the initial pressure level to a first pressure level to cause the tube 1212 to fold at the third and fourth minimum thicknesses 1294 and 1296 to seal the tube 912. In various embodiments, in the second configuration, the isolation valve 1340 may be caused to open and the exhaust valve 1342 may be caused to close, such that the pressure of the hydraulic fluid 1302 is increased from the initial pressure level to a first pressure level to cause the tube 1212 to fold at the third and fourth minimum thicknesses 1294 and 1296 to seal the tube 1212 as shown at FIG. 25, which shows the same cross-section shown in FIG. 24, but with the tube engager 1214 in the second configuration and the pressure of the hydraulic fluid 1302 at the first pressure level. In various embodiments, the first pressure level may be between about 0.1 bar and about 50 bar, for example.

In various embodiments, the cross-section 24 on which the sectional view shown in FIG. 24 is taken may depict the shape of the tube 1212 at or near a midpoint of the tube 1212 shown in FIG. 23. In some embodiments, the tube 1212 may have a minimum thickness at or near the cross-section 24 and the thickness of the tube 1212 may be greater at positions spaced longitudinally outward from the cross-section 24. In various embodiments, this change in thickness may facilitate peristaltic pumping effects when the tube 1212 collapses or folds, which may facilitate high pressure sealing and/or improve performance of the apparatus 1200 when acting as a valve. In various embodiments, having increased thickness near the ends of the tube 1212 near the connectors or shanks may facilitate resistance to tearing, reduced wear, and/or improved longevity of the tube 1212.

Figure 26:
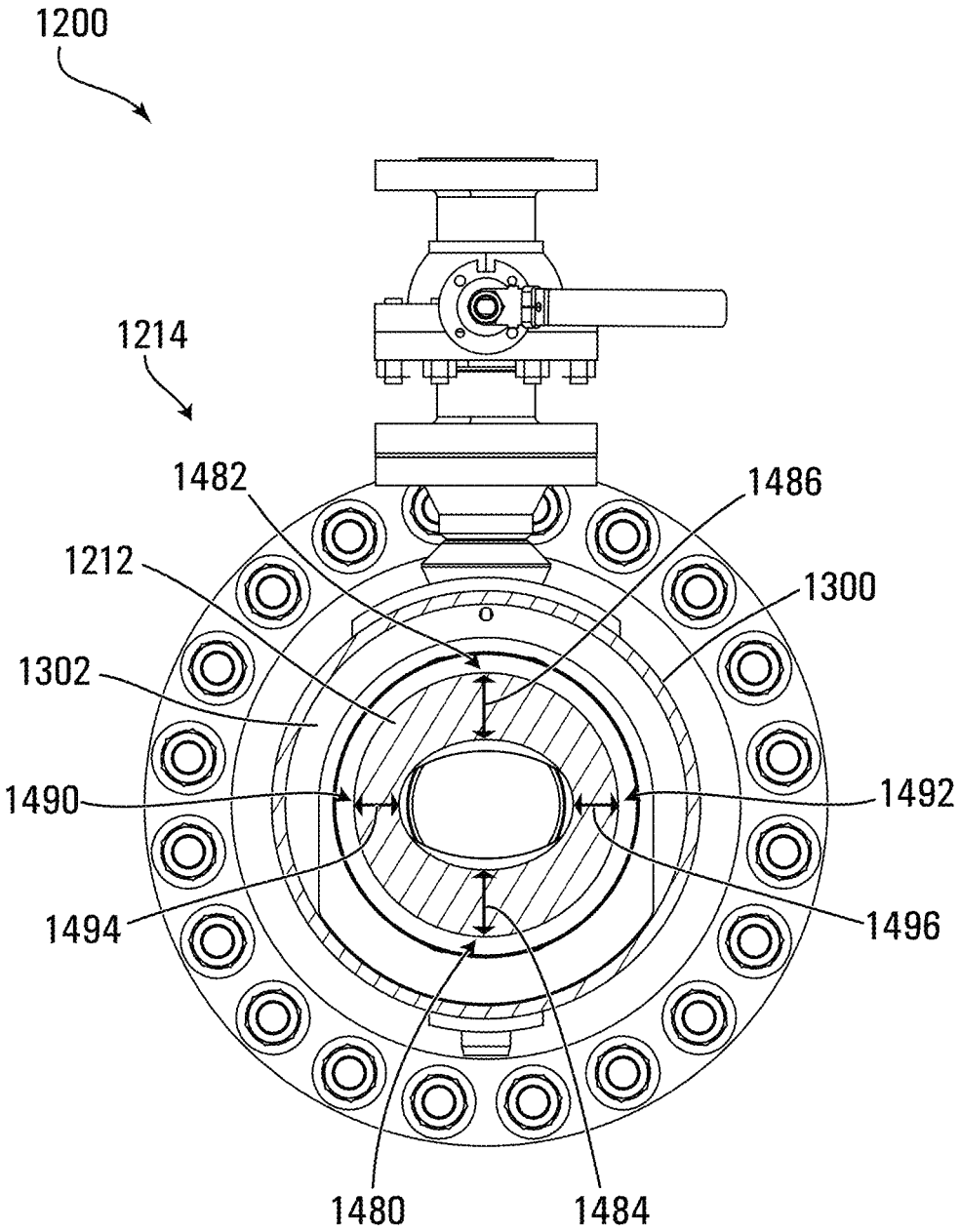
FIG. 26 is a sectional view of the apparatus shown in FIG. 23, according to various embodiments.

Referring to FIG. 23, there is shown at 26 a depiction of a cross-section, longitudinally spaced from the cross-section shown at 24 in FIG. 23, upon which a sectional view shown in FIG. 26 is taken of the tube 1212. Referring to FIG. 26, the tube 1212 includes fifth and sixth opposing wall portions 1480 and 1482 and seventh and eighth opposing wall portions 1490 and 1492 longitudinally spaced from the first, second, third, and fourth wall portions 1280, 1282, 1290 and 1292 (shown in FIG. 24). In some embodiments, the cross-section 26 may show the tube 1212 at a distance about 5 and ⅜ inches from the longitudinal position 1322, where the first, second, third, and fourth wall portions 1280, 1282, 1290, and 1292 end.

In various embodiments, the fifth and sixth opposing wall portions 1480 and 1482 have circumferentially varying thickness including fifth and sixth maximum thicknesses respectively 1484 and 1486, the fifth and sixth maximum thicknesses disposed on opposite sides of the tube 1212. In various embodiments, the seventh and eighth opposing wall portions 1490 and 1492 are disposed between the fifth and sixth opposing wall portions 1480 and 1482, the seventh and eighth opposing wall portions having seventh and eighth circumferentially minimum thicknesses respectively 1494 and 1496, the seventh and eighth minimum thicknesses disposed on opposite sides of the tube 1212 about halfway between the fifth and sixth maximum thicknesses 1484 and 1486.

In various embodiments, the fifth and sixth opposing wall portions 1480 and 1482 may be configured to be engaged by the hydraulic fluid 1302 to cause the tube to fold at the seventh and eighth minimum thicknesses 1494 and 1496 to seal the tube 1212. In various embodiments, the seventh and eighth minimum thicknesses 1494 and 1496 may be greater than the third and fourth minimum thicknesses 1294 and 1296 (shown in FIG. 24) such that the tube 1212 is configured to fold at the seventh and eighth minimum thicknesses 1494 and 1496 when the pressure of the hydraulic fluid 1302 is at a second pressure level greater than the first pressure level at which the tube 1212 is configured to fold at the third and fourth minimum thicknesses. For example, in some embodiments, the third and fourth minimum thicknesses 1294 and 1296 may each be about 1 inch and the seventh and eighth minimum thicknesses 1494 and 1496 may each be about 1 and ¾ inches. In some embodiments, the second pressure level may be about 50 bar.

Figure 27:
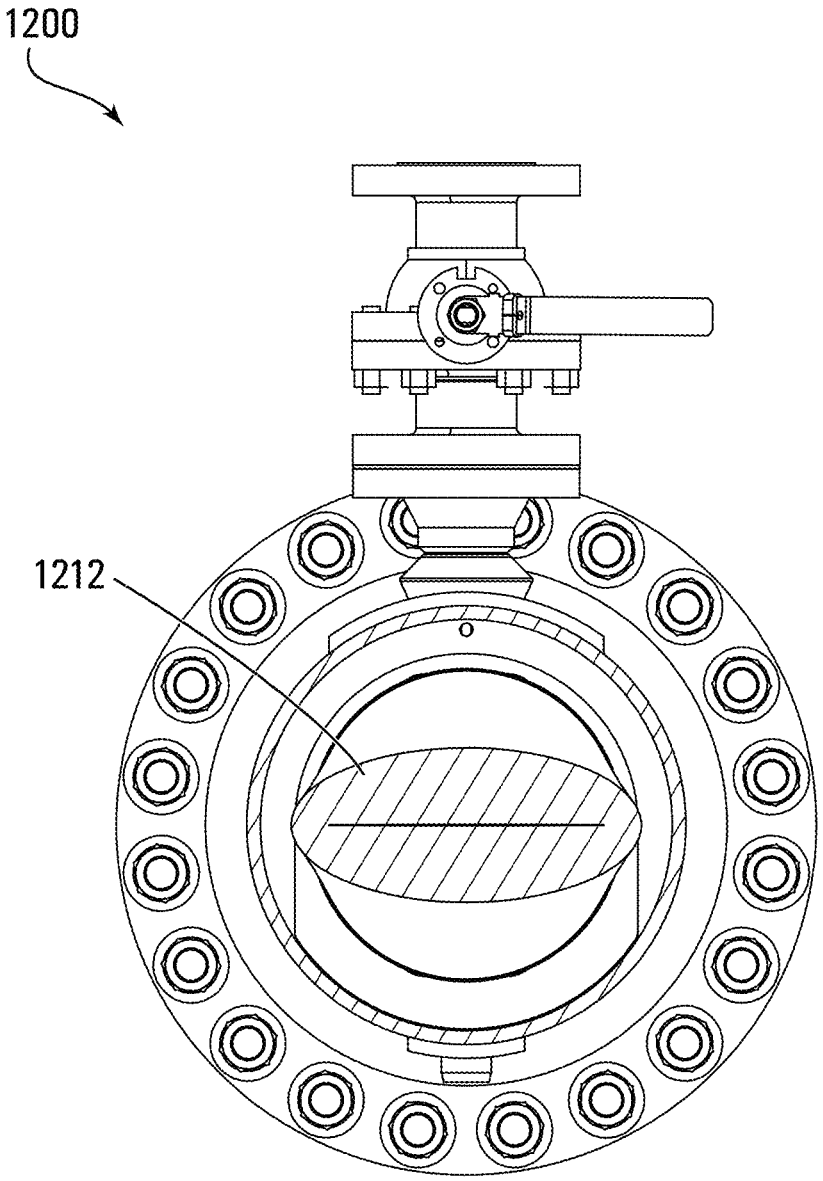
FIG. 27 is a sectional view of the apparatus shown in FIG. 23, according to various embodiments.

Referring to FIG. 27 there is shown the same cross-section depicted in FIG. 26, but with the pressure of the hydraulic fluid 1302 at the second pressure level such that the tube 1212 is folded at the seventh and eighth minimum thicknesses 1494 and 1496 and the tube 1212 is sealed.

Figure 28:
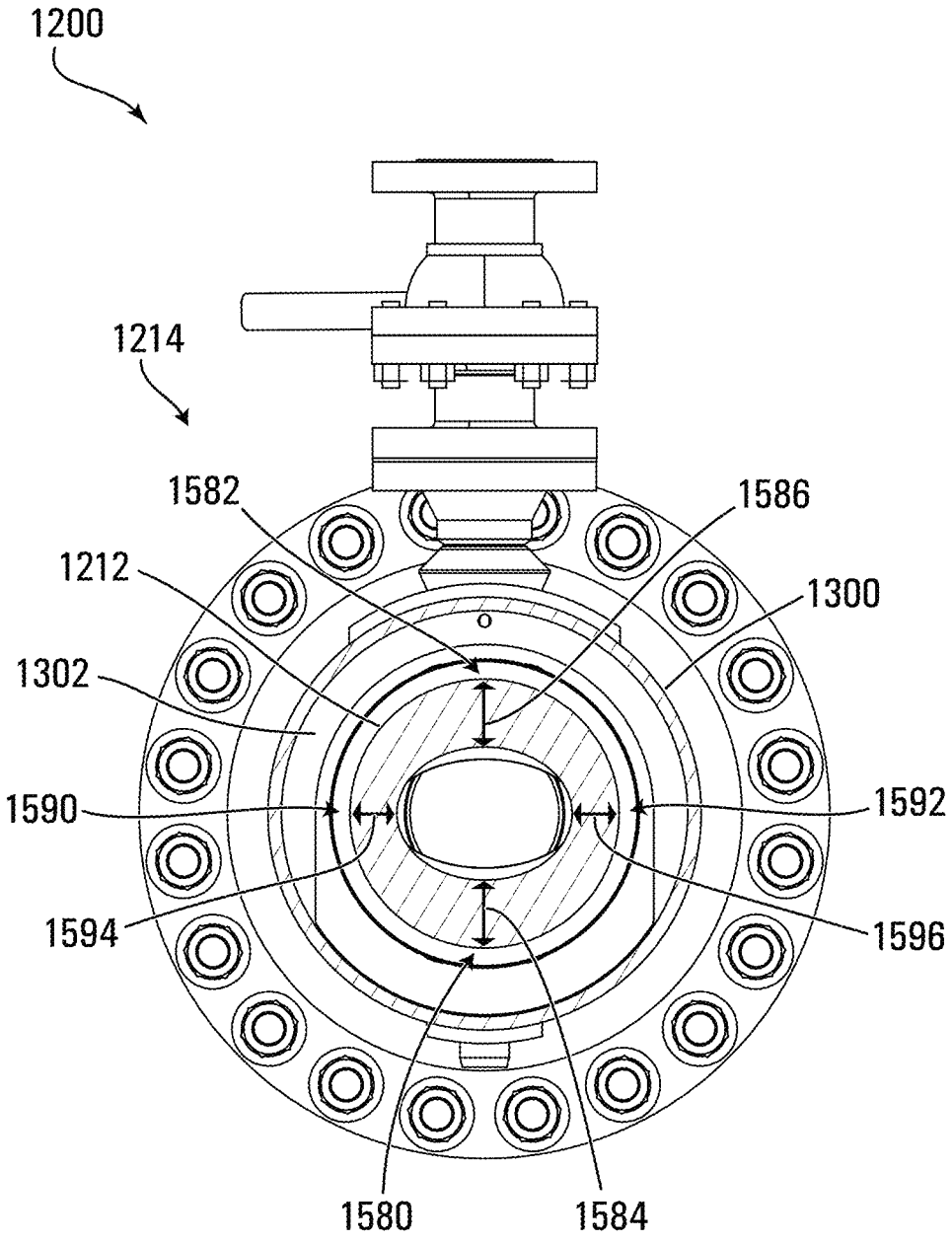
FIG. 28 is a sectional view of the apparatus shown in FIG. 23, according to various embodiments.

Referring to FIG. 23, there is shown at 28 a depiction of a cross-section, longitudinally spaced from the cross-section shown at 24 in FIG. 23, upon which a sectional view shown in FIG. 28 is taken of the tube 1212. Referring to FIG. 28, the tube 1212 includes ninth and tenth opposing wall portions 1580 and 1582 and eleventh and twelfth opposing wall portions 1590 and 1592 longitudinally spaced from the first, second, third, and fourth wall portions 1280, 1282, 1290 and 1292 (shown in FIG. 24) such that the first, second, third, and fourth wall portions are disposed longitudinally between the fifth, sixth, seventh, and eighth wall portions 1480, 1482, 1490 and 1492 (shown in FIG. 26) and the ninth, tenth, eleventh, and twelfth portions 1580, 1582, 1590 and 1592. In some embodiments, the cross-section 28 may show the tube 1212 at a distance about 5 and ⅜ inches from the longitudinal position 1320, where the first, second, third, and fourth wall portions 1280, 1282, 1290, and 1292 end.

In various embodiments, the ninth and tenth opposing wall portions 1580 and 1582 have circumferentially varying thickness including ninth and tenth maximum thicknesses respectively 1584 and 1586, the ninth and tenth maximum thicknesses disposed on opposite sides of the tube 1212. In various embodiments, the eleventh and twelfth opposing wall portions 1590 and 1592 are disposed between the ninth and tenth opposing wall portions 1580 and 1582, the eleventh and twelfth opposing wall portions having eleventh and twelfth circumferentially minimum thicknesses respectively 1594 and 1596, the eleventh and twelfth minimum thicknesses disposed on opposite sides of the tube 1212 about halfway between the ninth and tenth maximum thicknesses 1584 and 1586.

In various embodiments, the ninth and tenth opposing wall portions 1580 and 1582 may be configured to be engaged by the hydraulic fluid 1302 to cause the tube to fold at the eleventh and twelfth minimum thicknesses 1594 and 1596 to seal the tube 1212. In various embodiments, the eleventh and twelfth minimum thicknesses 1594 and 1596 may be greater than the third and fourth minimum thicknesses 1294 and 1296 (shown in FIG. 24) such that the tube 1212 is configured to fold at the eleventh and twelfth minimum thicknesses 1594 and 1596 when the pressure of the hydraulic fluid 1302 is at the second pressure level greater than the first pressure level at which the tube 1212 is configured to fold at the third and fourth minimum thicknesses. For example, in some embodiments, the third and fourth minimum thicknesses 1294 and 1296 may each be about 1 inch and the eleventh and twelfth minimum thicknesses 1594 and 1596 may each be about 1 and ¾ inches. In some embodiments, the second pressure level may be about 50 bar.

In various embodiments, in operation, when the apparatus 1200 acting as a valve is to be closed, the tube engager 1214 may raise the pressure of the hydraulic fluid 1302 from an initial pressure level lower than the first pressure level upwards and through the first pressure level to cause the tube 1212 to fold at the third and fourth minimum thicknesses 1294 and 1296 shown in FIG. 24 to seal the tube 1212. The tube engager 1214 may raise the pressure by opening the isolation valve 1340 and closing the exhaust valve 1342. The tube engager 1214 may continue to raise the pressure of the hydraulic fluid 1302 from the first pressure level to the second pressure level to cause the tube to fold at the seventh and eighth minimum thicknesses 1494 and 1496 shown in FIG. 26 and the eleventh and twelfth minimum thicknesses 1594 and 1596 shown in FIG. 28 to seal the tube, such that fluid or slurry in the tube is peristaltically forced longitudinally from the third and fourth minimum thicknesses outward to the seventh and eighth and eleventh and twelfth minimum thicknesses along the tube when the tube sealed. In various embodiments, the tube engager 1214 may continue to raise the pressure from the first pressure level to the second pressure level by keeping the isolation valve 1340 open and keeping the exhaust valve 1342 closed.

In various embodiments, thickness of the tube 1212 may vary generally linearly longitudinally along the tube 1212 from the third and fourth minimum thicknesses 1284 and 1286 to the seventh and eighth minimum thicknesses 1484 and 1486. In various embodiments, thickness of the tube 1212 may vary generally linearly longitudinally along the tube 1212 from the third and fourth minimum thicknesses 1284 and 1286 to the eleventh and twelfth minimum thicknesses 1584 and 1586. In various embodiments, this may facilitate peristaltic sealing and/or efficient closing of the apparatus 1200 when acting as pinch valve. In some embodiments, a cross-sectional profile of the tube 1212 may change from the shape shown in FIG. 24 at the longitudinal position 1322 shown in FIG. 23 to a generally cylindrical and circular profile having constant circumferential wall thickness at a longitudinal position 1324 shown in FIG. 23. In some embodiments, the wall thickness may be about 2 and 11/16 inches at the longitudinal position 1324. In some embodiments, the outer diameter of the tube 1212 may be about 9 inches at the longitudinal position 1322 and about 11 and ¼ inches at the longitudinal position 1324. In various embodiments, the cross-sectional profile of the tube 1212 from the longitudinal position 1320 to a longitudinal position 1326 shown in FIG. 23 may be generally similar.

In some embodiments, the third and fourth minimum thicknesses 1284 and 1286 may extend longitudinally along the tube 1212. In various embodiments, the cross sectional shape of the tube 1212 may remain constant for a length of the tube 1212 about the cross-section 24 shown in FIG. 23. In some embodiments, the third and fourth minimum thicknesses 1284 and 1286 may extend longitudinally along the tube for a length of at least about 10% of an inner circumference of the tube at the first, second, third, and fourth wall portions 1280, 1282, 1290, and 1292 of the tube 1212. In various embodiments, this may facilitate improved sealing of the tube 1212 and improved performance of the apparatus 1200 as a valve.

In some embodiments, the third and fourth minimum thicknesses 1284 and 1286 may extend longitudinally along the tube for a length of at least about 50% of an inner circumference of the tube at the first, second, third, and fourth wall portions 1280, 1282, 1290, and 1292 of the tube 1212. In various embodiments, this may facilitate further improved sealing of the tube 1212 and improved performance of the apparatus 1200 as a valve.

In some embodiments, the third and fourth minimum thicknesses 1284 and 1286 may extend longitudinally along the tube for a length between the longitudinal positions 1320 and 1322 of about 24 and 9/16 inches.

In various embodiments, use of the tube 1212 in the apparatus 1200 shown in FIGS. 22 to 28 may facilitate being able to employ large diameter high pressure valves. In some embodiments, the tube 1212 may facilitate sealing of the tube, while requiring reduced folding angles and/or wear and tear on the tube 1212.

In some embodiments, one or more valves generally similar to the apparatus 1200 shown in FIG. 23 may be used in place of the inlet valve 1044 and/or the outlet valve 1046 of the apparatus 900 shown in FIG. 17.

In various embodiments, any or all of the apparatuses 10, 400, 600 and/or 900 or an apparatus generally similar may be used as a pinch valve instead of a peristaltic pump.

Figure 29:
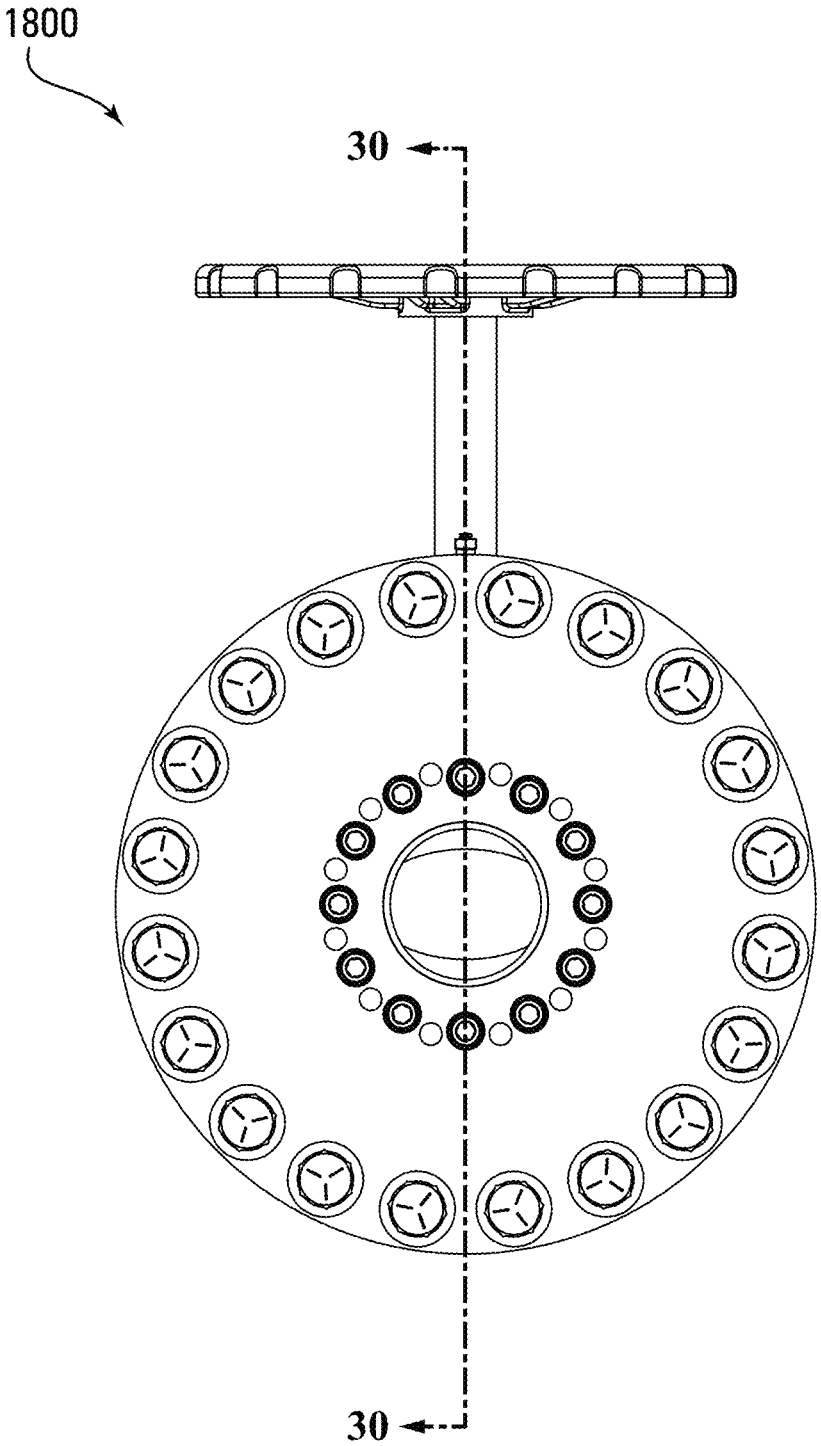
FIG. 29 is an end view of an apparatus for facilitating control of fluid or slurry movement in a collapsible tube, according to various embodiments.

Referring to FIG. 29, there is shown an end view of an apparatus 1800 for facilitating control of fluid or slurry movement in a collapsible tube, according to various embodiments.

Figure 30:
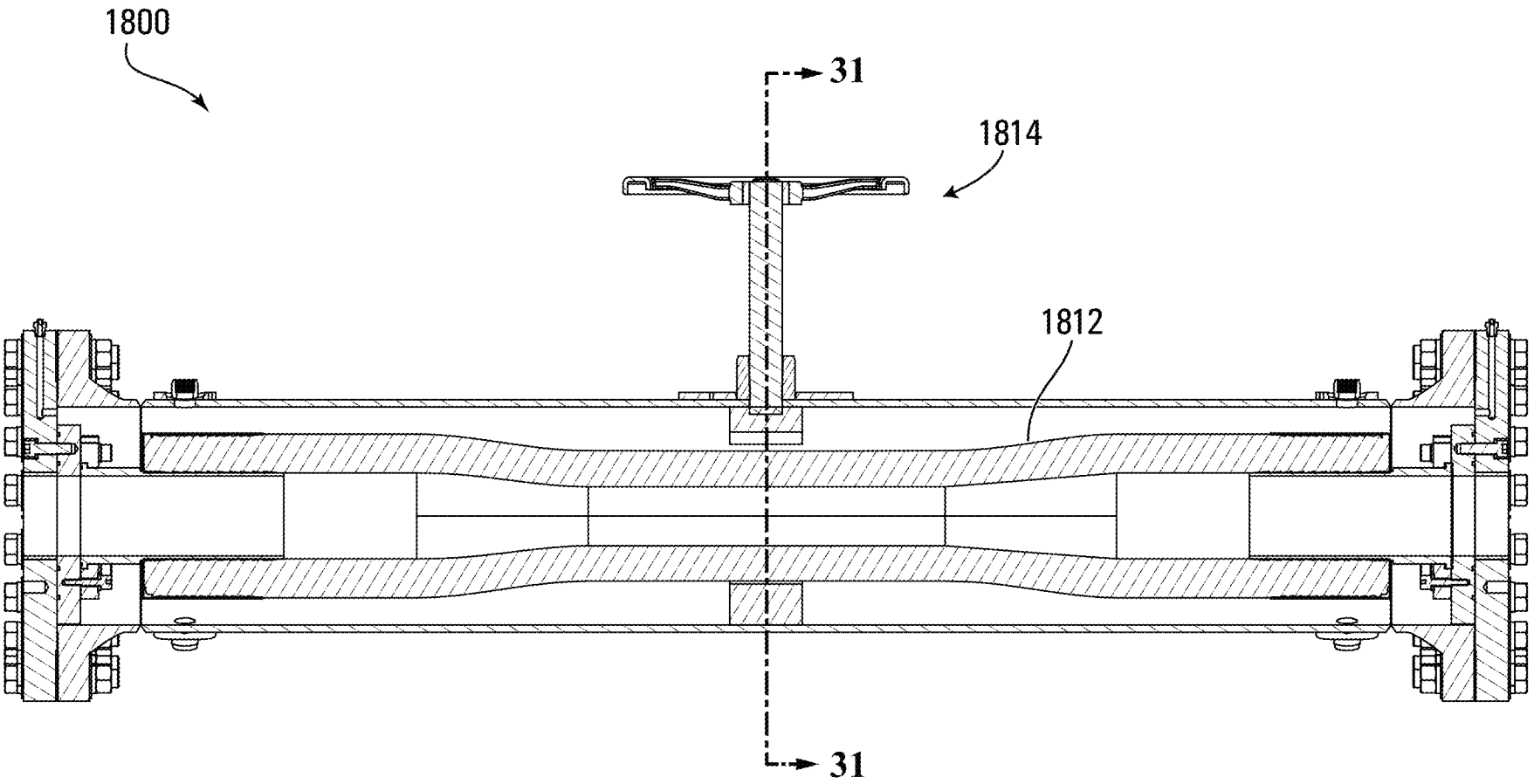
FIG. 30 is a sectional view of the apparatus shown in FIG. 29, according to various embodiments.

Referring to FIG. 29, there is shown at 30 a depiction of a cross-section upon which a sectional view shown in FIG. 30 is taken of the apparatus 1800, in accordance with various embodiments. Referring to FIG. 30, the apparatus 1800 may include a tube 1812, which may include features generally similar to features included in the tube 12 shown in FIGS. 3-6 and 9-11 but configured to function in the apparatus 1800 acting as a mechanical pinch valve.

Figure 31:
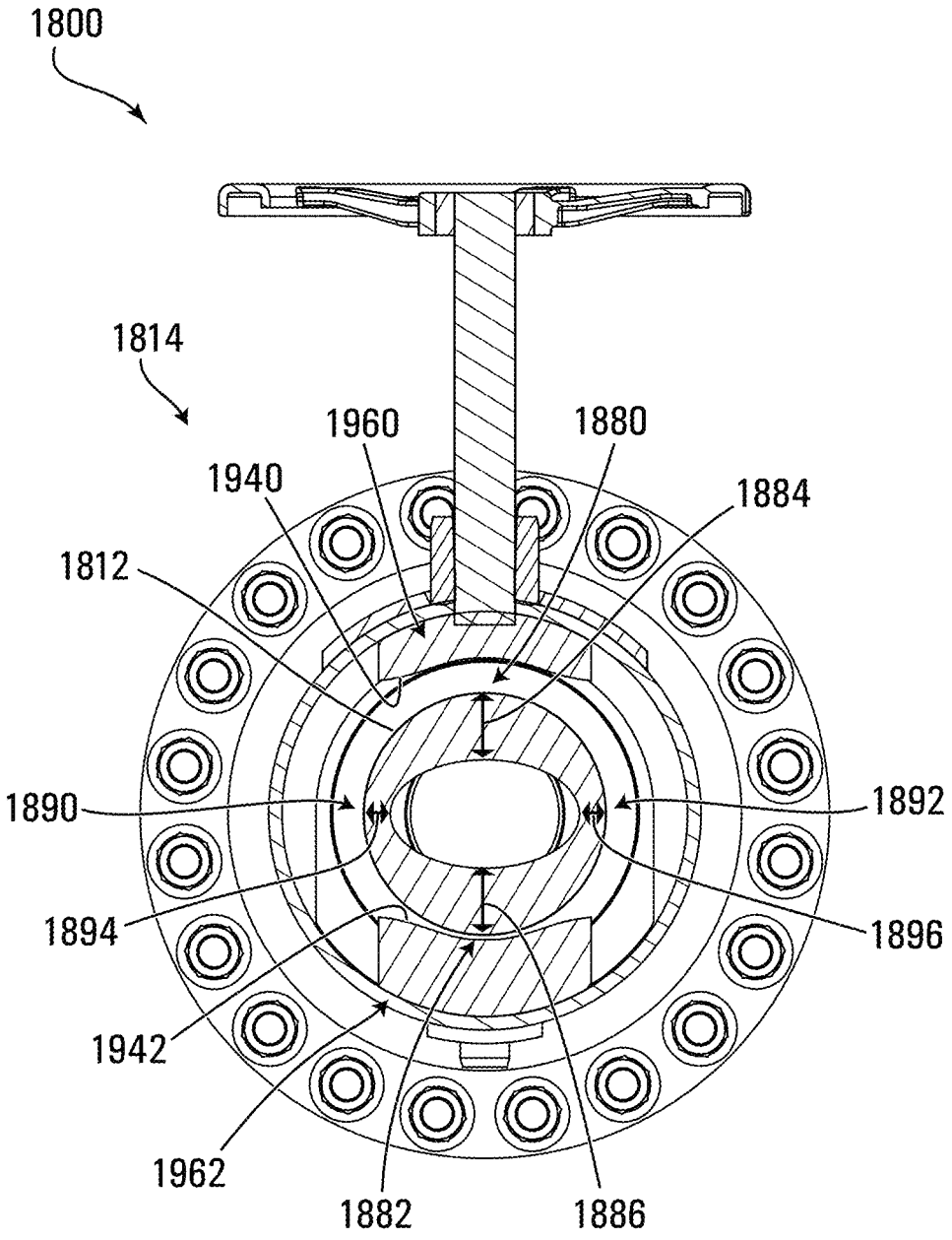
FIG. 31 is a sectional view of the apparatus shown in FIG. 30, according to various embodiments.

Referring to FIG. 30, there is shown at 31, a depiction of a cross-section upon which a sectional view shown in FIG. 31 is taken of the tube 1812 in a relaxed or open state, in accordance with various embodiments.

Referring to FIG. 31, the tube 1812 includes first and second opposing wall portions 1880 and 1882 having circumferentially varying thickness including first and second maximum thicknesses 1884 and 1886 respectively, the first and second maximum thicknesses disposed on opposite sides of the tube 1812. In various embodiments, the tube 1812 includes third and fourth opposing wall portions 1890 and 1892 between the first and second opposing wall portions 1880 and 1882, the third and fourth opposing wall portions 1890 and 1892 having third and fourth circumferentially minimum thicknesses 1894 and 1896 respectively, the third and fourth minimum thicknesses disposed on opposite sides of the tube 1812 about halfway between the first and second maximum thicknesses 1884 and 1886. In various embodiments, the first and second opposing wall portions 1880 and 1882 may be configured to be engaged by the tube engager 1814 to cause the tube 1812 to fold at the third and fourth minimum thicknesses 1894 and 1896 to seal the tube.

Referring to FIG. 30, in various embodiments, the apparatus 1800 may include a tube engager 1814 configured to cause the tube 1812 to fold at the third and fourth minimum thicknesses 1894 and 1896 to seal the tube 1812.

Referring to FIG. 31, in various embodiments, the tube engager 1814 may include first and second tube engaging surfaces 1940 and 1942 configured to engage the first and second opposing wall portions 1880 and 1882 of the tube 1812 respectively to cause the tube to fold to seal the tube. In some embodiments, the cross-sectional shape of the first and second tube engaging surfaces 1940 and 1942 may be generally similar to that of the first and second tube engaging surfaces 140 and 142 shown in FIGS. 6 and 7 and described herein.

Referring to FIG. 31, the tube engager 1814 may include a first press 1960 and a tube engaging wall 1962, which may include the first and second tube engaging surfaces 1940 and 1942 respectively. In various embodiments, the tube engager 1814 may be configured to cause the first press 1960 to press the tube 1812 using the first tube engaging surface 1940 by moving perpendicular to the length of the tube 1812. In various embodiments, the tube engager 1814 may be configured such that the first tube engaging surface 1940 is configured to maintain a longitudinal position along the tube 1812 when folding the tube against the second tube engaging surface 1942 such that the apparatus 1800 acts as a closed pinch valve when the tube is folded and sealed.

In various embodiments, any or all of the same or similar advantages associated with the shape of the tube 12 and the tube engager 14 when used as a peristaltic pump as disclosed herein may be achieved using the shape of the tube 1812 and the tube engager 1814 when the apparatus 1800 shown in FIGS. 29-31 is used as a pinch valve.

In various embodiments, the apparatus 10 shown in FIG. 3 may be configured such that the first and second rollers 160 and 166 can be driven in the direction shown by the arrows 174 and 176 and in the opposite direction.

While specific embodiments of the present disclosure have been described and illustrated, such embodiments should be considered illustrative of the present disclosure only and not as limiting the present disclosure as construed in accordance with the accompanying claims.

The invention claimed is:

1. An apparatus for facilitating control of fluid or slurry movement in a collapsible tube, the apparatus comprising:

the tube and a tube engager;

wherein the tube includes:

first and second opposing wall portions having circumferentially varying thickness including first and second maximum thicknesses respectively, the first and second maximum thicknesses disposed on opposite sides of the tube; and third and fourth opposing wall portions between the first and second opposing wall portions, the third and fourth opposing wall portions having third and fourth circumferentially minimum thicknesses respectively, the third and fourth minimum thicknesses disposed on opposite sides of the tube about halfway between the first and second maximum thicknesses;

wherein the first and second opposing wall portions are configured to be engaged by the tube engager to cause the tube to fold at the third and fourth minimum thicknesses to seal the tube; and wherein the tube engager includes first and second tube engaging surfaces configured to engage the first and second wall portions of the tube respectively to cause the tube to fold at the third and fourth minimum thicknesses to seal the tube, wherein the first and second tube engaging surfaces are configured to define a spacing between the first and second tube engaging surfaces to compress the tube during sealing, the spacing varying along a width of the first and second tube engaging surfaces and having a greatest spacing at around a middle width position of the first and second tube engaging surfaces.

2. The apparatus of claim 1 wherein the apparatus is configured to facilitate fluid or slurry movement in a peristaltic pump and wherein the first and second opposing wall portions are configured to be engaged by the tube engager to cause the tube to fold at the third and fourth minimum thicknesses to peristaltically seal the tube.

3. The apparatus of claim 1 wherein the third and fourth minimum thicknesses each extend less than 10% about a circumference of the tube.

4. The apparatus of claim 3 wherein the third and fourth minimum thicknesses each extend less than 2% about the circumference of the tube.

5. The apparatus of claim 4 wherein the third and fourth minimum thicknesses each extend a negligible portion about the circumference of the tube.

6. The apparatus of claim 1 wherein each of the third and fourth wall portions have circumferentially varying thickness.

7. The apparatus of claim 1 wherein an outer surface of the tube includes outer surfaces of the first, second, third, and fourth wall portions, the outer surface of the tube having a generally circular cross sectional profile when the tube is relaxed.

8. The apparatus of claim 1 wherein an inner surface of the tube includes inner surfaces of the first, second, third, and fourth wall portions, the inner surface of the tube having a generally elliptical cross sectional profile when the tube is relaxed.

9. The apparatus of claim 1 wherein the tube includes a first length portion, the first, second, third, and fourth wall portions extending along the first length portion, and the tube includes a second length portion and a third length portion coupled to opposite ends of the first length portion, wherein the second length portion has a generally constant wall thickness between an inner surface and an outer surface of the second length portion and the third length portion has a generally constant wall thickness between an inner surface and an outer surface of the third length portion.

10. The apparatus of claim 9 wherein the inner surfaces of the second and third length portions of the tube each have a generally circular cross sectional profile.

11. The apparatus of claim 9 wherein the inner surface of the second length portion of the tube, the third length portion of the tube, or both, has a cross sectional circumference greater than 95% of a cross sectional circumference of an inner surface of the first length portion of the tube.

12. The apparatus of claim 11 wherein the cross-sectional circumference of the inner surface of the second length portion, the third length portion, or both is between 95% and 105% of the cross sectional circumference of the inner surface of the first length portion of the tube.

13. The apparatus of claim 9 wherein the tube includes a first transition length portion extending between the first and second length portions and a second transition length portion extending between the first and third length portions, the first and second transition length portions including wall thicknesses that vary generally linearly along lengths of the first and second transition length portions.

14. The apparatus of claim 1 wherein the first and second maximum thicknesses are generally equal and the third and fourth minimum thicknesses are generally equal and a ratio of the first and second maximum thicknesses over the third and fourth minimum thicknesses is between 1.5 and 5.

15. The apparatus of claim 1 wherein the first and second maximum thicknesses are generally equal and the third and fourth minimum thicknesses are generally equal and a ratio of the first and second maximum thicknesses over the third and fourth minimum thicknesses is at least 1.5.

16. The apparatus of claim 15 wherein a cross sectional circumference of an inner surface of the tube at the first, second, third, and fourth wall portions is at least 314 mm.

17. The apparatus of claim 1 wherein the first and second maximum thicknesses are generally equal and the third and fourth minimum thicknesses are generally equal and a ratio of the first and second maximum thicknesses over the third and fourth minimum thicknesses is at least 2.0.

18. The apparatus of claim 17 wherein a cross sectional circumference of an inner surface of the tube at the first, second, third, and fourth wall portions is at least 471 mm.

19. The apparatus of claim 1 wherein the first and second maximum thicknesses are generally equal and the third and fourth minimum thicknesses are generally equal and a ratio of the first and second maximum thicknesses over the third and fourth minimum thicknesses is at least 3.5.

20. The apparatus of claim 19 wherein a cross sectional circumference of an inner surface of the tube at the first, second, third, and fourth wall portions is at least 942 mm.

21. The apparatus of claim 1 wherein each of the third and fourth minimum thicknesses is less than or equal to 35 mm.

22. The apparatus of claim 1 wherein the first tube engaging surface includes, on each side of the middle width position, a plurality of surface portions at respective width positions along the width of the first and second tube engaging surfaces, each of the surface portions of the first tube engaging surface having a distinct non-zero slope relative to the width.

23. The apparatus of claim 22 wherein the slopes of the surface portions increase for a first width as the width positions of the surface portions move outward from the middle width position.

24. The apparatus of claim 22 wherein the slopes of the surface portions decrease for a second width as the width positions of the surface portions move outward from the first width.

25. The apparatus of claim 22 wherein a maximum slope of the slopes of the surface portions is between 20 and 40 degrees.

26. The apparatus of claim 1 wherein the spacing is constant at the greatest spacing for a central width at around the middle width position of the first and second tube engaging surfaces.

27. The apparatus of claim 26 wherein the central width is at least 10% of a width of the first tube engaging surface.

28. The apparatus of claim 27 wherein the central width is between 10% and 30% of the width of the first tube engaging surface.

29. The apparatus of claim 1 wherein the second tube engaging surface is shaped generally as a reflection of the first tube engaging surface at the spacing.

30. The apparatus of claim 1 wherein the second tube engaging surface has a slope that is generally zero and constant along the width of the second tube engaging surface.

31. The apparatus of claim 1 comprising a roller including the first tube engaging surface.

32. The apparatus of claim 1 comprising a tube engaging wall including the second tube engaging surface.

33. The apparatus of claim 1 wherein the first tube engaging surface is configured to maintain a longitudinal position along the tube when folding the tube against the second tube engaging surface such that the apparatus acts as a closed pinch valve when the tube is folded and sealed.

34. The apparatus of claim 1 wherein the first tube engaging surface is configured to travel along a length of the first wall portion while folding the tube against the second tube engaging surface to peristaltically force fluid in the tube along the tube.

35. The apparatus of claim 34 comprising a rotor, the first tube engaging surface pivotably coupled to the rotor, wherein the rotor is configured to rotate to cause the first tube engaging surface to engage the first wall portion of the tube and the second tube engaging surface to engage the second wall portion of the tube to cause the tube to fold at the third and fourth minimum thicknesses to seal the tube and to travel along the length of the first wall portion.

36. The apparatus of claim 35 comprising a driver coupled to the rotor and configured to cause the rotor to rotate.

37. An apparatus for facilitating control of fluid or slurry movement in a collapsible tube, the apparatus comprising the tube and a tube engager, wherein:

the tube includes:

first and second opposing wall portions having circumferentially varying thickness including first and second maximum thicknesses respectively, the first and second maximum thicknesses disposed on opposite sides of the tube;

third and fourth opposing wall portions between the first and second opposing wall portions, the third and fourth opposing wall portions having third and fourth circumferentially minimum thicknesses respectively, the third and fourth minimum thicknesses disposed on opposite sides of the tube about halfway between the first and second maximum thicknesses; and wherein the first and second opposing wall portions are configured to be engaged by the tube engager to cause the tube to fold at the third and fourth minimum thicknesses to seal the tube; and the tube engager includes a vessel configured to surround the tube and hold a hydraulic fluid in engagement with the tube, the tube engager configured to selectively increase pressure of the hydraulic fluid to cause the tube to fold at the third and fourth minimum thicknesses to seal the tube; and the tube includes fifth and sixth opposing wall portions and seventh and eighth opposing wall portions longitudinally spaced from the first, second, third, and fourth wall portions and wherein:

the fifth and sixth opposing wall portions have circumferentially varying thickness including fifth and sixth maximum thicknesses respectively, the fifth and sixth maximum thicknesses disposed on opposite sides of the tube;

the seventh and eighth opposing wall portions are disposed between the fifth and sixth opposing wall portions, the seventh and eighth opposing wall portions having seventh and eighth circumferentially minimum thicknesses respectively, the seventh and eighth minimum thicknesses disposed on opposite sides of the tube about halfway between the fifth and sixth maximum thicknesses;

the fifth and sixth opposing wall portions are configured to be engaged by the hydraulic fluid to cause the tube to fold at the seventh and eighth minimum thicknesses to seal the tube; and the seventh and eighth minimum thicknesses are greater than the third and fourth minimum thicknesses such that the tube is configured to fold at the third and fourth minimum thicknesses when the pressure of the hydraulic fluid is at a first pressure level and the tube is configured to fold at the seventh and eighth minimum thicknesses when the pressure of the hydraulic fluid is at a second pressure level greater than the first pressure level.

38. The apparatus of claim 37 wherein thickness of the tube varies generally linearly longitudinally along the tube from the third and fourth minimum thicknesses to the seventh and eighth minimum thicknesses.

39. The apparatus of claim 37 wherein the fifth and sixth maximum thicknesses are greater than the first and second maximum thicknesses.

40. The apparatus of claim 37 comprising an isolation valve in fluid communication between the vessel and a pressure source, the isolation valve configured to selectively increase the pressure of the hydraulic fluid in the vessel when the isolation valve is opened and an exhaust valve in fluid communication between the vessel and an exhaust, the exhaust valve configured to selectively decrease the pressure of the hydraulic fluid in the vessel when the exhaust valve is opened.

41. The apparatus of claim 37 comprising an inlet valve configured to selectively open to provide fluid to the tube and an outlet valve configured to selectively open to facilitate flow of fluid out of the tube.

42. The apparatus of claim 37 wherein the tube engager is configured to raise the pressure of the hydraulic fluid from an initial pressure level lower than the first pressure level upwards and through the first pressure level to cause the tube to fold at the third and fourth minimum thicknesses to seal the tube and to continue raising the pressure of the hydraulic fluid from the first pressure level to the second pressure level to cause the tube to fold at the seventh and eighth minimum thicknesses to seal the tube, such that fluid or slurry in the tube is peristaltically forced longitudinally from the third and fourth minimum thicknesses to the seventh and eighth minimum thicknesses along the tube.

43. The apparatus of claim 37 wherein the tube includes ninth and tenth opposing wall portions and eleventh and twelfth opposing wall portions longitudinally spaced from the first, second, third, and fourth wall portions such that the first, second, third, and fourth wall portions are disposed longitudinally between the fifth, sixth, seventh, and eighth wall portions and the ninth, tenth, eleventh, and twelfth portions and wherein:

the ninth and tenth opposing wall portions have circumferentially varying thickness including ninth and tenth maximum thicknesses respectively, the ninth and tenth maximum thicknesses disposed on opposite sides of the tube;

the eleventh and twelfth opposing wall portions are disposed between the ninth and tenth opposing wall portions, the eleventh and twelfth opposing wall portions having eleventh and twelfth circumferentially minimum thicknesses respectively, the eleventh and twelfth minimum thicknesses disposed on opposite sides of the tube about halfway between the ninth and tenth maximum thicknesses;

the ninth and tenth opposing wall portions are configured to be engaged by the hydraulic fluid to cause the tube to fold at the eleventh and twelfth minimum thicknesses to seal the tube; and the eleventh and twelfth minimum thicknesses are greater than the third and fourth minimum thicknesses such that the tube is configured to fold at the eleventh and twelfth minimum thicknesses when the pressure of the hydraulic fluid is at the second pressure level greater than the first pressure level.

44. The apparatus of claim 43 wherein the tube engager is configured to raise the pressure of the hydraulic fluid from an initial pressure level lower than the first pressure level upwards and through the first pressure level to cause the tube to fold at the third and fourth minimum thicknesses to seal the tube and to continue raising the pressure of the hydraulic fluid from the first pressure level to the second pressure level to cause the tube to fold at the seventh and eighth minimum thicknesses and the eleventh and twelfth minimum thicknesses to seal the tube, such that fluid or slurry in the tube is peristaltically forced longitudinally from the third and fourth minimum thicknesses outward to the seventh and eighth minimum thicknesses and the eleventh and twelfth minimum thicknesses along the tube when the tube sealed.

45. The apparatus of claim 43 wherein thickness of the tube varies generally linearly longitudinally along the tube from the third and fourth minimum thicknesses to the eleventh and twelfth minimum thicknesses.

46. The apparatus of claim 45 wherein the third and fourth minimum thicknesses extend longitudinally along the tube for a length of at least 10% of an inner circumference of the tube at the first, second, third, and fourth wall portions of the tube.

47. The apparatus of claim 46 wherein the third and fourth minimum thicknesses extend longitudinally along the tube for a length of at least 50% of the inner circumference of the tube at the first, second, third, and fourth wall portions of the tube.

48. An apparatus for facilitating control of fluid or slurry movement in a collapsible tube, the apparatus comprising the tube including:

first and second opposing wall portions having circumferentially varying thickness including first and second maximum thicknesses respectively, the first and second maximum thicknesses disposed on opposite sides of the tube; and third and fourth opposing wall portions between the first and second opposing wall portions, the third and fourth opposing wall portions having third and fourth circumferentially minimum thicknesses respectively, the third and fourth minimum thicknesses disposed on opposite sides of the tube about halfway between the first and second maximum thicknesses;

wherein the first and second opposing wall portions are configured to be engaged by a tube engager to cause the tube to fold at the third and fourth minimum thicknesses to seal the tube; and wherein the tube includes a first length portion, the first, second, third, and fourth wall portions extending along the first length portion, and the tube includes a second length portion and a third length portion coupled to opposite ends of the first length portion, wherein the second length portion has a generally constant wall thickness between an inner surface and an outer surface of the second length portion and the third length portion has a generally constant wall thickness between an inner surface and an outer surface of the third length portion.

49. The apparatus of claim 48 wherein the apparatus is configured to facilitate fluid or slurry movement in a peristaltic pump and wherein the first and second opposing wall portions are configured to be engaged by the tube engager to cause the tube to fold at the third and fourth minimum thicknesses to peristaltically seal the tube.

50. The apparatus of claim 48 wherein the third and fourth minimum thicknesses each extend less than 10% about a circumference of the tube.

51. The apparatus of claim 50 wherein the third and fourth minimum thicknesses each extend less than 2% about the circumference of the tube.

52. The apparatus of claim 51 wherein the third and fourth minimum thicknesses each extend a negligible portion about the circumference of the tube.

53. The apparatus of claim 48 wherein each of the third and fourth wall portions have circumferentially varying thickness.

54. The apparatus of claim 48 wherein an outer surface of the tube includes outer surfaces of the first, second, third, and fourth wall portions, the outer surface of the tube having a generally circular cross sectional profile when the tube is relaxed.

55. The apparatus of claim 48 wherein an inner surface of the tube includes inner surfaces of the first, second, third, and fourth wall portions, the inner surface of the tube having a generally elliptical cross sectional profile when the tube is relaxed.

56. The apparatus of claim 48 wherein the inner surfaces of the second and third length portions of the tube each have a generally circular cross sectional profile.

57. The apparatus of claim 48 wherein the inner surface of the second length portion of the tube, the third length portion of the tube, or both, has a cross sectional circumference greater than 95% of a cross sectional circumference of an inner surface of the first length portion of the tube.

58. The apparatus of claim 57 wherein the cross-sectional circumference of the inner surface of the second length portion, the third length portion, or both is between 95% and 105% of the cross sectional circumference of the inner surface of the first length portion of the tube.

59. The apparatus of claim 48 wherein the tube includes a first transition length portion extending between the first and second length portions and a second transition length portion extending between the first and third length portions, the first and second transition length portions including wall thicknesses that vary generally linearly along lengths of the first and second transition length portions.

60. The apparatus of claim 48 wherein the first and second maximum thicknesses are generally equal and the third and fourth minimum thicknesses are generally equal and a ratio of the first and second maximum thicknesses over the third and fourth minimum thicknesses is between 1.5 and 5.

61. The apparatus of claim 48 wherein the first and second maximum thicknesses are generally equal and the third and fourth minimum thicknesses are generally equal and a ratio of the first and second maximum thicknesses over the third and fourth minimum thicknesses is at least 1.5.

62. The apparatus of claim 61 wherein a cross sectional circumference of an inner surface of the tube at the first, second, third, and fourth wall portions is at least 314 mm.

63. The apparatus of claim 48 wherein the first and second maximum thicknesses are generally equal and the third and fourth minimum thicknesses are generally equal and a ratio of the first and second maximum thicknesses over the third and fourth minimum thicknesses is at least 2.0.

64. The apparatus of claim 63 wherein a cross sectional circumference of an inner surface of the tube at the first, second, third, and fourth wall portions is at least 471 mm.

65. The apparatus of claim 48 wherein the first and second maximum thicknesses are generally equal and the third and fourth minimum thicknesses are generally equal and a ratio of the first and second maximum thicknesses over the third and fourth minimum thicknesses is at least 3.5.

66. The apparatus of claim 65 wherein a cross sectional circumference of an inner surface of the tube at the first, second, third, and fourth wall portions is at least 942 mm.

67. The apparatus of claim 48 wherein each of the third and fourth minimum thicknesses is less than or equal to 35 mm.

* * * * *